US012735830B2

(12) United States Patent
Heo et al.

(10) Patent No.: US 12,735,830 B2
(45) Date of Patent: Sep. 15, 2026

(54) CLOTHING TREATMENT APPARATUS

(71) Applicant: LG Electronics Inc., Seoul (KR)

(72) Inventors: Junyi Heo, Seoul (KR); Bohyun Nam, Seoul (KR); Donghwan Lee, Seoul (KR); Wonjun Lee, Seoul (KR); Seonkyu Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 915 days.

(21) Appl. No.: 17/912,363

(22) PCT Filed: Mar. 17, 2021

(86) PCT No.: PCT/KR2021/003300
§ 371 (c)(1),
(2) Date: Sep. 16, 2022

(87) PCT Pub. No.: WO2021/187890
PCT Pub. Date: Sep. 23, 2021

(65) Prior Publication Data

US 2023/0116412 A1 Apr. 13, 2023

Related U.S. Application Data

(60) Provisional application No. 62/991,080, filed on Mar. 18, 2020.

(30) Foreign Application Priority Data

Mar. 17, 2021 (KR) ..... 10-2021-0034679

(51) Int. Cl.
*D06F 71/10* (2006.01)
*A47G 25/14* (2006.01)
(Continued)

(52) U.S. Cl.
CPC ..... *D06F 58/12* (2013.01); *A47G 25/1442* (2013.01); *D06F 58/203* (2013.01)

(58) Field of Classification Search
CPC ..... D06F 25/00; D06F 58/12; D06F 58/30; D06F 58/203; D06F 71/10; D06F 71/12; F06F 37/263; F06F 73/00; F06F 73/02
(Continued)

(56) References Cited

U.S. PATENT DOCUMENTS 3,739,496 A 6/1973 Buckley et al.
2010/0043247 A1 2/2010 Park et al.
(Continued)

FOREIGN PATENT DOCUMENTS

CN 102282309 A 12/2011
CN 102301061 A 12/2011
(Continued)

OTHER PUBLICATIONS

English translation of JP2002000997 by PE2E, May 28, 2025.*
(Continued)

*Primary Examiner* — Deming Wan
(74) *Attorney, Agent, or Firm* — Fish & Richardson P.C.

(57) ABSTRACT

The present disclosure relates to a clothing treatment apparatus comprising: a cabinet having an input hole formed on one surface thereof; a clothing treatment chamber positioned inside the cabinet so as to accommodate clothing; a hanger part including hangers on which the clothing is hung; and a back-and-forth moving part for generating rotating force in order to move the hanger part back and forth, wherein the hanger part and the back-and-forth moving part are horizontally coupled.

20 Claims, 52 Drawing Sheets

(51) Int. Cl.

| | |
|---|---|
| ***D06F 37/26*** | (2006.01) |
| ***D06F 58/10*** | (2006.01) |
| ***D06F 58/12*** | (2006.01) |
| ***D06F 58/20*** | (2006.01) |
| ***D06F 71/12*** | (2006.01) |
| ***D06F 73/00*** | (2006.01) |
| ***D06F 73/02*** | (2006.01) |

(58) Field of Classification Search
USPC ..... 68/5 C; 34/621
See application file for complete search history.

(56) References Cited

U.S. PATENT DOCUMENTS

| | | | |
|---|---|---|---|
| 2014/0238086 | A1 | 8/2014 | Choi et al. |
| 2019/0211497 | A1 | 7/2019 | Kim et al. |

FOREIGN PATENT DOCUMENTS

| | | | | | |
|---|---|---|---|---|---|
| CN | 104120599 | A | | 10/2014 | |
| CN | 106948150 | A | * | 7/2017 | ..... D06F 73/00 |
| CN | 109567422 | A | | 4/2019 | |
| CN | 110552133 | A | | 12/2019 | |
| CN | 110886074 | A | | 3/2020 | |
| EP | 3034678 | | | 6/2016 | |
| JP | S53-68470 | | | 6/1978 | |
| JP | 2001-347100 | A | | 12/2001 | |
| JP | 2002-000997 | | | 1/2002 | |
| JP | 2002000997 | A | * | 1/2002 | ..... D06F 58/10 |
| JP | 2005-329104 | | | 12/2005 | |
| JP | 2007-237068 | A | | 9/2007 | |
| JP | 6355075 | B2 | | 7/2018 | |
| KR | 10-2010-0022383 | A | | 3/2010 | |
| KR | 10-2010-0022798 | A | | 3/2010 | |
| KR | 10-2010-0022800 | A | | 3/2010 | |
| KR | 20130028434 | | | 3/2013 | |
| KR | 10-1456210 | | | 11/2014 | |
| KR | 10-1525569 | | | 6/2015 | |
| KR | 101597111 | | | 2/2016 | |
| KR | 10-2016-0028799 | A | | 3/2016 | |
| KR | 20160028798 | | | 3/2016 | |
| KR | 101859958 | | | 5/2018 | |
| KR | 101954032 | | | 3/2019 | |
| KR | 20190124678 | | | 11/2019 | |
| KR | 20200003957 | | | 1/2020 | |
| KR | 10-2020-0017633 | A | | 2/2020 | |
| KR | 10-2020- 0028185 | | | 3/2020 | |
| KR | 20200028184 | | | 3/2020 | |
| RU | 2576509 | | | 3/2016 | |
| WO | WO 2019112354 | A1 | | 6/2019 | |
| WO | WO 2019112387 | | | 6/2019 | |
| WO | 2020/050637 | A1 | | 3/2020 | |

OTHER PUBLICATIONS

English translation of CN106948160 by PE2E May 28, 2025.*
Office Action in Russian Appln. No. 2022126903, mailed on Mar. 14, 2023, 11 pages(with English translation).
Office Action in Russian Appln. No. 2022126906, mailed on Mar. 14, 2023, 11 pages(with English translation).
Office Action in Japanese Appln. No. 2022-556117, mailed on Oct. 24, 2023, 12 pages (with English translation).
Office Action in Japanese Appln. No. 2022-556124, mailed on Oct. 3, 2023, 14 pages (with English translation).
Office Action in Chinese Appln. No. 202180022415.7, mailed on Feb. 25, 2025, 19 pages (with English translation).
Office Action in Chinese Appln. No. 202180022425.0, mailed on Feb. 27, 2025, 16 pages (with English translation).
International Search Report and Written Opinion in International Appln. No. PCT/KR2021/003299, dated Jun. 18, 2021, 22 pages (with English translation).
International Search Report and Written Opinion in International Appln. No. PCT/KR2021/003300, dated Jul. 5, 2021, 16 pages (with English translation).
Extended European Search Report in European Appln. No. 21771149.8, mailed on Feb. 7, 2024, 8 pages.
Notice of Allowance in Japanese Appln. No. 2022-556117, mailed on Apr. 16, 2024, 5 pages (with English translation).
Office Action in Korean Appln. No. 10-2021-0034678, mailed on Jul. 23, 2024, 18 pages (with English translation).
Office Action in Korean Appln. No. 10-2021-0034679, mailed on Jul. 23, 2024, 6 pages.
Notice of Allowance in Korean Appln. No. 10-2021-0034679, mailed on Oct. 24, 2025, 3 pages (with English translation).
Notice of Allowance in U.S. Appl. No. 17/912,326, mailed on Jan. 21, 2026, 9 pages.
Office Action in U.S. Appl. No. 17/912,326, mailed on Sep. 3, 2025, 16 pages.

* cited by examiner (b)

(a)

(b)

(a)

(b)

(a)

(b)

(a)

(b)

(a)

(a) (b)

(a)

(b)

(a)

(b)

(b)

(a)

(a)

(b)

(a)

(b)

CLOTHING TREATMENT APPARATUS

CROSS-REFERENCE TO RELATED APPLICATIONS

This application is a National Stage application under 35 U.S.C. § 371 of International Application No. PCT/KR2021/003300, filed on Mar. 17, 2021, which claims the benefit of Korean Application No. 10-2021-0034679, filed on Mar. 17, 2021, and U.S. Provisional Application No. 62/991,080, filed on Mar. 18, 2020. The disclosures of the prior applications are incorporated by reference in their entirety.

TECHNICAL FIELD

The present disclosure relates to a laundry treating apparatus. More specifically, the present disclosure relates to a hanger assembly that hangs laundry thereon.

BACKGROUND ART

A laundry treating apparatus refers to an apparatus developed for washing and drying laundry at home and in a laundry, and for removing wrinkles on the laundry. What is classified as the laundry treating apparatus includes a washing machine that washes the laundry, a dryer that dries the laundry, a washing machine/dryer that has both a washing function and a drying function, a laundry manager that refreshes the laundry, a steamer that removes the wrinkles from the laundry, and the like.

The steamer is an apparatus that supplies steam to the laundry to remove wrinkles from the laundry. Unlike a regular iron, the steamer is an apparatus that removes the wrinkles by applying heat to the laundry via convection rather than directly heating the laundry (e.g., in a scheme of allowing the laundry to be in contact with a hard object).

On the other hand, the laundry manager is an apparatus that allows the laundry to be maintained pleasant and clean. The laundry manager may shake off fine dust attached to the laundry, deodorize the laundry, dry the laundry, and add aroma to the laundry. In addition, generation of static electricity may be prevented, the wrinkles on the laundry may be removed using dehumidified air or steam, and the laundry may be sterilized.

According to Korean Patent No. 10-1456210, disclosed is a hanger bar capable of reciprocating so as to shake off fine dust attached to the laundry. However, disclosed is a hanger bar that reciprocates by a crankshaft and a connecting rod disposed in a motor for the reciprocating motion of the hanger bar. However, because the motor and the hanger bar are arranged in parallel with a width direction of the cabinet, there is a problem that, for the reciprocating motion of the hanger bar, a force is applied not only in the width direction of the cabinet, but also in a height direction of the cabinet, which is unnecessary.

According to Korean Patent No. 10-1525569, disclosed is a structure in which the motor and the hanger bar are connected to each other vertically and thus only the force in the width direction required for the reciprocating motion of the hanger bar is transmitted. Because the vertical coupling structure of the driver for the reciprocating motion occupies a lot of space in the height direction, there is a problem in that a space for the driver located above a laundry accommodation space is not able to be efficiently utilized.

In addition, because the hanger bar is always exposed to the accommodation space, even in order to treat only one clothes hanged on the hanger bar, an entirety of the accommodation space had to be used to perform a steam cycle or a dry cycle. In addition, an object-to-be-dried including the clothes, such as silk or knitted clothes, large dolls, scarves, and hats, may be mounted on a shelf without the hanger bar so as to be treated. There is a problem that there is a space limitation as much as a space occupied by the hanger bar.

According to Korean Patent No. 10-2020-0028185, disclosed is a structure in which the hanger bars are able to move forward as well as reciprocate. However, because the hanger bars always move together at fixed positions, there is a problem that the accommodation space of the laundry is not able to be utilized in a divided manner. In addition, in the hanger bar, because positions of grooves capable of mounting therein clothes hangers on which the clothes are hanged are fixed, there is a limit in adjusting a spacing between the clothes.

In addition, a normal clothes hanger that may be used in the laundry treating apparatus has a problem that, in a case of clothes with a great shoulder length (or shoulder width), which is a length between ends of both shoulders, the clothes hanger may not be mounted or the clothes may be crammed due to a size of the accommodation space. In one example, the clothes may be accommodated in a diagonal direction with respect to the accommodation space as a user arbitrarily rotate a hook of the clothes hanger, but the rotation of the hook is not fixed because the clothes shakes during the reciprocating motion of the hanger bar.

DISCLOSURE

Technical Problem

The present disclosure is to reduce a size of a driver space located at an upper portion of a laundry accommodation space and in which a driver for operating a hanger is located.

The present disclosure is not only to reciprocate hangers along a width direction of a cabinet, but also to place other drivers for moving the hangers in other directions at an upper portion of a laundry accommodation space so as to efficiently utilize a driving space.

The present disclosure is to independently or selectively arrange a plurality of hangers inside or outside an accommodation space as needed in order to maximally utilize the accommodation space where laundry is accommodated.

The present disclosure is to provide a structure in which a plurality of hangers are also movable in a height direction of a cabinet, a width direction of the cabinet, and a depth direction of the cabinet.

The present disclosure is to prevent interference with a plurality of hangers even when a laundry treating apparatus has a dividing wall capable of variably adjusting and dividing an accommodation space.

The present disclosure is to provide a clothes hanger that may be stably fixed while rotating a hook thereof so as to hang bulky clothes.

The present disclosure is to allow each of a plurality of hangers has a plurality of hooks, each of which is able to mount a clothes hanger thereon.

The present disclosure is to provide a shelf that may allow an accommodation space to be used by being divided in various ways.

Technical Solutions

For this purpose, the present disclosure is to provide a pop-up hanger (or a hanger arranging portion) that independently controls a plurality of hangers for hanging laundry in an accommodation space, which is a space that accommodates the laundry therein, such that the plurality of hangers are located inside or outside the accommodation space as needed.

In addition, the present disclosure is to provide a moving hanger (or a reciprocating portion) capable of reciprocating in a width direction of a cabinet in order to remove dust or fine dust from the laundry, and a welcome hanger (or a moving driver) that moves forward when a door is opened so as to make it easy for a user to hang the laundry.

In addition, a dividing wall that may vertically divide the accommodation space may be disposed, so that the pop-up hanger may be individually moved such that the hanger does not interfere when the dividing wall moves. That is, in order for the dividing wall (or a variable wall) to move, a plurality of hangers placed on a movement path must be hidden. As the variable wall moves, a hanger that needs to be hidden may be hidden above a top surface of a first chamber via pivoting after moving forward when the door is opened.

In one example, the present disclosure is to provide a shelf that maximizes space utilization by horizontally dividing the accommodation space.

In addition, the present disclosure is to provide a clothes hanger that allows bulky clothes to be easily accommodated via rotation and fixing of a clothes hanger hook.

In order to solve such problem, provided is a laundry treating apparatus including a cabinet with an inlet defined in one surface thereof, a top panel for forming a top surface of the cabinet, a laundry treating chamber positioned inside the cabinet so as to accommodate therein laundry through the inlet, a laundry treating chamber top surface for forming a top surface of the laundry treating chamber, a hanger assembly including a hanger for hanging the laundry thereon in the laundry treating chamber, and a reciprocating portion spaced apart from the hanger assembly in a width direction of the cabinet or a depth direction of the cabinet, wherein the reciprocating portion reciprocates the hanger assembly in the width direction of the cabinet.

The reciprocating portion may include a power motor assembly including a power motor rotation shaft assembly directed in parallel with the width direction, and rotating the power motor rotation shaft assembly using a rotating magnetic field, and a moving body coupled to the power motor rotation shaft assembly in a direction parallel to the width direction, wherein the moving body converts the rotational motion of the power motor into a reciprocating motion along the depth direction so as to reciprocate the hanger assembly coupled thereto in a direction parallel to the depth direction and the width direction.

The hanger assembly may further include a hanger support positioned outside the laundry treating chamber so as to support the hanger, the hanger support and the reciprocating portion may be located between the top panel and the laundry treating chamber top surface, and the reciprocating portion may reciprocate the hanger support in the width direction.

The hanger support may include a hanger support frame for pivotably supporting the hanger, a hanger supporting stage for guiding the hanger support frame and the hanger to reciprocate in the width direction and move in the depth direction, and a movement guide hole extending through the hanger supporting stage and extending along the depth direction.

The reciprocating portion may be connected to the hanger supporting stage, reciprocate the hanger supporting stage in the width direction, and be located farther away from the inlet than the hanger assembly along the depth direction.

The laundry treating apparatus may further include a transport driver for moving the hanger support frame in the depth direction along the movement guide hole, and the transport driver may be positioned on the hanger supporting stage and between the hanger support frame and at least one of both side surfaces of the cabinet.

The laundry treating apparatus may further include a dividing portion located inside the laundry treating chamber, and dividing the laundry treating chamber into one or more accommodation spaces, and a moving driver for moving the dividing portion along the width direction inside the laundry treating chamber.

The moving driver may be positioned between the hanger supporting stage and at least one of both side surfaces of the cabinet.

The laundry treating apparatus may further include a hanger arranging portion for moving the hanger into or to the outside of the laundry treating chamber, the hanger support frame may include a pivoting support frame located above the movement guide hole and pivotably supports the hanger, and the hanger arranging portion may be located on one side surface of the pivoting support frame.

In one example, the laundry treating apparatus may further include a cutout defined by extending through the laundry treating chamber top surface in a height direction of the cabinet, the hanger may include a plurality of hangers, and the laundry treating apparatus may include a hanger arranging portion for moving one or more of the plurality of hangers into or to the outside of the laundry treating chamber via the cutout.

The cutout may include a plurality of cutout holes respectively corresponding to the plurality of hangers, and the hanger arranging portion may pivot and move the one or more of the plurality of hangers into or to the outside of the laundry treating chamber via one or more cut holes where the one or more hangers are respectively inserted.

The hanger assembly may include a hanger supporting stage located between the laundry treating chamber top surface and the top panel so as to support the plurality of hangers, a plurality of movement guide holes extending through the hanger supporting stage along the width direction and defined along the depth direction, wherein the plurality of movement guide holes correspond to the plurality of cutout holes, respectively, and a hanger support frame coupled to the hanger supporting stage, and coupled to the plurality of hangers respectively inserted into the plurality of movement guide holes and the plurality of cutout holes respectively facing the plurality of movement guide holes, and the hanger arranging portion may be coupled to the hanger support frame so as to pivot one of the plurality of hangers into or to the outside of the laundry treating chamber.

The hanger support frame may include a plurality of pivoting support frames respectively positioned above the plurality of movement guide holes so as to support pivoting of the plurality of hangers, respectively, and each hanger arranging portion may be located between adjacent two of the plurality of pivoting support frames.

The hanger arranging portion may include an arranging motor assembly including one or more arranging motors for rotating corresponding the one or more of the plurality of hangers, and an arranging motor rotation shaft assembly including an arranging motor rotation shaft disposed in each of the one or more arranging motors to rotate, and each arranging motor rotation shaft may be connected to each of the one or more hangers by being inserted into and extending through one surface or both surfaces of one or more pivoting support frames where the one or more hangers are respectively inserted.

In one example, the hanger may include a plurality of hangers.

The laundry treating apparatus may further include a plurality of cutout holes extending through the laundry treating chamber top surface in a height direction of the cabinet, the hanger assembly may include a hanger supporting stage located between the laundry treating chamber top surface and the top panel so as to support the plurality of hangers, a plurality of movement guide holes extending through the hanger supporting stage along the width direction and defined along the depth direction, wherein the plurality of movement guide holes face the plurality of cutout holes, respectively, and a hanger support frame coupled to the hanger supporting stage, wherein the plurality of hangers are movably coupled to the hanger support frame, and the reciprocating portion may include a power motor assembly for generating a rotational force, a power motor rotation shaft assembly disposed inside the power motor assembly to rotate, a power motor support positioned between the laundry treating chamber top surface and the top panel so as to support the power motor assembly, and a moving body for converting a rotational motion of the power motor assembly into a reciprocating motion along the width direction and transferring the reciprocating motion to the hanger assembly.

The power motor rotation shaft assembly may include a disk-shaped eccentric body coupled to the power motor rotation shaft assembly, and an eccentric protrusion located radially spaced apart from a center of the power motor rotation shaft assembly, and protruding from the eccentric body in a direction away from the rotation shaft assembly, and the moving body may be connected to the eccentric protrusion so as to convert the rotational motion into the reciprocating motion and transfer the reciprocating motion to the hanger assembly.

The moving body may include motion conversion means for converting a rotational motion of the eccentric protrusion into the reciprocating motion of the moving body, and the motion conversion means may be defined in a form of a slot extending in the depth direction through the moving body along the width direction.

The moving body may further include a motion guide hole extending through the moving body along the width direction and extending in the width direction, and a motion guide positioned inside the motion guide hole so as to support the motion guide hole and guide the reciprocating motion of the moving body in the width direction.

The moving body may further include a hanger supporting stage connecting portion directed in a direction parallel to the hanger supporting stage so as to connect the moving body to the hanger supporting stage, and the hanger supporting stage may further include a motion body connecting portion disposed to correspond to the hanger supporting stage connecting portion, and connected to the hanger supporting stage connecting portion so as to transfer the reciprocating motion of the moving body to the hanger supporting stage.

The power motor may be located further from the inlet than the hanger supporting stage.

The moving body and the hanger supporting stage may be located at the same vertical level with respect to the laundry treating chamber top surface.

In one example, the laundry treating apparatus may further include a cutout defined by extending through the laundry treating chamber top surface in a height direction of the cabinet, the hanger may include a plurality of hangers, the cutout may include a plurality of cutout holes respectively corresponding to positions of the plurality of hangers, and each of the plurality of cutout holes may include a hanger hole portion defined through each cutout hole along the width direction, and a linear hole portion extending vertically from the hanger hole portion in a direction toward the inlet and connected to the hanger hole portion.

The linear hole portion may further include a hanger gasket for covering the linear hole portion, and the hanger gasket may be cut along the depth direction at a center of the linear hole portion.

The laundry treating apparatus may further include a transport driver for moving the hanger assembly along the linear hole portion.

The laundry treating apparatus may further include a main door pivotably disposed on the cabinet so as to open and close the inlet, and the transport driver may move the hanger assembly along the linear hole portion such that the hanger assembly becomes closer to the inlet when the main door is opened.

The laundry treating apparatus may further include a hanger arranging portion for pivoting and moving one or more of the plurality of hangers into or to the outside of the laundry treating chamber through one or more cutout holes where the one or more hangers are respectively inserted, and, after the transport driver moves the hanger assembly along the linear hole portion, the hanger arranging portion may pivot and move the one or more of the plurality of hangers into or to the outside of the laundry treating chamber.

The transport driver may move the hanger assembly along the linear hole portion such that the hanger assembly is located in the hanger hole portion when the main door is closed.

The hanger assembly may include a hanger supporting stage located between the laundry treating chamber top surface and the top panel so as to support the plurality of hangers, a plurality of movement guide holes extending through the hanger supporting stage along the width direction and defined along the depth direction, wherein the plurality of movement guide holes are defined to correspond to the plurality of cutout holes, respectively, and a hanger support frame coupled to the hanger supporting stage, wherein the plurality of hangers are movably coupled to the hanger support frame, and the transport driver may move the hanger support frame along the depth direction through the plurality of movement guide holes and the plurality of cutout holes.

The hanger support frame may include a hanger rack disposed at at least one of both sides of the hanger support frame, the transport driver may include a transport motor for generating a rotational force to move the hanger support frame, a transport motor rotation shaft disposed inside the transport motor so as to rotate, and a transport gear connected to the transport motor rotation shaft and coupled to the hanger rack to move the hanger rack, and the hanger support frame may be moved along the depth direction by the hanger rack when the transport gear rotates.

The hanger support frame may further include movement support frames for connecting a plurality of pivoting support frames to each other, and movably coupling the plurality of pivoting support frames to the hanger supporting stage, and the hanger supporting stage may further include a hanger guide rail disposed between adjacent two of the movement guide holes so as to guide the hanger support frame to move along the depth direction.

The laundry treating apparatus may further include a reciprocating portion for reciprocating the plurality of hangers along the width direction, and the reciprocating portion may reciprocate when the plurality of hangers are positioned above the hanger hole portions respectively corresponding to the plurality of hangers or the laundry treating chamber.

In one example, the laundry treating apparatus may further include a cutout defined by extending through the laundry treating chamber top surface in a height direction of the cabinet, the hanger may include a plurality of hangers, the cutout may include a plurality of cutout holes respectively corresponding to the plurality of hangers, and each of the plurality of hangers may include a hanger support body having one end inserted into one of the plurality of cutout holes and positioned between the top panel and the laundry treating chamber top surface, and the other end positioned inside the laundry treating chamber, and hanger hooks positioned close to the other end of the hanger support body and disposed on both side surfaces of the hanger support body so as to mount clothes hangers thereon.

The hanger hooks may include a first hanger hook body and a second hanger hook body coupled to both of the side surfaces of the hanger support body, each of the first hanger hook body and the second hanger hook body may include a connecting hanger body coupled to the hanger support body, a fixed hanger body disposed to face the connecting hanger body, and a bent hanger body disposed to connect the fixed hanger body and the connecting hanger body to each other such that each hanger hook body is open toward the laundry treating chamber top surface.

In the hanger hook, a length along the width direction of the connecting hanger body may be greater than a length along the width direction of the fixed hanger body.

At least a portion of a surface of the connecting hanger body located on an opposite side of a surface of the connecting hanger coupled to the hanger support body may be inclined downwards toward the bent hanger body.

The hanger hook may further include a clothes hanger check sensor capable of identifying that the clothes hanger is mounted.

In one example, the laundry treating apparatus may further include a plurality of shelf fixing clips disposed on one of inner surfaces of the laundry treating chamber, and one or more mountable shelves fixed to the plurality of shelf fixing clips so as to support an object-to-be-dried.

Each of the one or more mountable shelves may include a plurality of support bars arranged at a preset spacing, and a first coupling bar and a second coupling bar vertically coupled to the plurality of support bars so as to be closer to one end than to the other end of each of the plurality of support bars, and the first coupling bar may be coupled closer to the one end of each of the plurality of support bars than the second coupling bar.

Each of the plurality of shelf fixing clips may include a clip body for forming an outer appearance of the shelf fixing clip, a clip through-hole defined by extending through the clip body in a direction parallel to the laundry treating chamber top surface, a clip opening defined as a portion of a surface facing the treating chamber top surface among outer surfaces of the clip body is opened, and connected to the clip through-hole, and a center dividing portion protruding from an inner circumferential surface of the clip through-hole and extending inwardly of the inner circumferential surface of the clip through-hole, and the center dividing portion may divide the inner circumferential surface of the clip through-hole into a first installation portion and a second installation portion where the one or more mountable shelves are installed, respectively.

When one of the one or more mountable shelves is installed in a direction parallel to the laundry treating chamber top surface so as to support the object-to-be-dried, the one end of each of the first coupling bar and the second coupling bar may be mounted on one of the plurality of shelf fixing clips and the other end thereof may be mounted on another shelf fixing clip located at the same vertical level as the one shelf fixing clip along the width direction.

When the one or more mountable shelves are mounted on the plurality of shelf fixing clips parallel to the width direction, the first coupling bar may be located inside one shelf fixing clip and another shelf fixing clip of the plurality of shelf fixing clips, and the second coupling bar may be located outside of said one shelf fixing clip and said another one shelf fixing clip of the plurality of shelf fixing clips.

In one example, the laundry treating apparatus may further include a clothes hanger unit detachable from the hanger, the clothes hanger unit may include a clothes hanger hook of a hook shape with a portion thereof opened so as to be mounted on the hanger, and a clothes hanger body coupled to one end of the clothes hanger hook so as to mount the laundry thereon, and the clothes hanger body may include a hook rotation guide coupled to the clothes hanger hook so as to move the clothes hanger hook, and a guide connecting portion for accommodating the hook rotation guide therein, and connecting the clothes hanger hook and the clothes hanger body to each other.

The hook rotation guide may include a guide protrusion formed to protrude from an outer circumferential surface of the hook rotation guide in a radial direction of the hook rotation guide, the guide connecting portion may further include a guide accommodating opening defined as a portion of a surface of the guide connecting portion coupled to the clothes hanger body is opened, and a guide accommodating portion for accommodating the hook rotation guide inside the guide connecting portion through the guide accommodating opening, and an inner surface of the guide accommodating portion may include a first guide groove and a second guide groove defined therein for guiding a movement of the guide protrusion.

The guide connecting portion may include a first inner surface located close to the guide accommodating opening of inner surfaces of the guide accommodating portion, a second inner surface formed with a smaller diameter than the first inner surface of the inner surfaces of the guide accommodating portion, and a stepped surface for connecting the first inner surface and the second inner surface to each other, the second inner surface may include the first guide groove and the second guide groove defined in a groove shape along the width direction such that the guide protrusion is inserted thereinto, and when the hook rotation guide moves along the stepped surface positioned between the first guide groove and the second guide groove, the clothes hanger hook may rotate relative to the clothes hanger body.

The clothes hanger unit may further include a hook elastic member positioned between the hook rotation guide and the clothes hanger body and elastically supporting the hook rotation guide.

When the hook rotation guide is located in the first guide groove or the second guide groove, the clothes hanger hook may be prevented from rotating relative to the clothes hanger body.

The laundry treating apparatus may further include a main door pivotably disposed on the cabinet so as to open and close the inlet, and the hanger arranging portion may pivot and move the hanger into or to the outside of the laundry treating chamber when the main door is opened.

In one example, a laundry treating apparatus includes a cabinet with an inlet defined in a front surface thereof, a top panel for forming a top surface of the cabinet, a laundry treating chamber positioned inside the cabinet so as to accommodate therein laundry through the inlet, a machine room positioned inside the cabinet and at a lower portion of the cabinet so as to define a space separated from the laundry treating chamber, a laundry treating chamber top surface for forming a top surface of the laundry treating chamber, a cutout defined by extending through the laundry treating chamber top surface in a first direction that is a height direction of the cabinet, a hanger assembly including a hanger inserted into the laundry treating chamber through the cutout so as to hang the laundry thereon, a reciprocating portion positioned on a side farther from the inlet than the hanger assembly along a second direction that is a depth direction of the cabinet so as to reciprocate the hanger assembly in a third direction that is a width direction of the cabinet, and a first surface and a second surface for forming a laundry treating chamber bottom surface, and a vertical level of the first surface is higher than a vertical level of the second surface.

In addition, the machine room may be located below the first surface.

The hanger may include a plurality of hangers, the cutout may include a plurality of cutout holes respectively corresponding to the plurality of hangers, and the hanger arranging portion may selectively pivot and move some hangers respectively located in some of the plurality of cutout holes included or spanning in a portion of the laundry treating chamber top surface facing the first surface into or to the outside of the laundry treating chamber based on a movement of a dividing portion.

In one example, a laundry treating apparatus includes a cabinet with an inlet defined in one surface thereof, a top panel for forming a top surface of the cabinet, a laundry treating chamber positioned inside the cabinet so as to accommodate therein laundry through the inlet, a laundry treating chamber top surface for forming a top surface of the laundry treating chamber, a cutout defined by extending through the laundry treating chamber top surface in a first direction that is a height direction of the cabinet, a hanger assembly including a hanger inserted into the laundry treating chamber through the cutout so as to hang the laundry thereon, and a reciprocating portion positioned on a side farther from the inlet than the hanger assembly along a second direction that is a depth direction of the cabinet so as to reciprocate the hanger assembly in a third direction that is a width direction of the cabinet.

In one example, a laundry treating apparatus includes a cabinet with an inlet defined in one surface thereof, a laundry treating chamber positioned inside the cabinet so as to accommodate therein laundry through the inlet, a laundry treating chamber top surface for forming a top surface of the laundry treating chamber, a hanger assembly including a hanger for hanging the laundry thereon in the laundry treating chamber, and a reciprocating portion for reciprocating the hanger assembly in a width direction of the cabinet, and when the hanger assembly and the reciprocating portion are orthogonally projected to the laundry treating chamber top surface along a height direction of the cabinet, the hanger assembly is located at a first position on the laundry treating chamber top surface, and the reciprocating portion is located at a second position different from the first position on the laundry treating chamber top surface.

In one example, a laundry treating apparatus includes a cabinet with an inlet defined in one surface thereof, a laundry treating chamber positioned inside the cabinet so as to accommodate therein laundry through the inlet, a laundry treating chamber top surface for forming a top surface of the laundry treating chamber, a hanger assembly including a hanger disposed in parallel with a height direction of the cabinet and mounting the laundry thereon in the laundry treating chamber, and a reciprocating portion including a power motor assembly for generating a rotational force and a power motor rotation shaft assembly directed in a direction parallel to the hanger so as to rotate at a center of the power motor assembly, wherein the reciprocating portion is spaced apart from the hanger assembly in a depth direction of the cabinet or a width direction of the cabinet and reciprocates the hanger assembly in the width direction of the cabinet.

In addition, the reciprocating portion may be located on a side farther away from the inlet than the hanger assembly.

That is, the second position may be located at the rear of the first position.

Advantageous Effects

According to the present disclosure, not only the plurality of hangers reciprocate along the width direction of the cabinet at the same time, but also the motion conversion means of the reciprocating portion and the hanger assembly are coupled to each other horizontally, thereby reducing the size of the space between the top surface of the accommodation space and the top panel of the cabinet.

According to the present disclosure, the plurality of hangers may be independently or selectively arranged inside or outside the accommodation space as needed in order to maximally utilize the accommodation space where the laundry is accommodated.

According to the present disclosure, the plurality of hangers may be also movable in the height direction of the cabinet, the width direction of the cabinet, and the depth direction of the cabinet.

According to the present disclosure, not only the plurality of hangers reciprocate along the width direction of the cabinet at the same time, but also the motion conversion means of the reciprocating portion and the hanger assembly are coupled to each other horizontally, thereby reducing the space between the top surface of the accommodation space and the top panel of the cabinet.

According to the present disclosure, the interference with the plurality of hangers may be prevented even when the laundry treating apparatus has the dividing wall capable of variably adjusting and dividing the accommodation space.

According to the present disclosure, the clothes hanger that may be stably fixed while rotating the hook thereof may be provided so as to hang the bulky clothes.

According to the present disclosure, the plurality of hooks, each of which is able to mount the clothes hanger thereon, may be provided on each of the plurality of hangers.

According to the present disclosure, the shelf that may allow the accommodation space to be used by being divided in the various ways may be provided.

Figure 2:
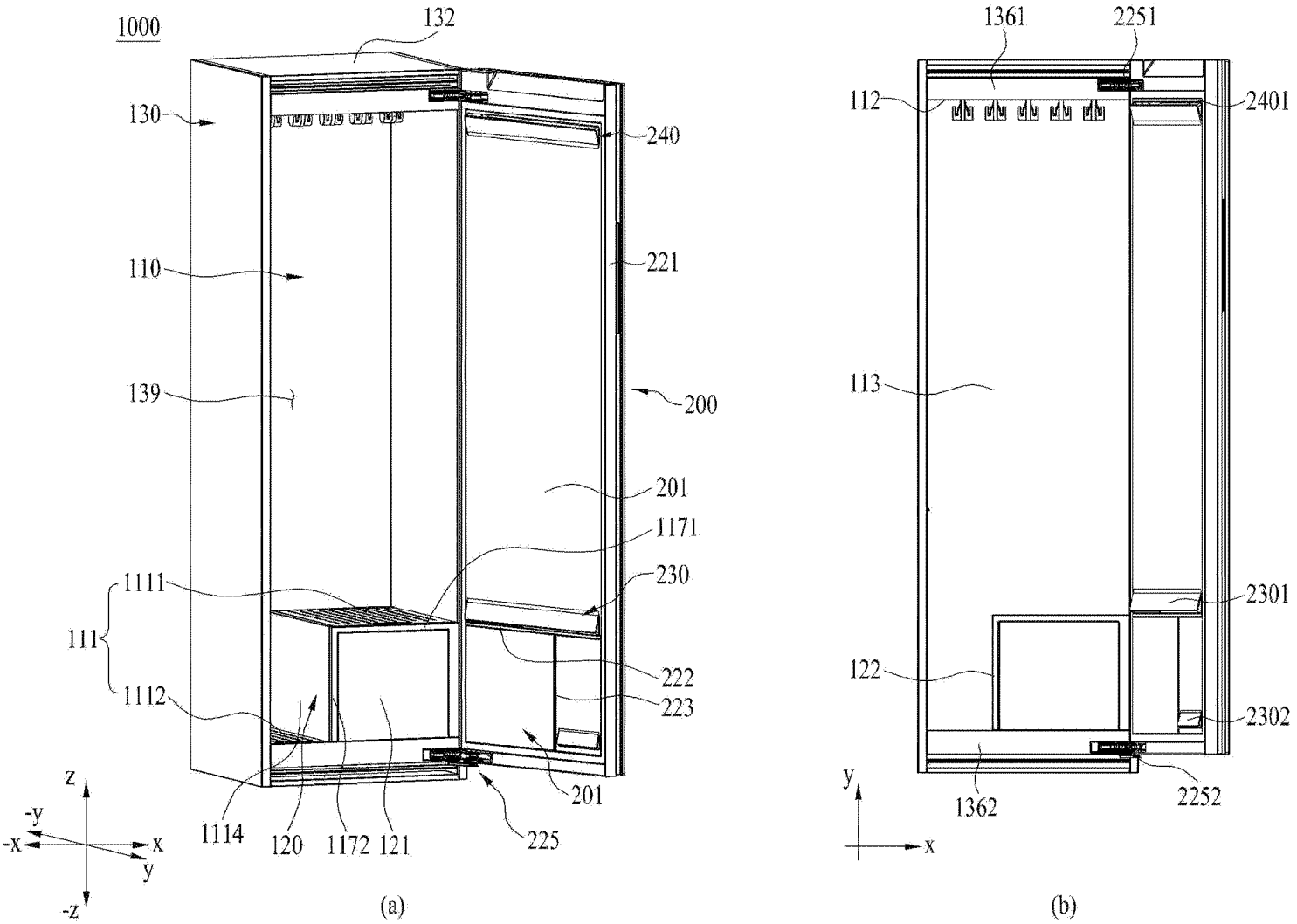

(a) and (b) in FIG. 2 show an example of a laundry treating apparatus that is the present disclosure.

Figure 3:
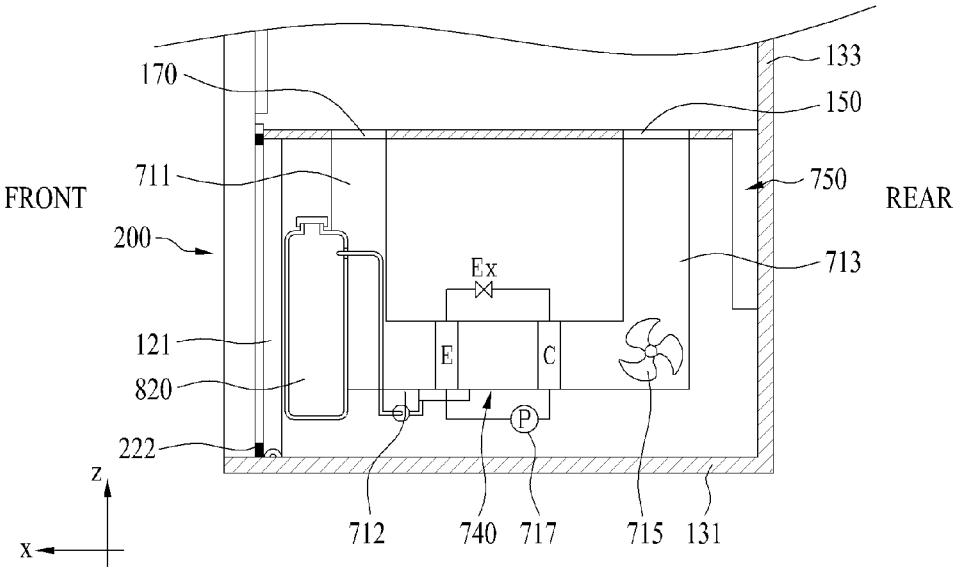

FIG. 3 shows a blower unit and heat exchange means located inside a second chamber.

Figure 4:
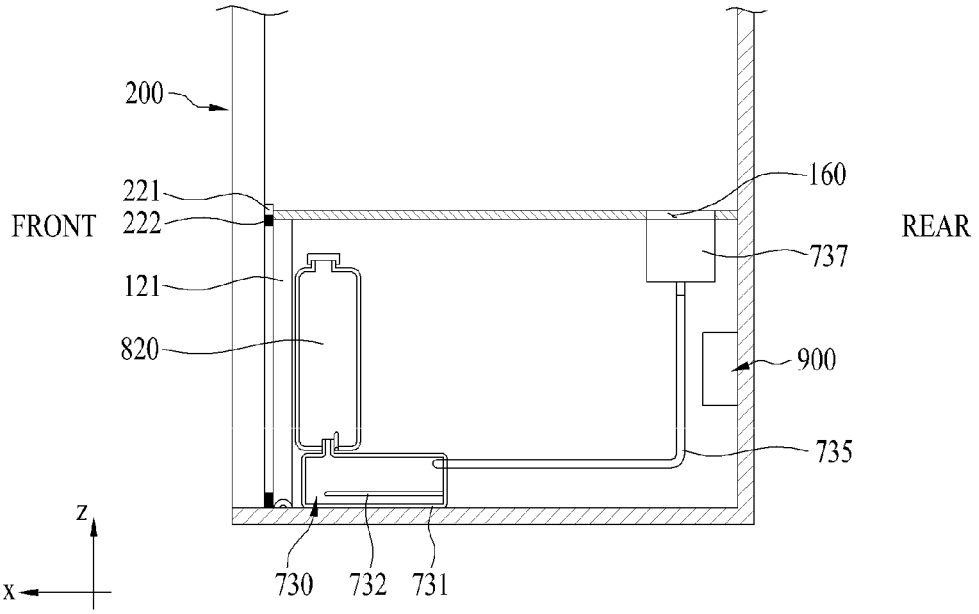

FIG. 4 shows a steam unit located inside a second chamber.

Figure 5:
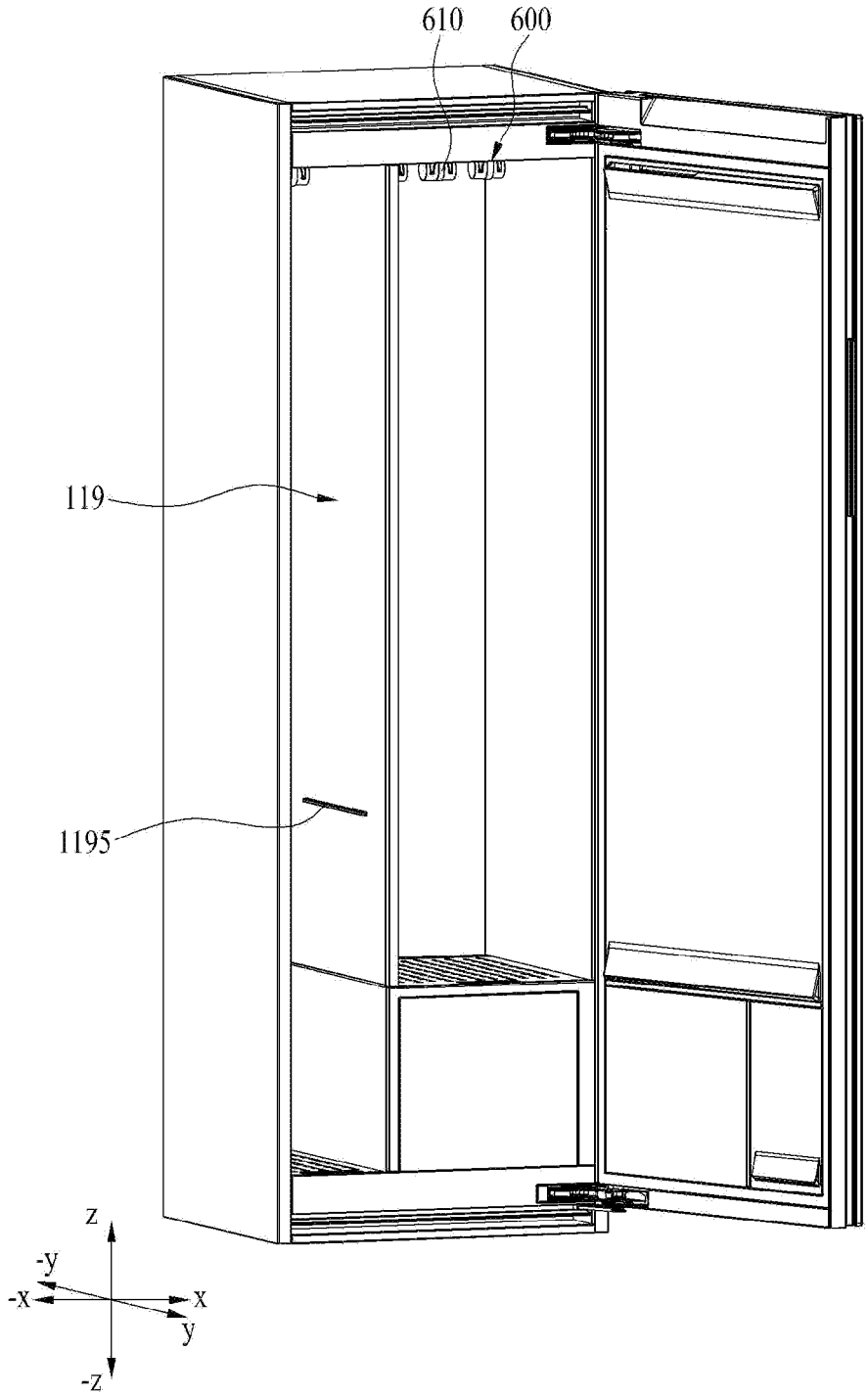

FIG. 5 shows a dividing portion for dividing an accommodation space inside a first chamber.

Figure 6:
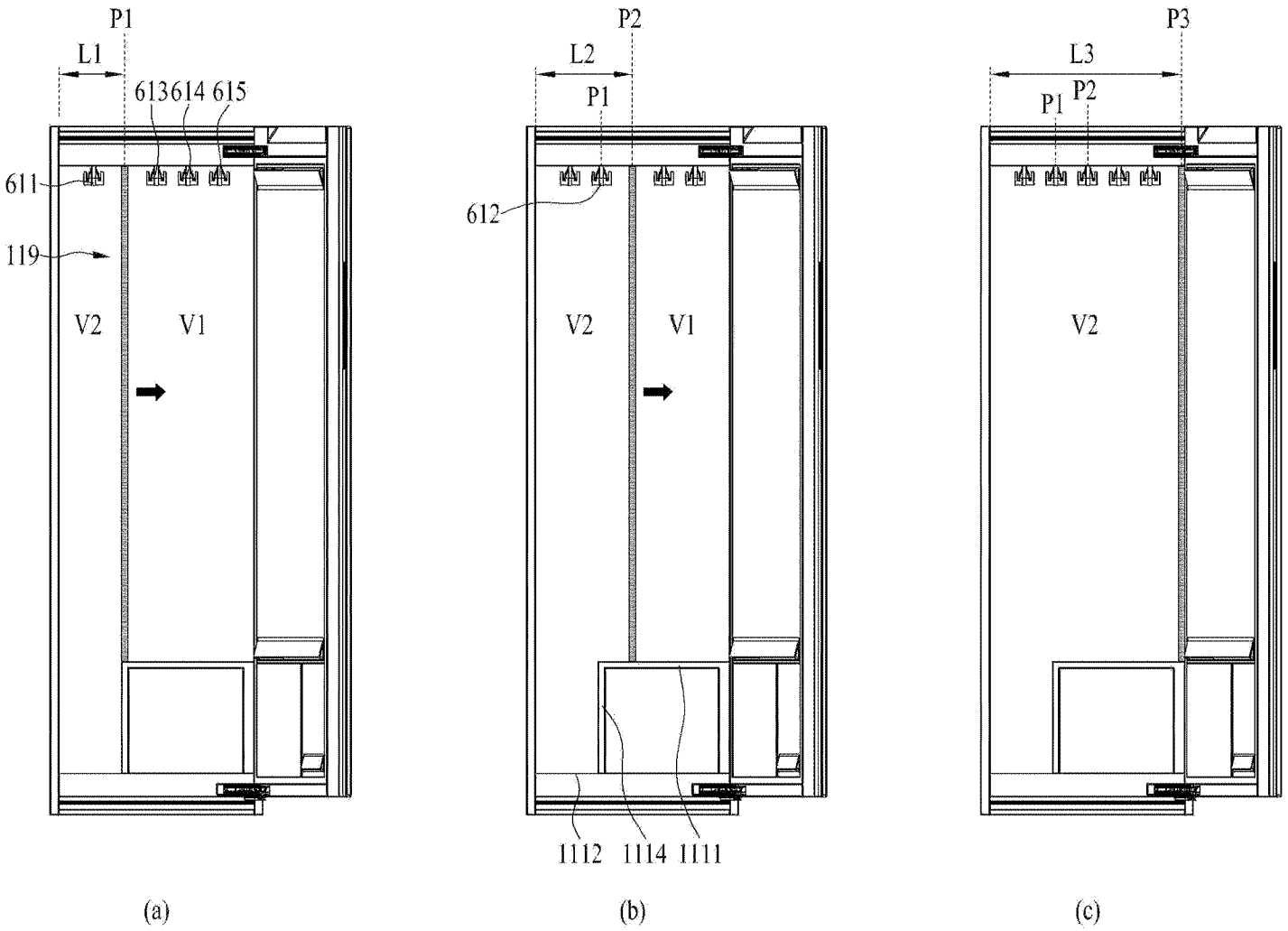

(a) to (c) in FIG. 6 show an example in which a dividing portion moves inside an accommodation space.

Figure 7:
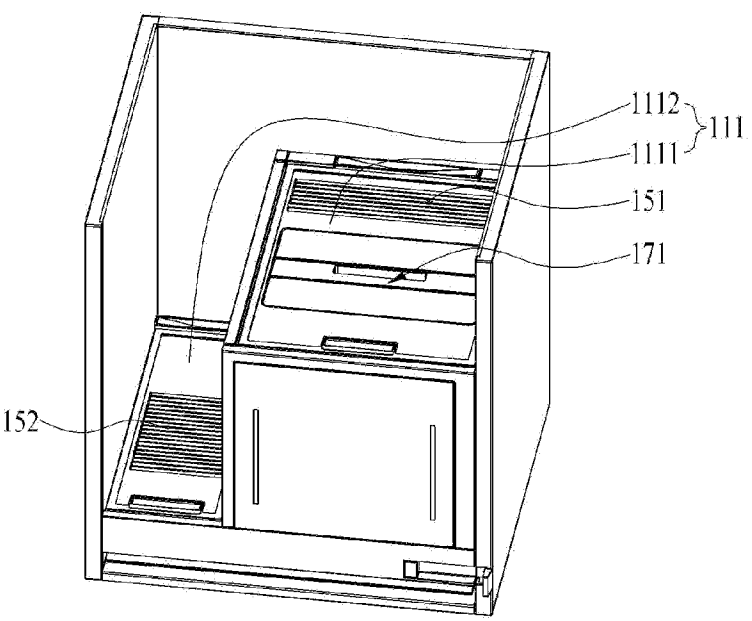
Figure 7:
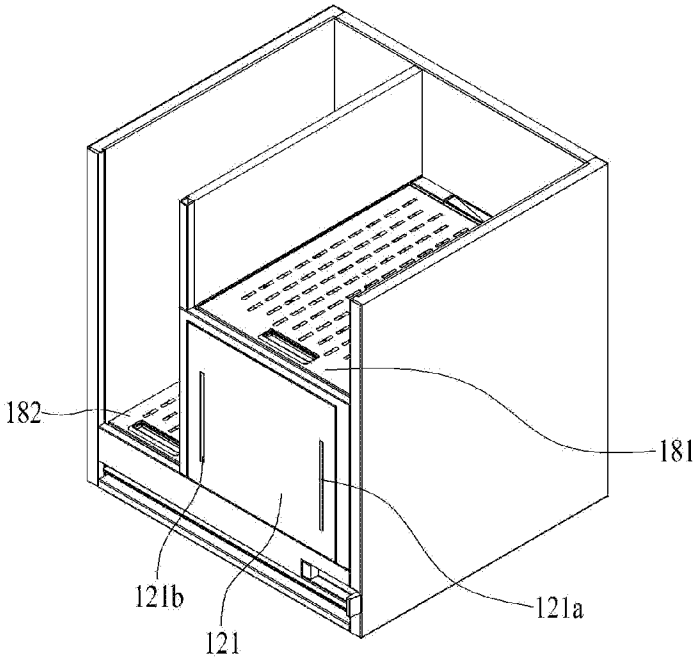

(a) and (b) in FIG. 7 show cases in which a bottom cover assembly exists on a first chamber bottom surface and is removed from the first chamber bottom surface, respectively.

Figure 8:
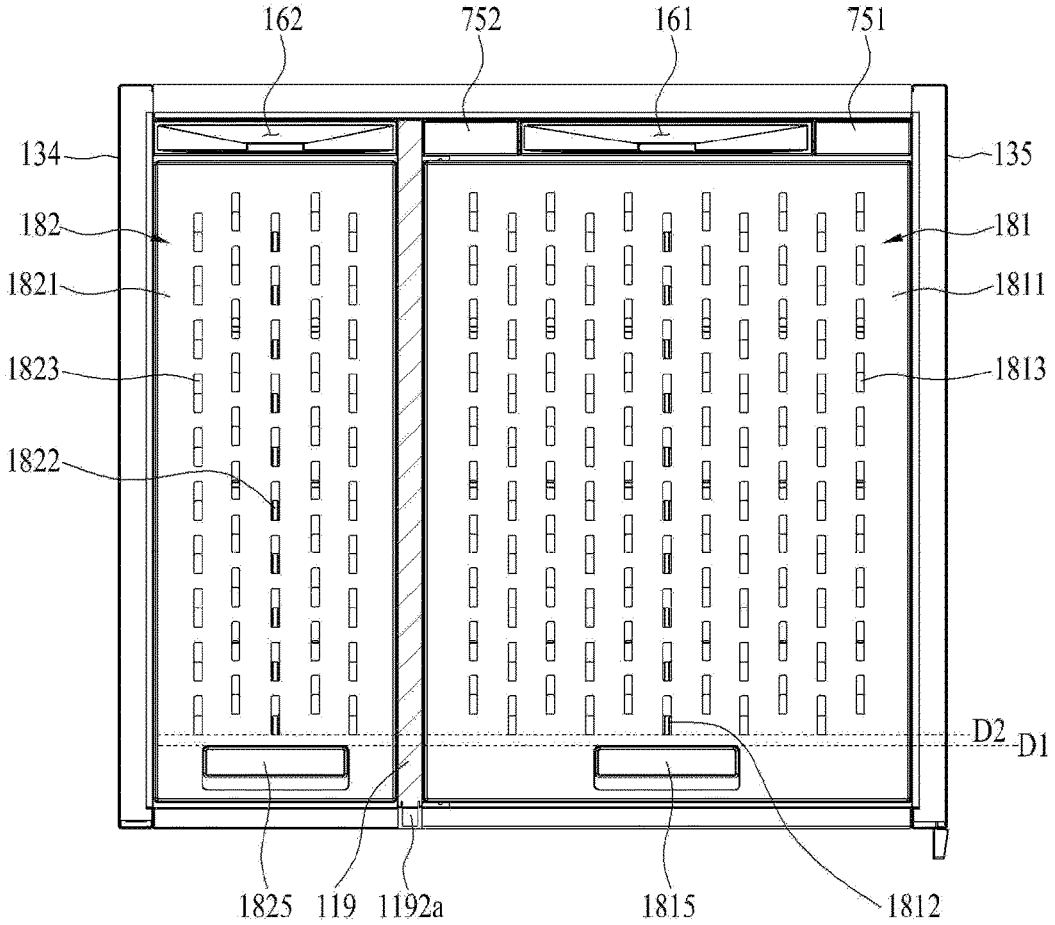

FIG. 8 is a top view of a first chamber bottom surface.

Figure 9:
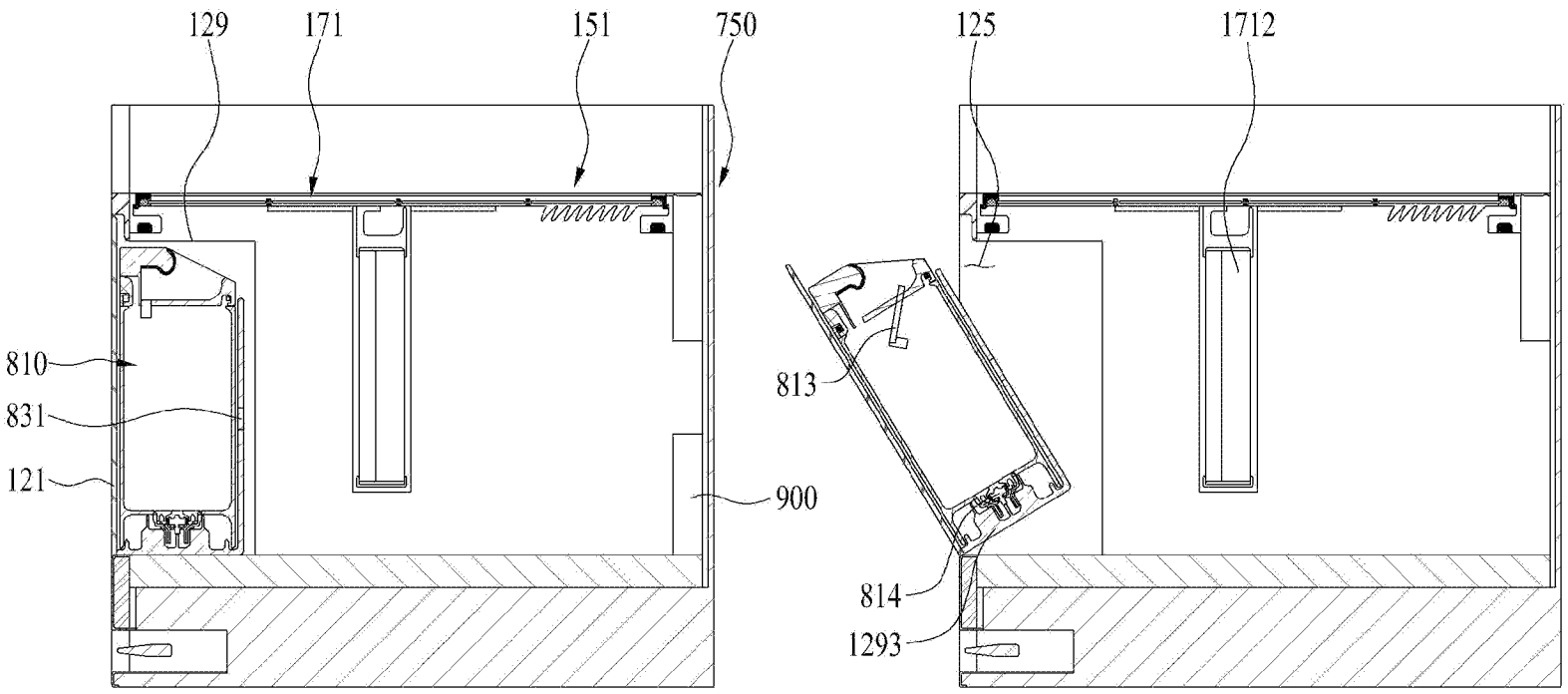

(a) and (b) in FIG. 9 show cases in which a water supply tank is mounted in a tank module frame and is removed from the tank module frame, respectively.

Figure 10:
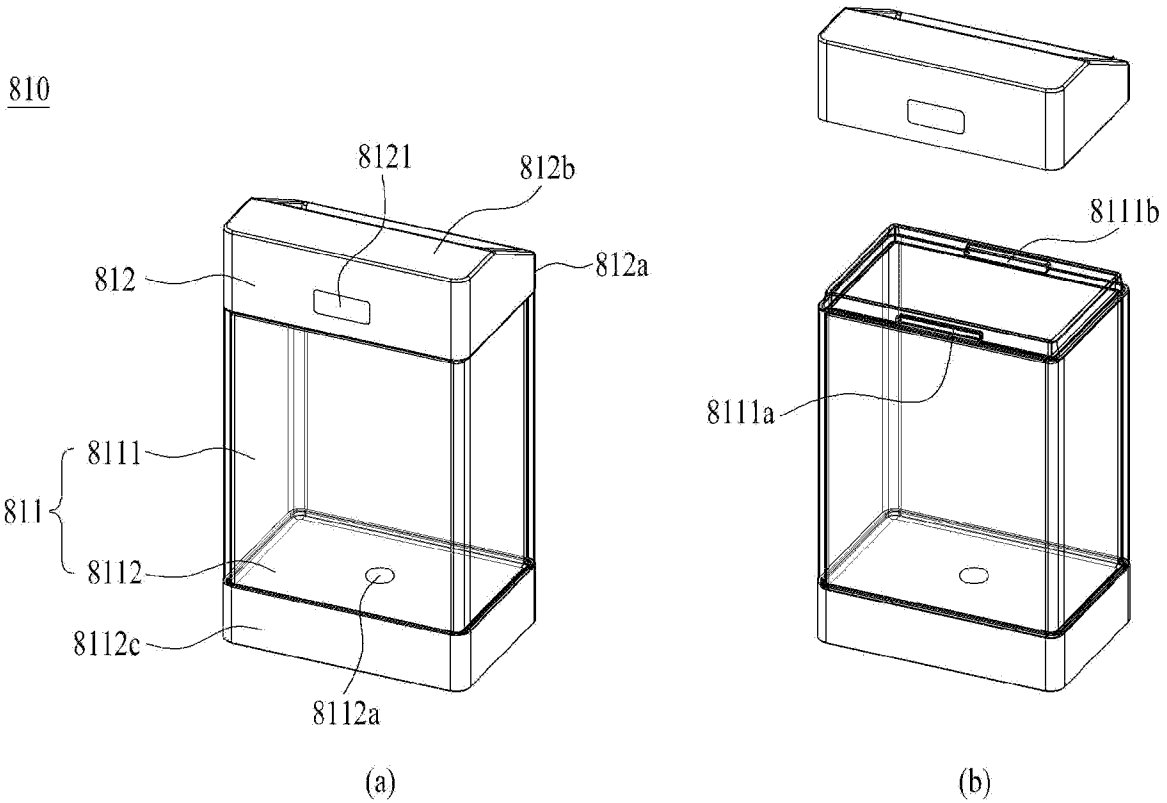

(a) and (b) in FIG. 10 show states in which a water supply tank body and a water supply tank lid are coupled to each other and are separated from each other, respectively.

Figure 11:
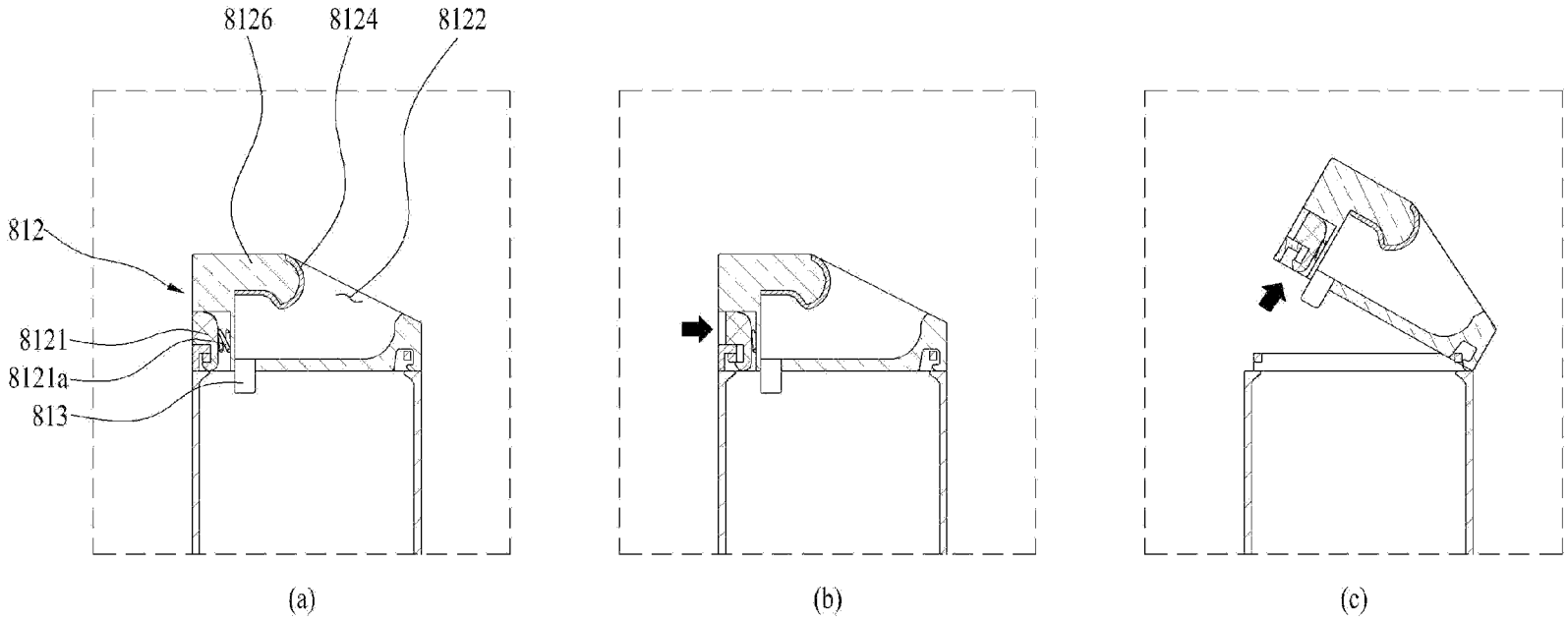

(a) to (c) in FIG. 11 show separation of a water supply tank lid in stages.

Figure 12:
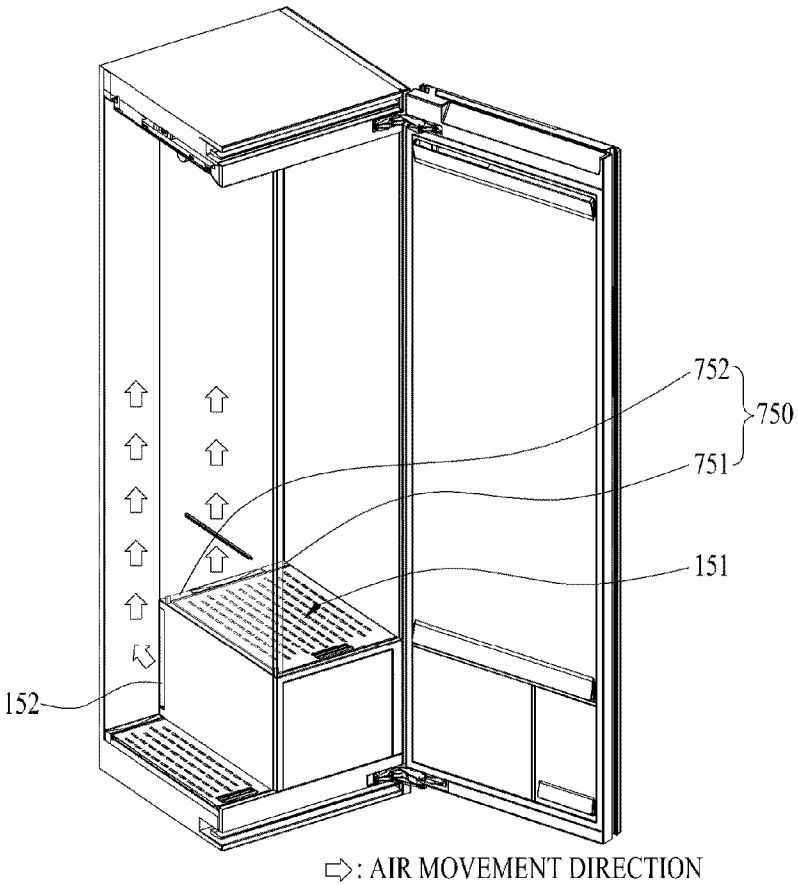
Figure 12:
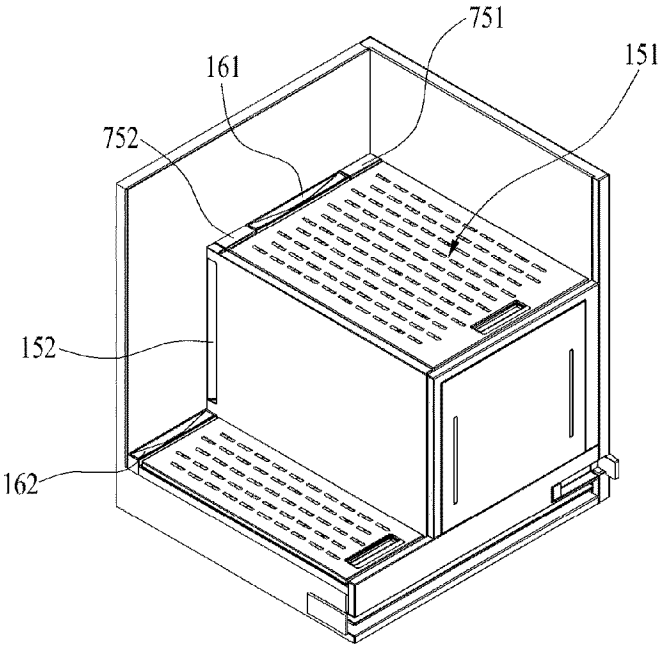

(a) and (b) in FIG. 12 show a position of aromatizing means and a flow direction of aromatized air, respectively.

Figure 13:
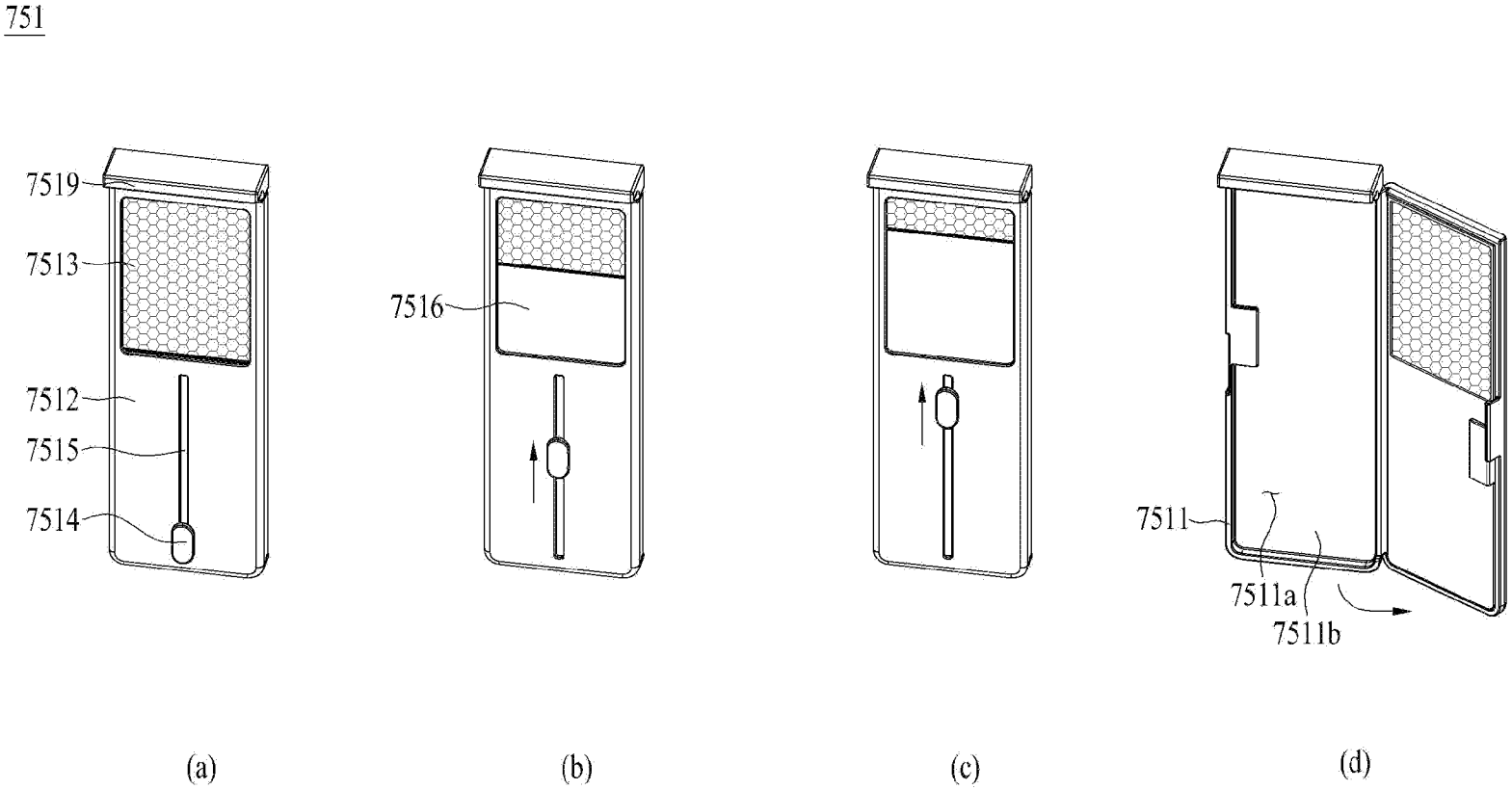

(a) and (d) in FIG. 13 show an example of a first aromatizing kit or a second aromatizing kit.

Figure 14:
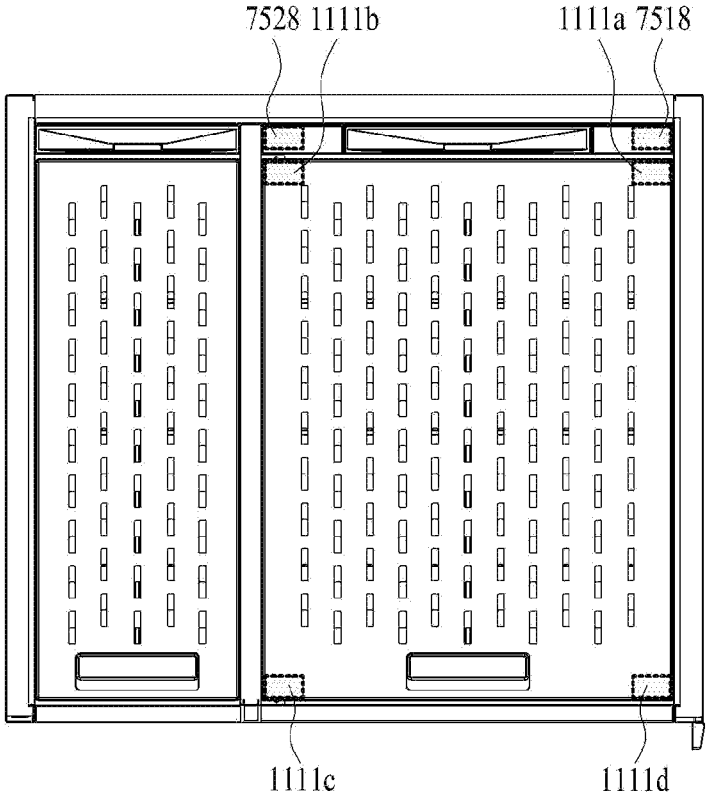

FIG. 14 shows an example of installed locations of a bottom sensor and an aromatizing kit installation sensor to determine normal installation of a bottom cover assembly and aromatizing means.

Figure 15:
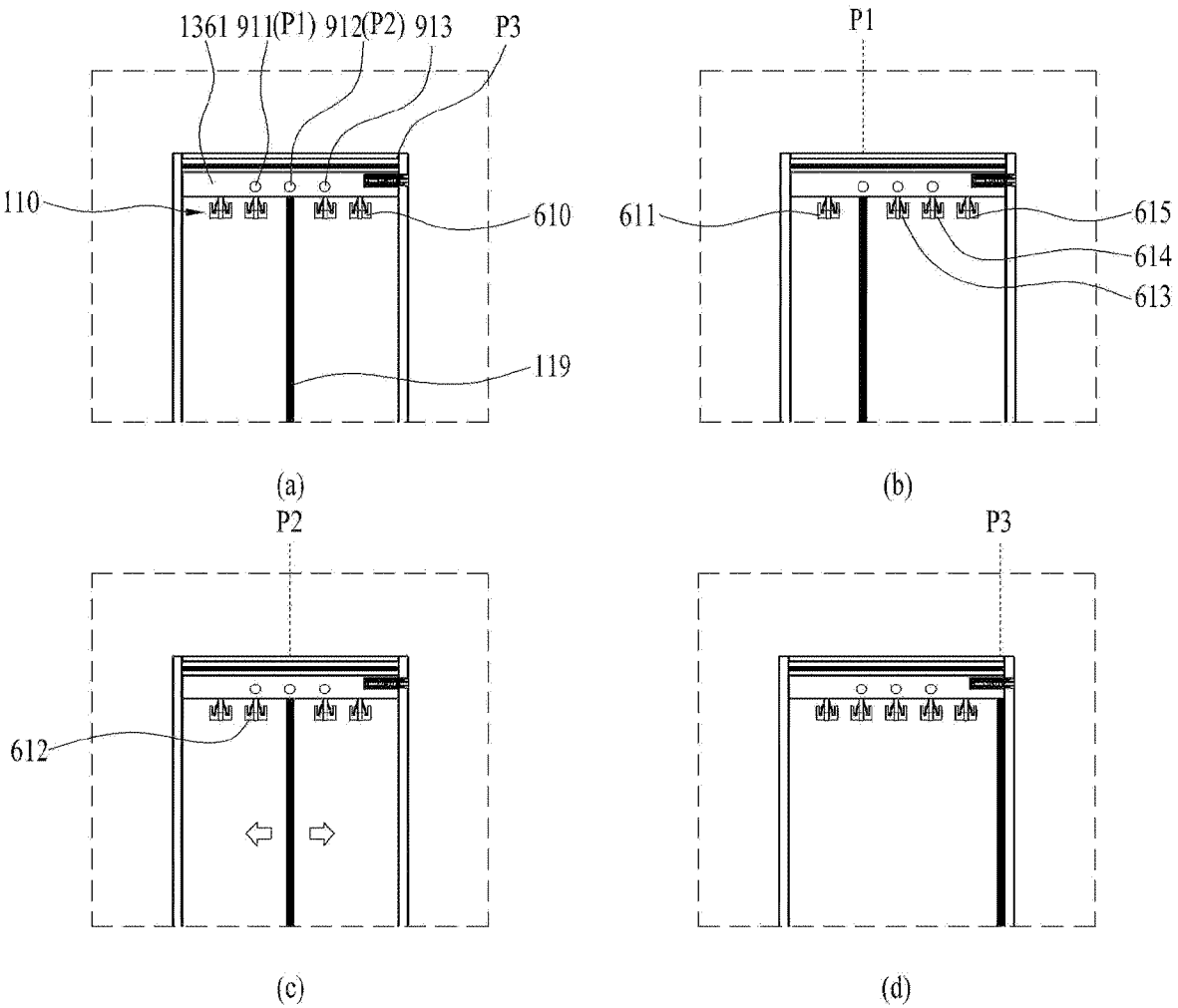

(a) and (d) in FIG. 15 show an example of a hanger assembly whose location changes by a hanger arranging portion as a dividing portion moves in a laundry treating apparatus in which the dividing portion is installed.

Figure 16:
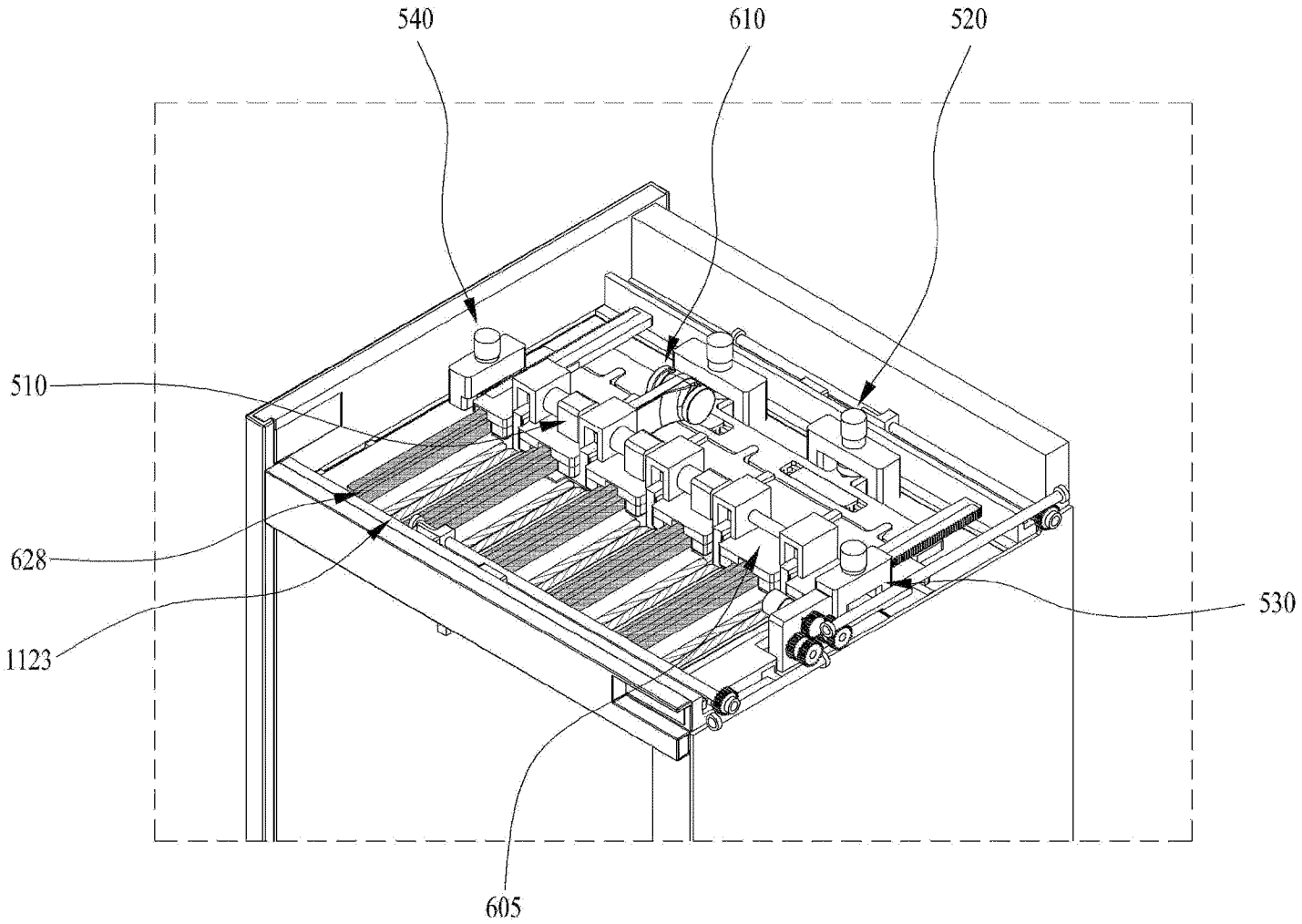

FIG. 16 shows an example of a hanger assembly and a driver.

Figure 17:
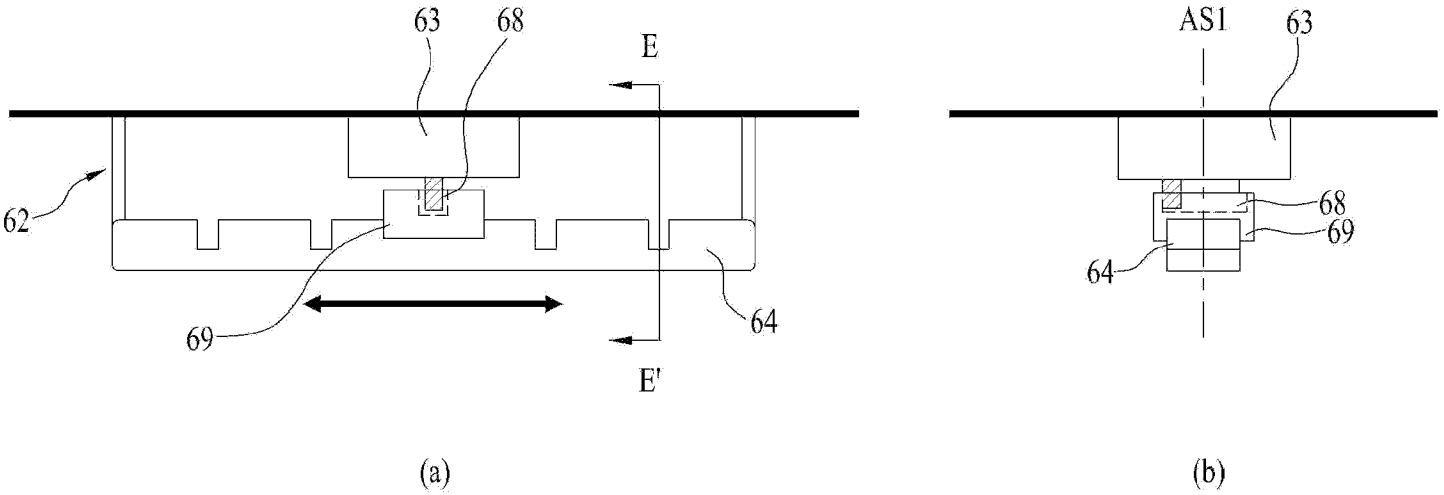

(a) and (b) in FIG. 17 show an example of a hanger assembly and a driver of a conventional laundry treating apparatus.

Figure 18:
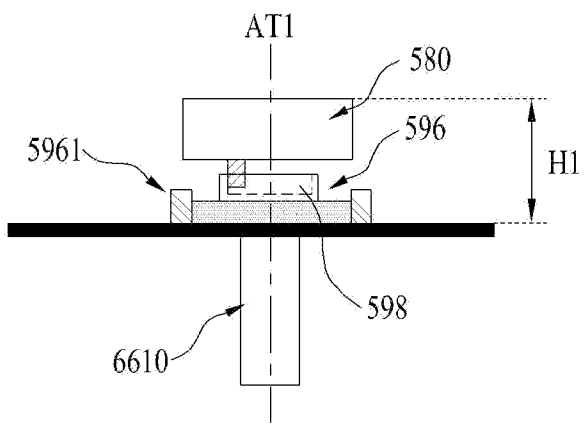
Figure 18:
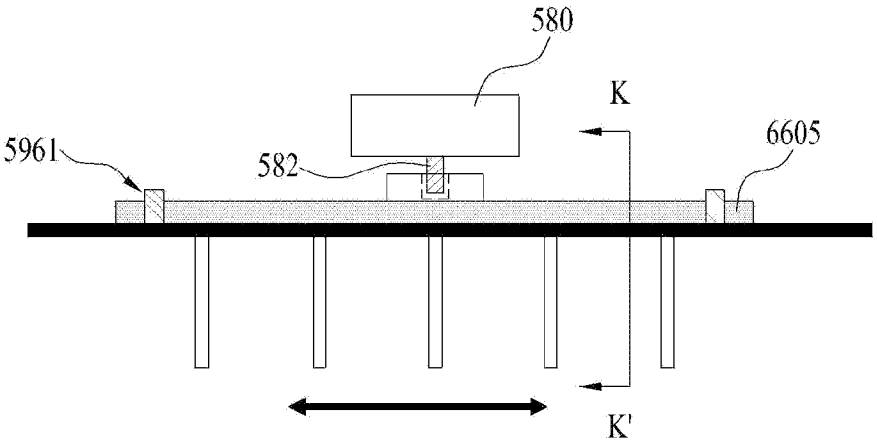

(a) and (b) in FIG. 18 schematically show another example of a hanger assembly and a driver of a laundry treating apparatus described in the present disclosure.

Figure 19:
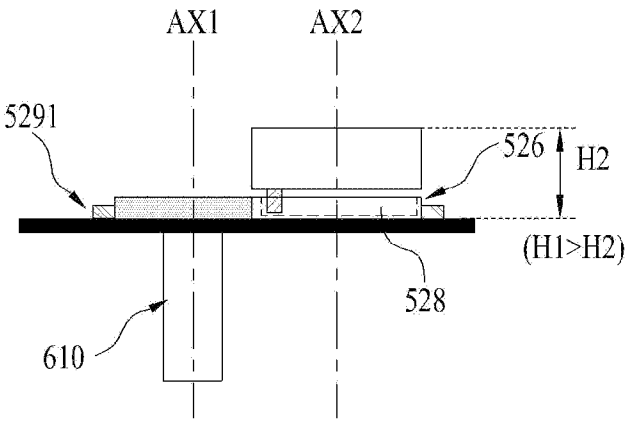
Figure 19:
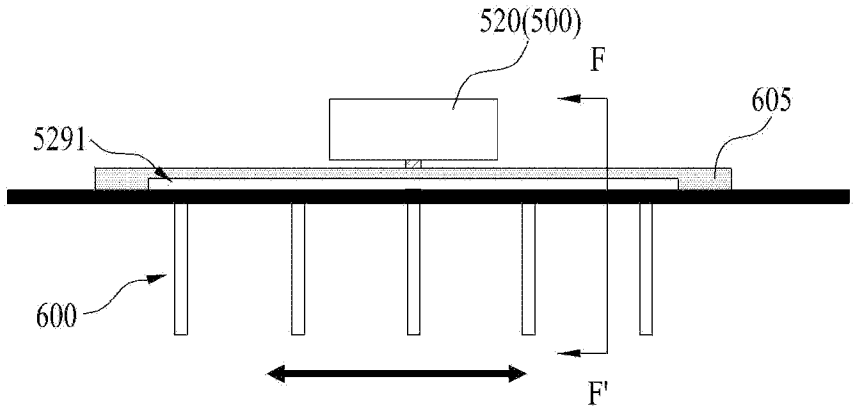

(a) and (b) in FIG. 19 schematically show another example of a hanger assembly and a driver of a laundry treating apparatus described in the present disclosure.

Figure 20:
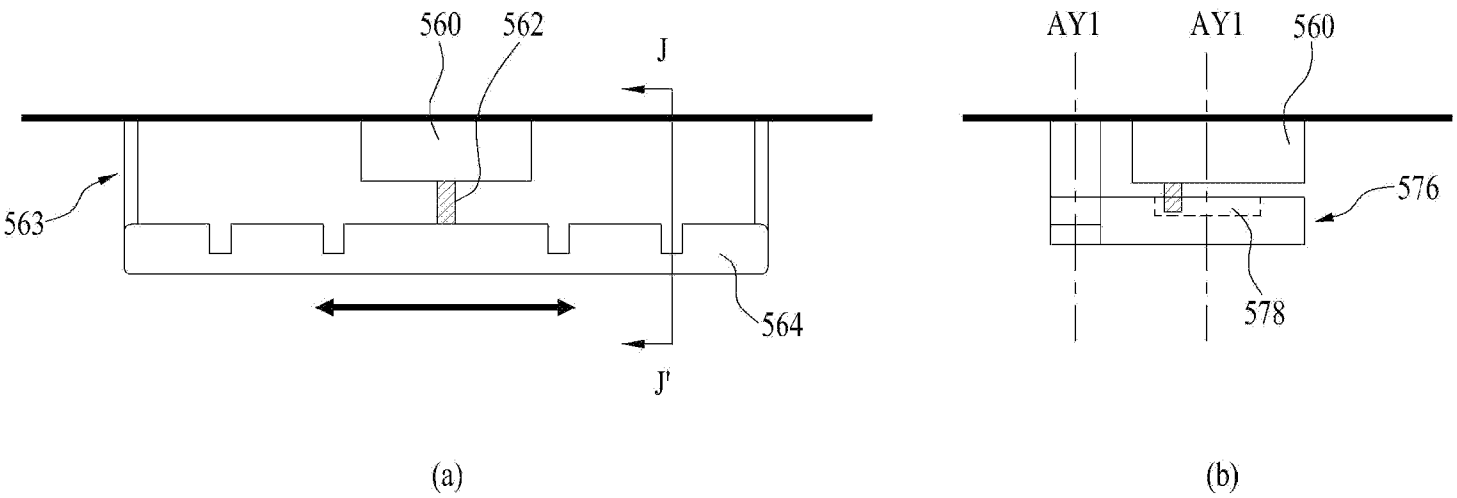

(a) and (b) in FIG. 20 schematically show still another example of a hanger assembly and a driver of a laundry treating apparatus described in the present disclosure.

Figure 21:
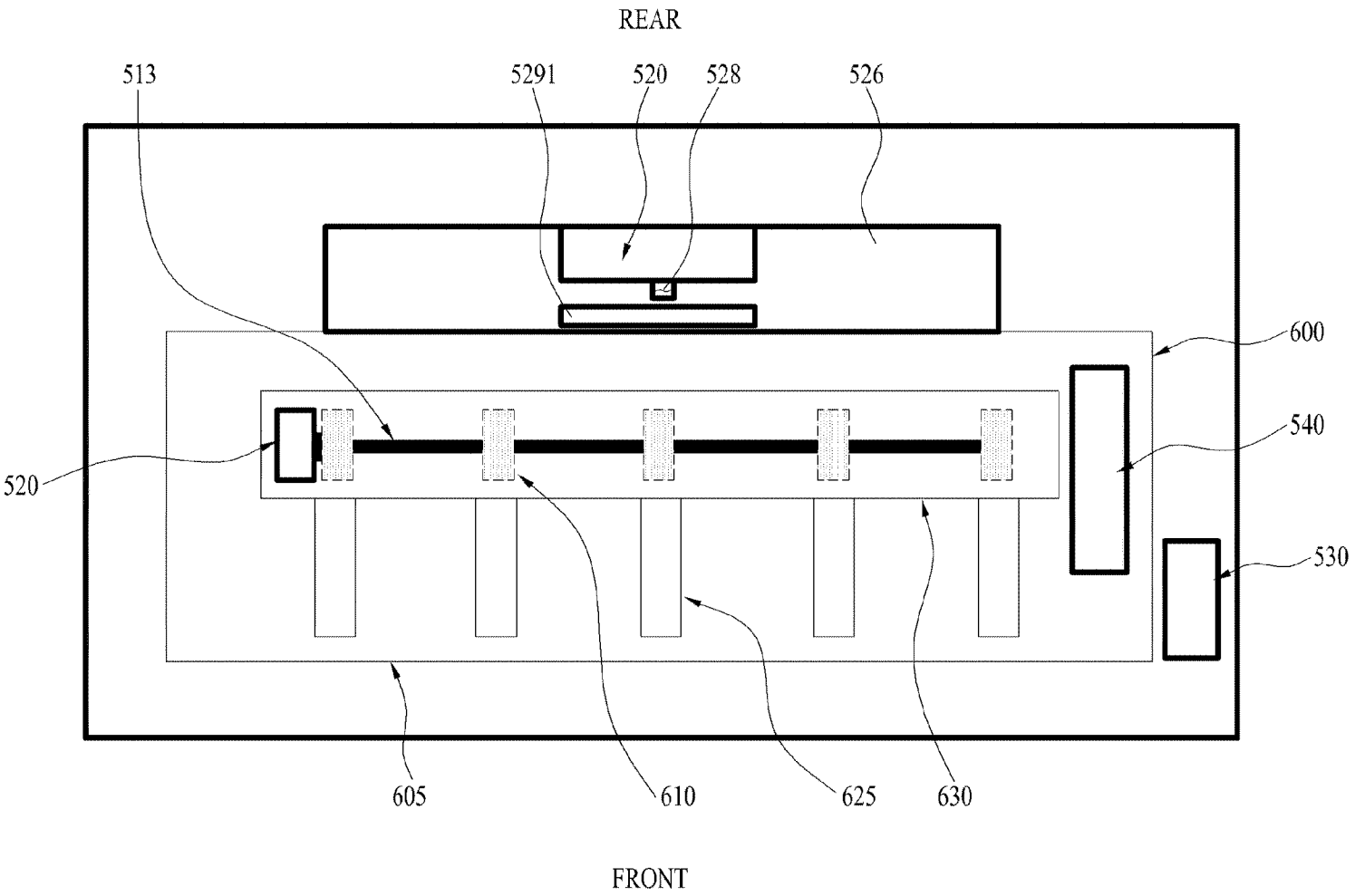

FIG. 21 schematically shows an example of driver arrangement described in the present disclosure.

Figure 22:
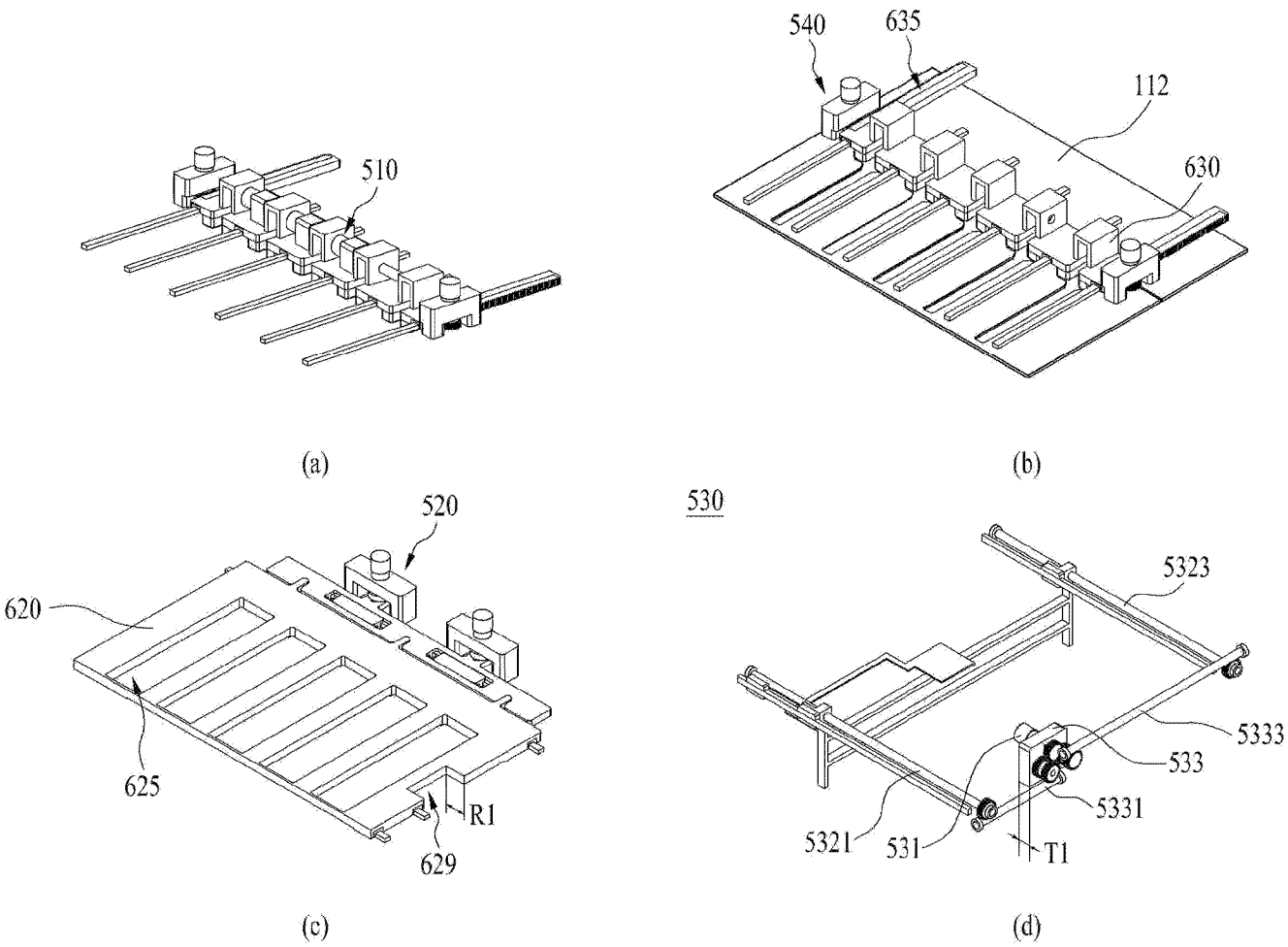

(a) in FIG. 22 shows an example of a hanger arranging portion. (b) in FIG. 22 shows an example of a hanger support frame and a transport driver. (c) in FIG. 22 shows an example of a hanger supporting stage and a reciprocating portion. (d) in FIG. 22 shows an example of a moving driver that moves a dividing portion.

Figure 23:
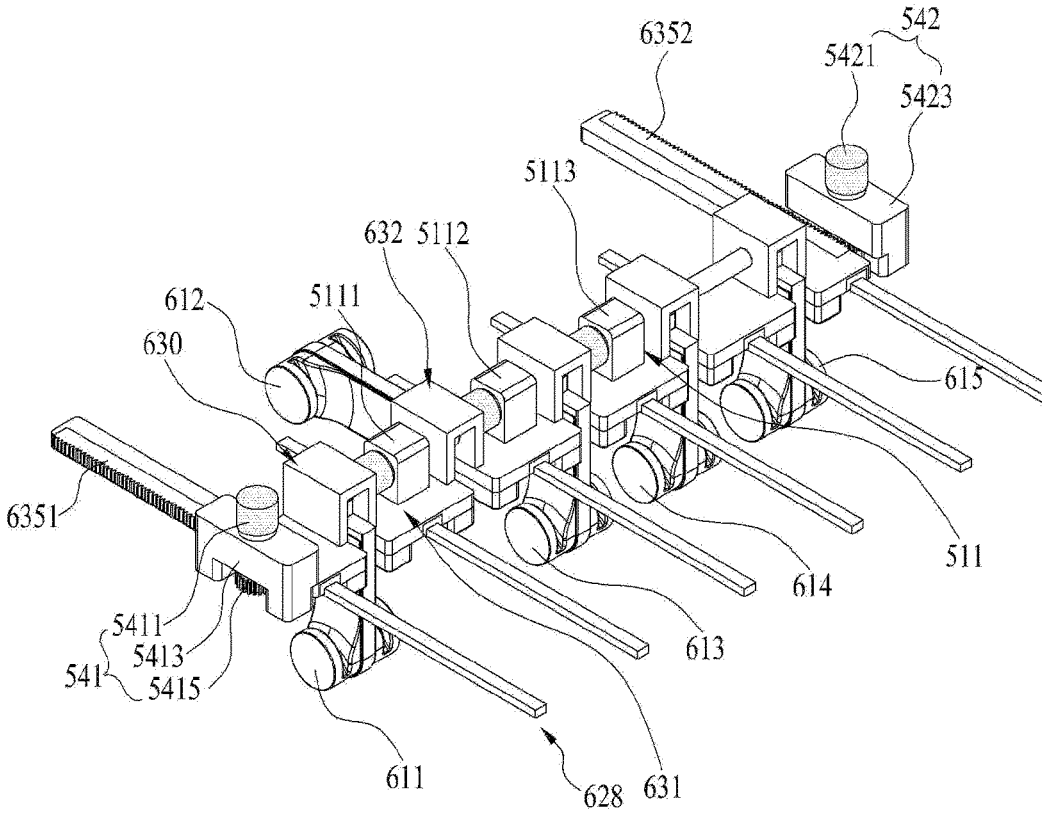

FIG. 23 shows a state in which one hanger is raised above a first chamber top surface by a hanger arranging portion.

Figure 24:
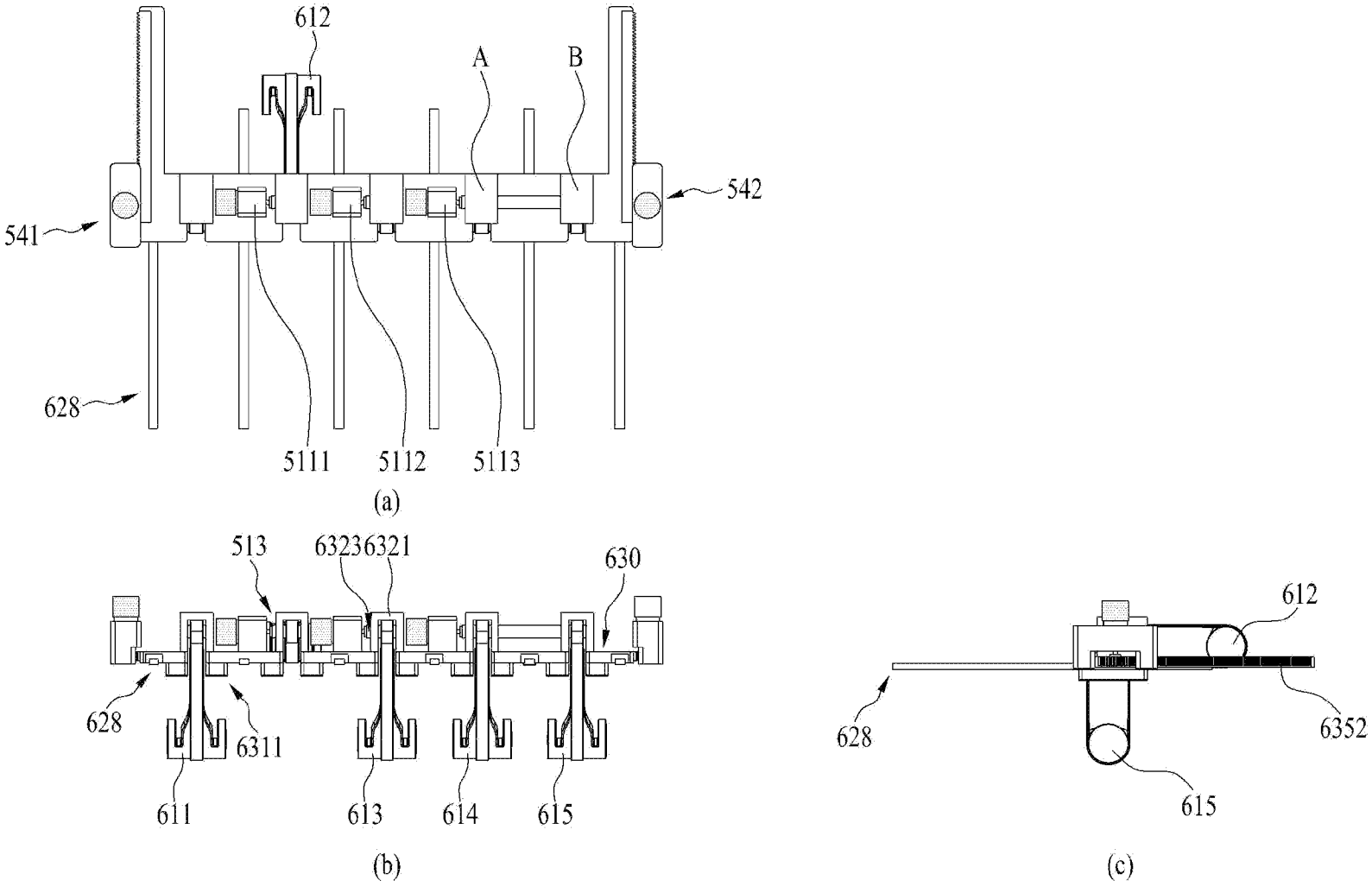

(a) and (b) in FIG. 24 show a top view and a front view of an example of a hanger arranging portion shown in FIG. 23, respectively. (c) in FIG. 24 is a side view of a hanger support frame and a transport driver.

Figure 25:
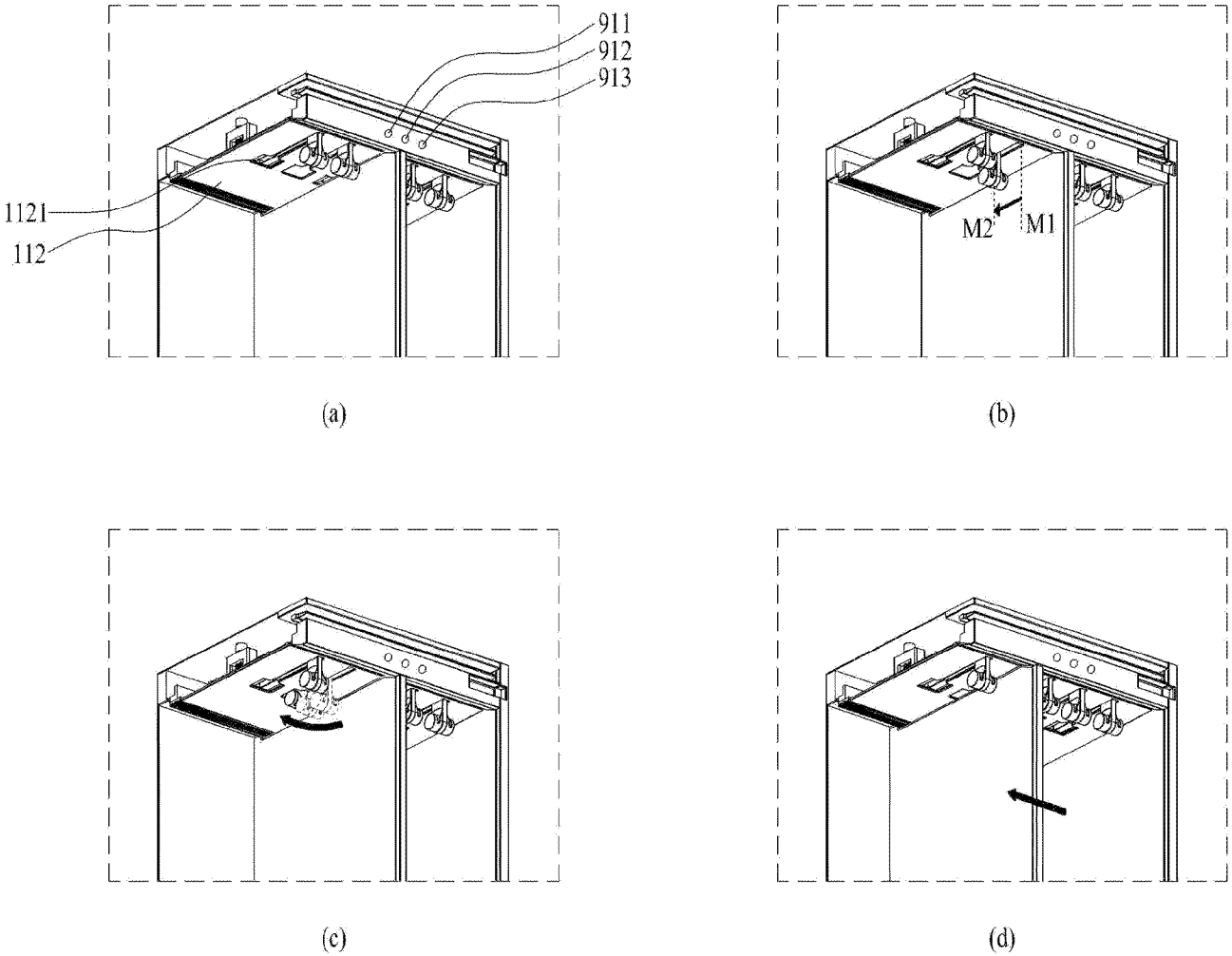

(a) and (d) in FIG. 25 show a state in which, when a dividing portion moves to a position of one of cutout holes, a hanger located in the corresponding cutout hole pivots and enters a first chamber top surface so as to be located above the first chamber top surface in stages.

Figure 26:
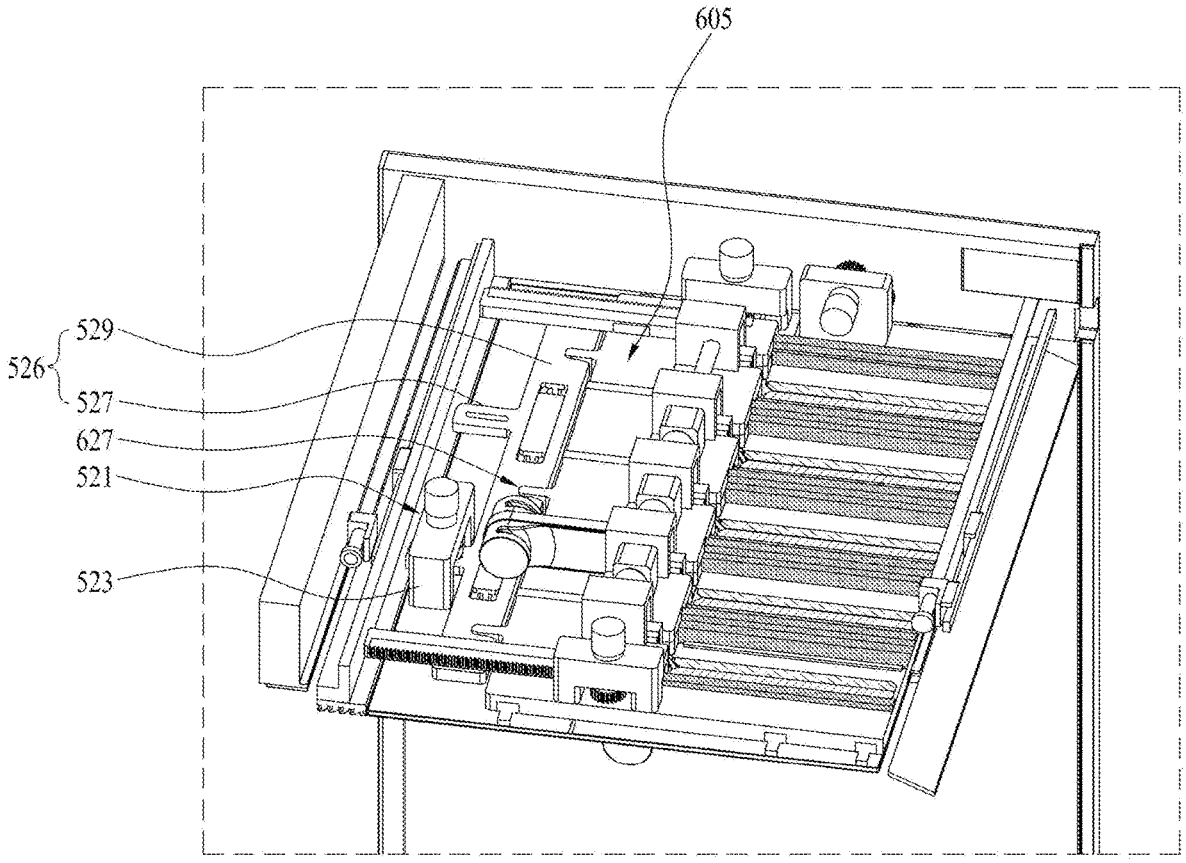

FIG. 26 shows an example of a reciprocating portion and a hanger assembly.

Figure 27:
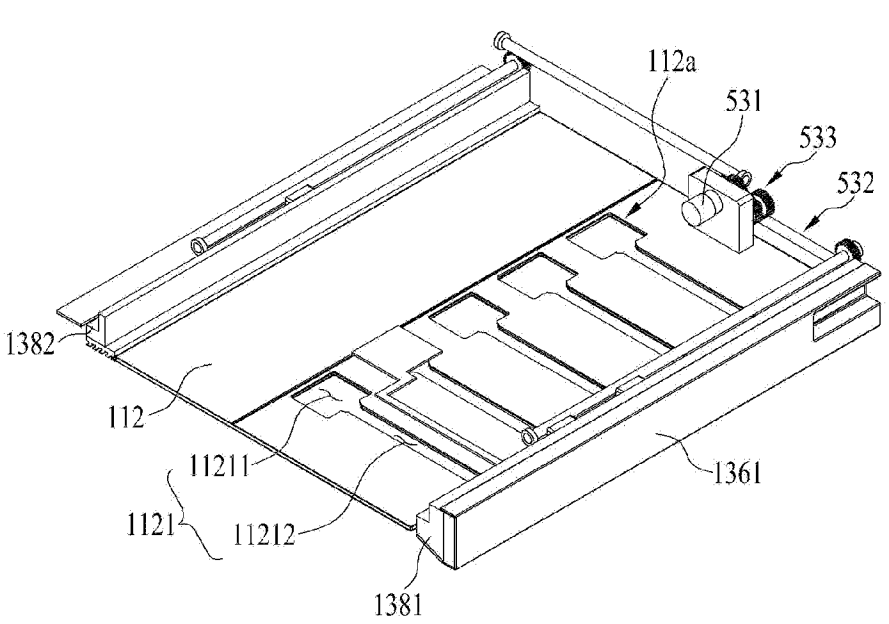
Figure 27:
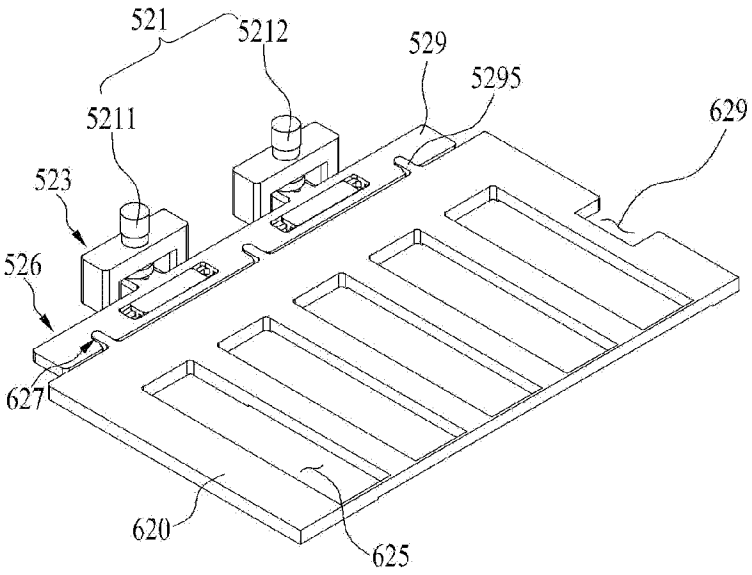

(a) in FIG. 27 shows an example of a reciprocating portion and a hanger supporting stage. (b) in FIG. 27 shows an example of a moving driver.

Figure 28:
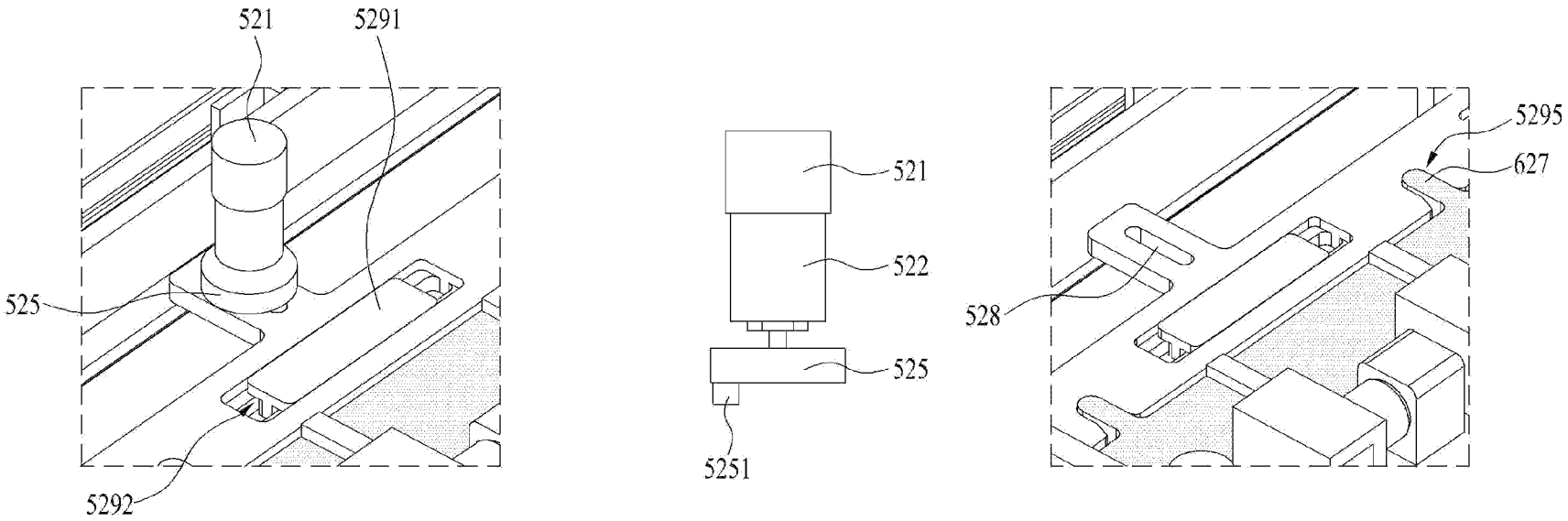

(a) in FIG. 28 is an enlarged view of an example of a reciprocating portion and a moving body. (b) in FIG. 28 shows an eccentric moving portion. (c) in FIG. 28 shows an example of motion conversion means and motion transfer means.

Figure 29:
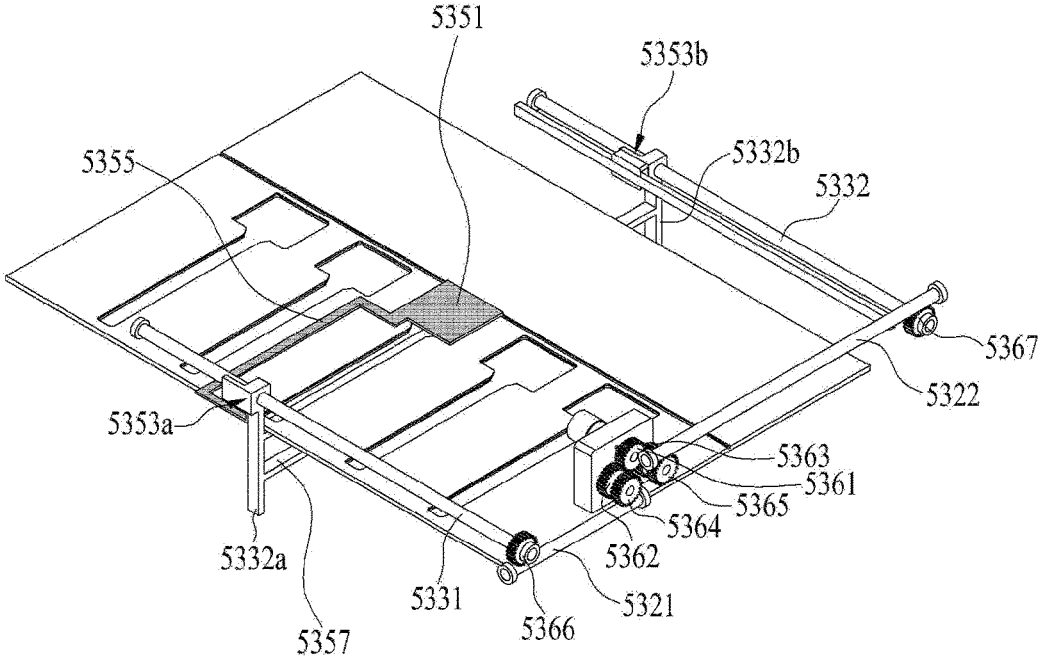

FIG. 29 shows an example of a moving driver and a moving member.

Figure 30:
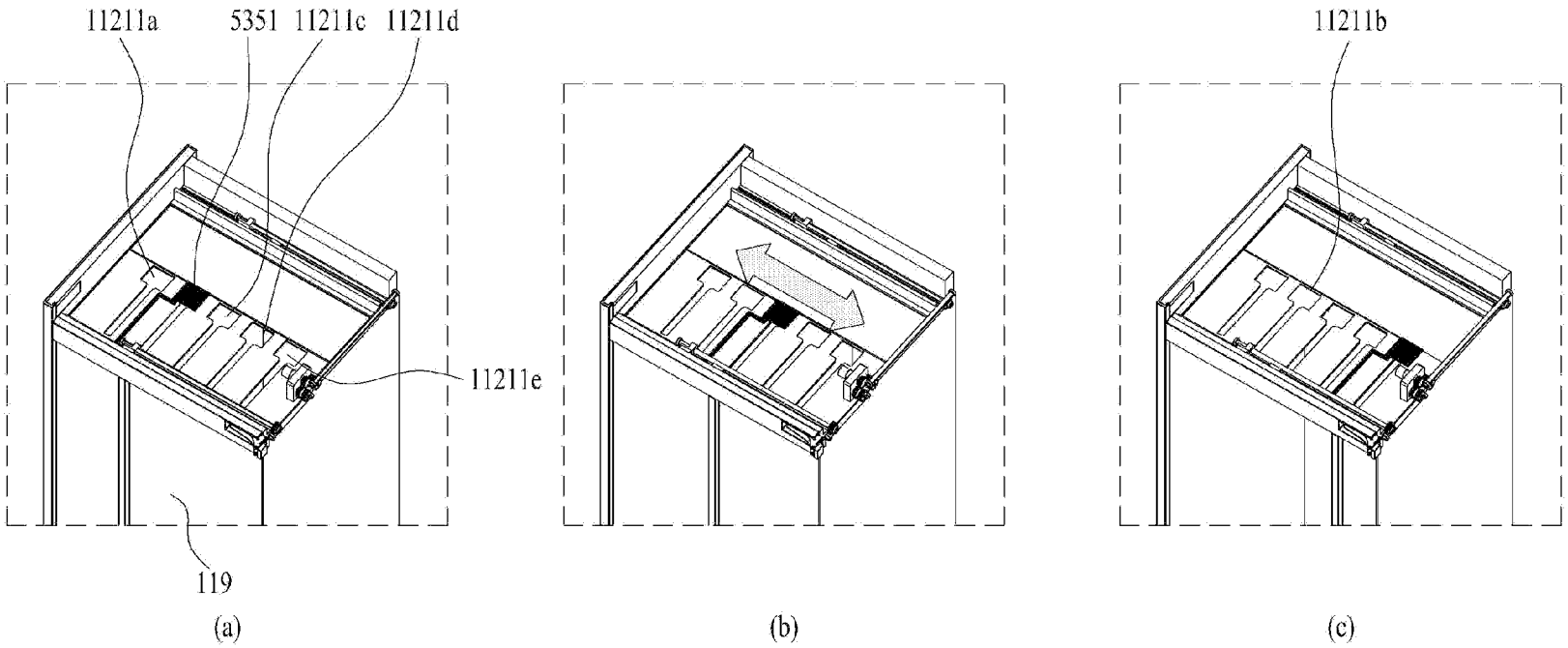

(a) and (c) in FIG. 30 shows an example of a hanger cover.

Figure 31:
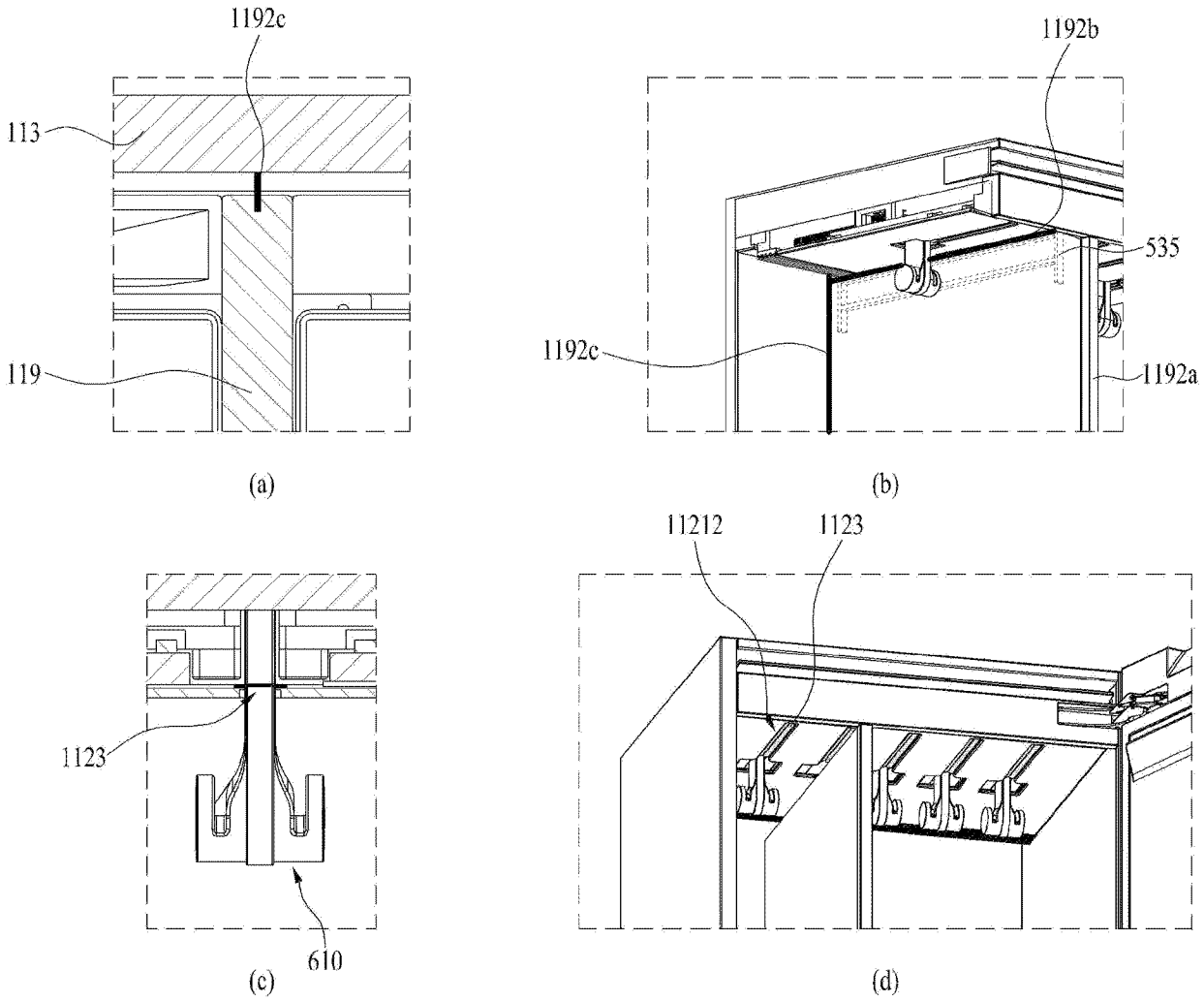

(a) and (d) in FIG. 31 show an example of a dividing wall gasket and a hanger gasket.

Figure 32:
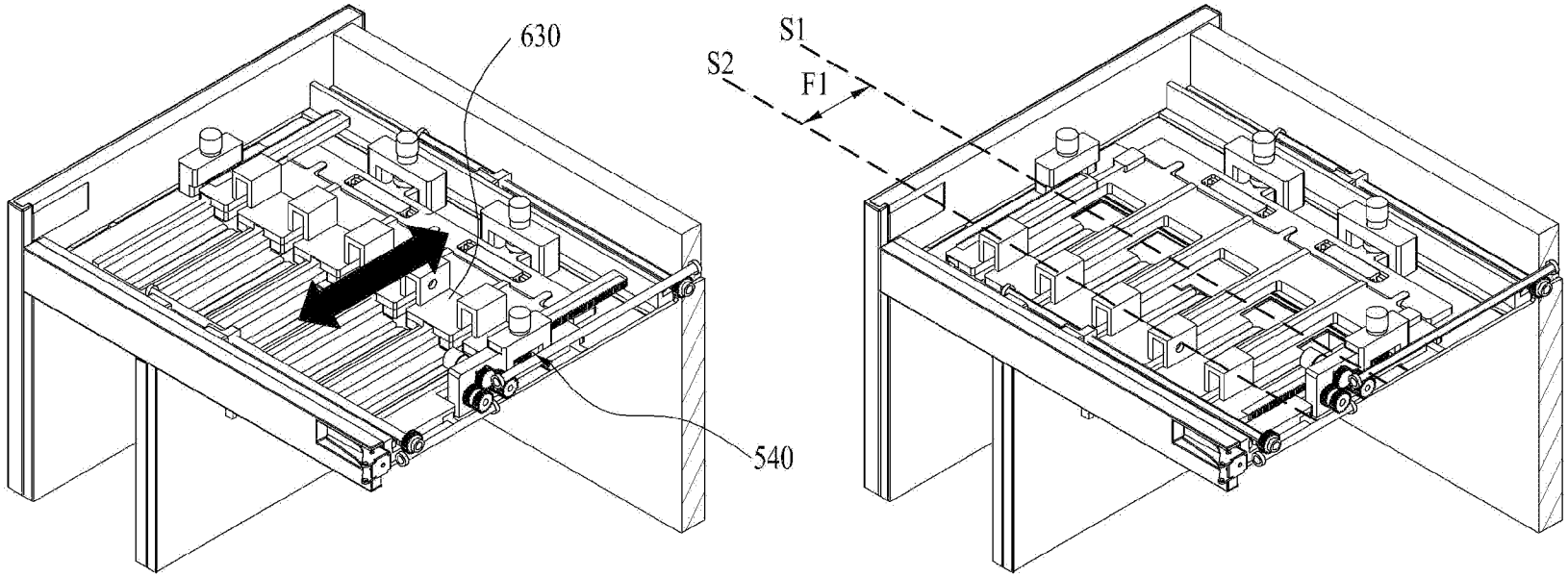

(a) and (b) in FIG. 32 show an example of a transport driver.

Figure 33:
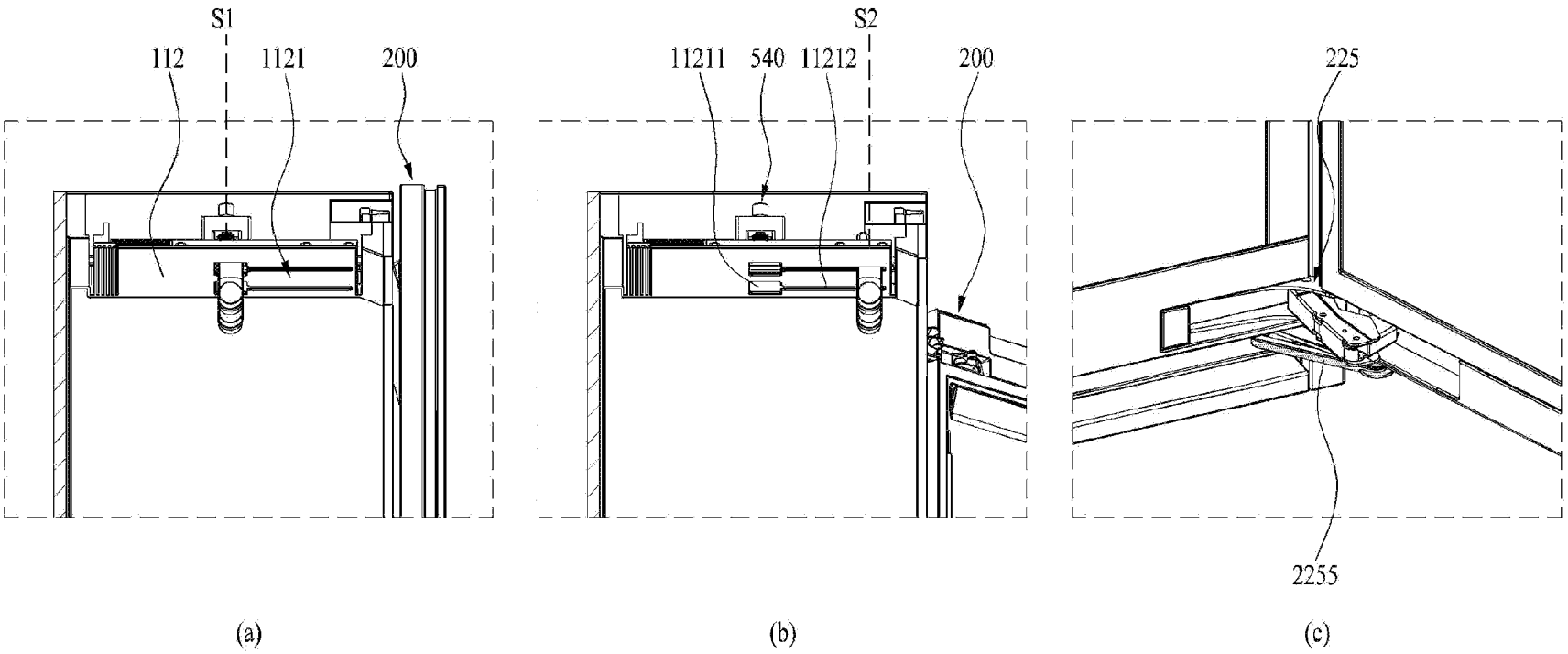

(a) and (c) in FIG. 33 show operation steps of a transport driver when a main door is opened.

Figure 34:
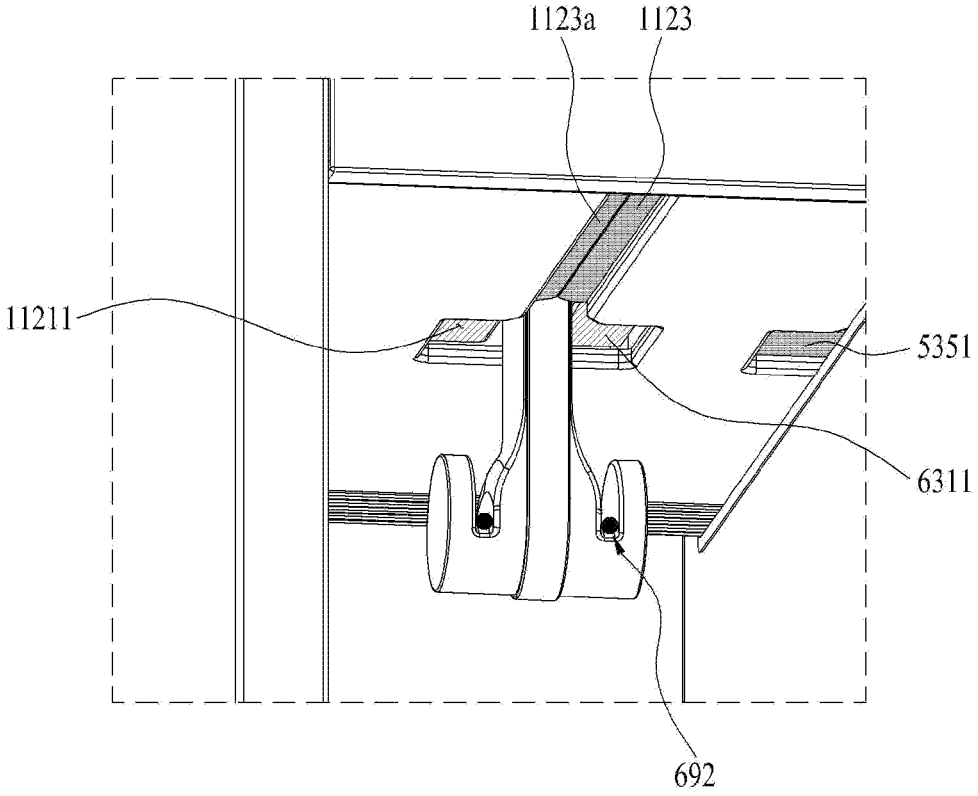

FIG. 34 is an enlarged view of a hanger gasket.

Figure 35:
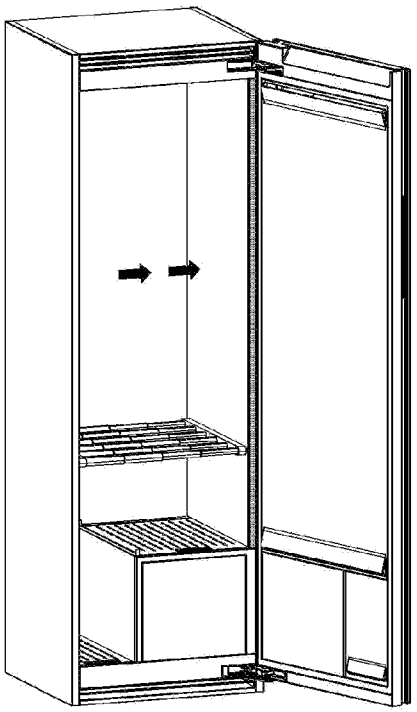
Figure 35:
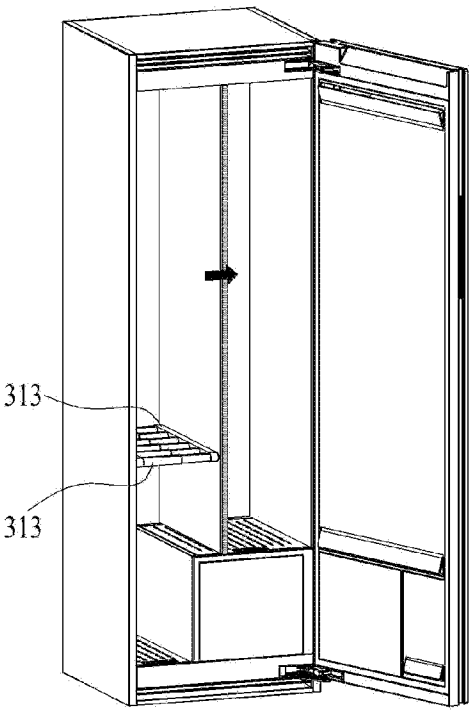
Figure 35:
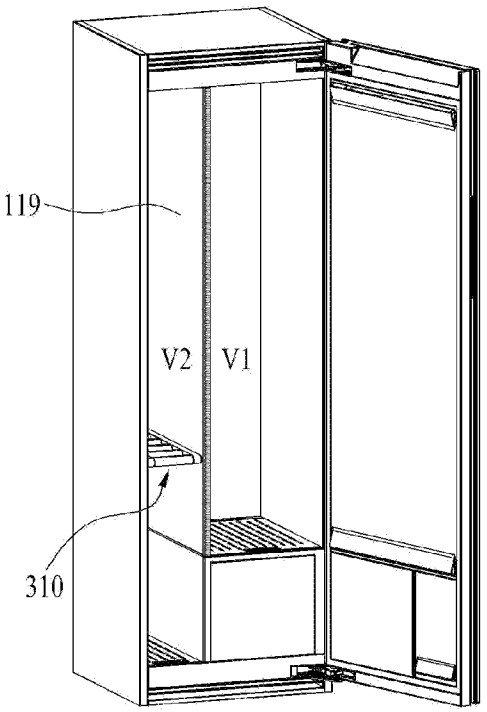

(a) and (c) in FIG. 35 show an example of a length-adjustable shelf with a shelf length adjustable based on a movement of a dividing portion.

Figure 36:
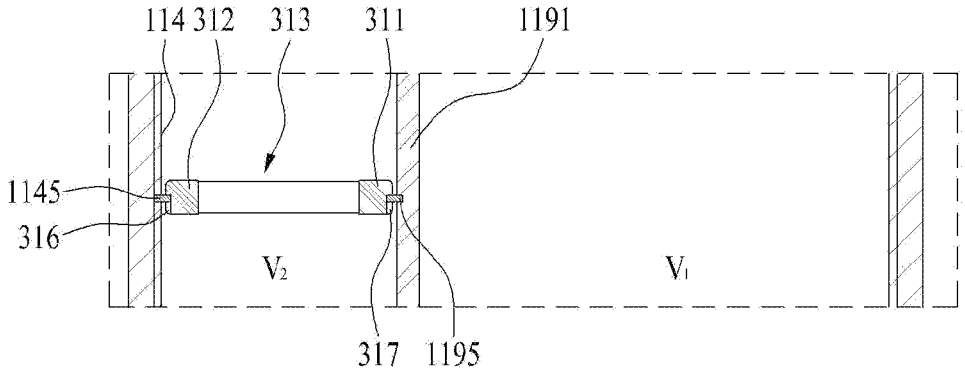

FIG. 36 shows a front view of an example in which a length-adjustable shelf is mounted.

Figure 37:
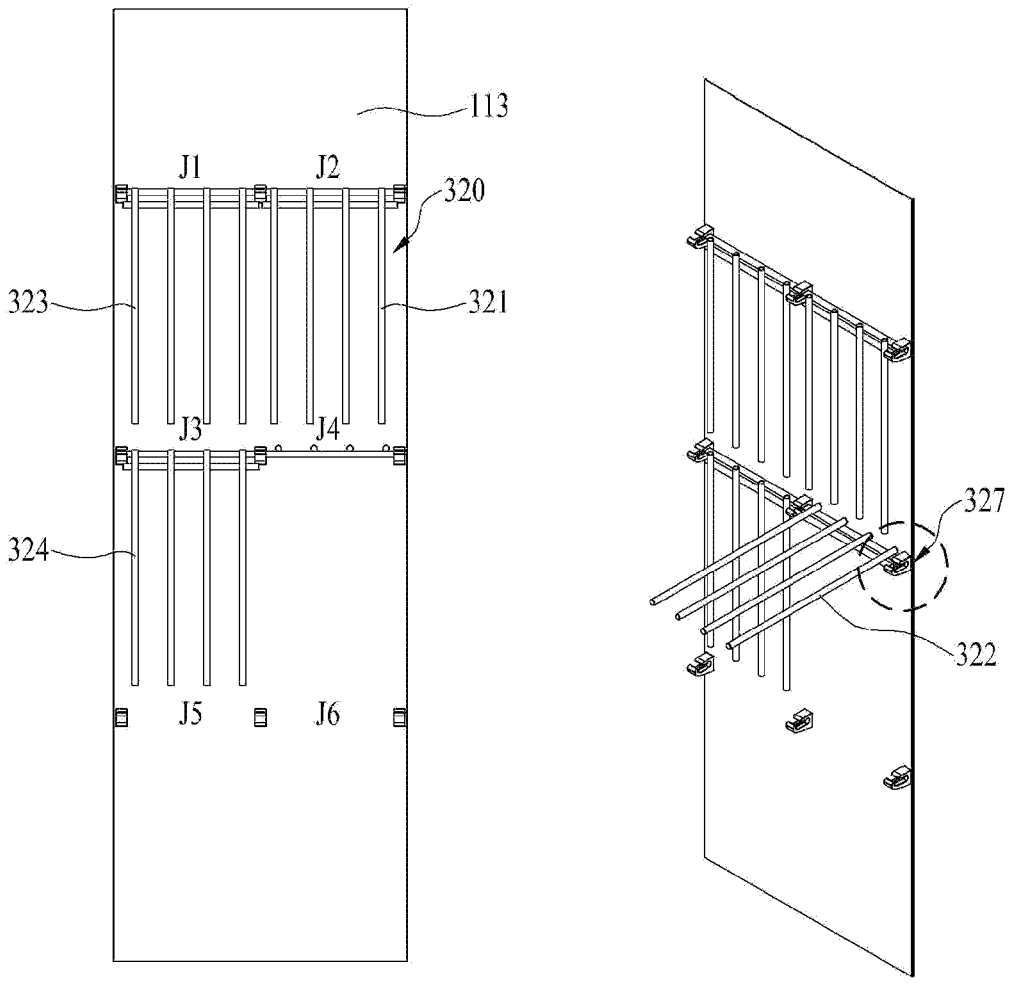

(a) and (b) in FIG. 37 show an example of a mountable shelf detachable from one side surface of a first chamber.

Figure 38:
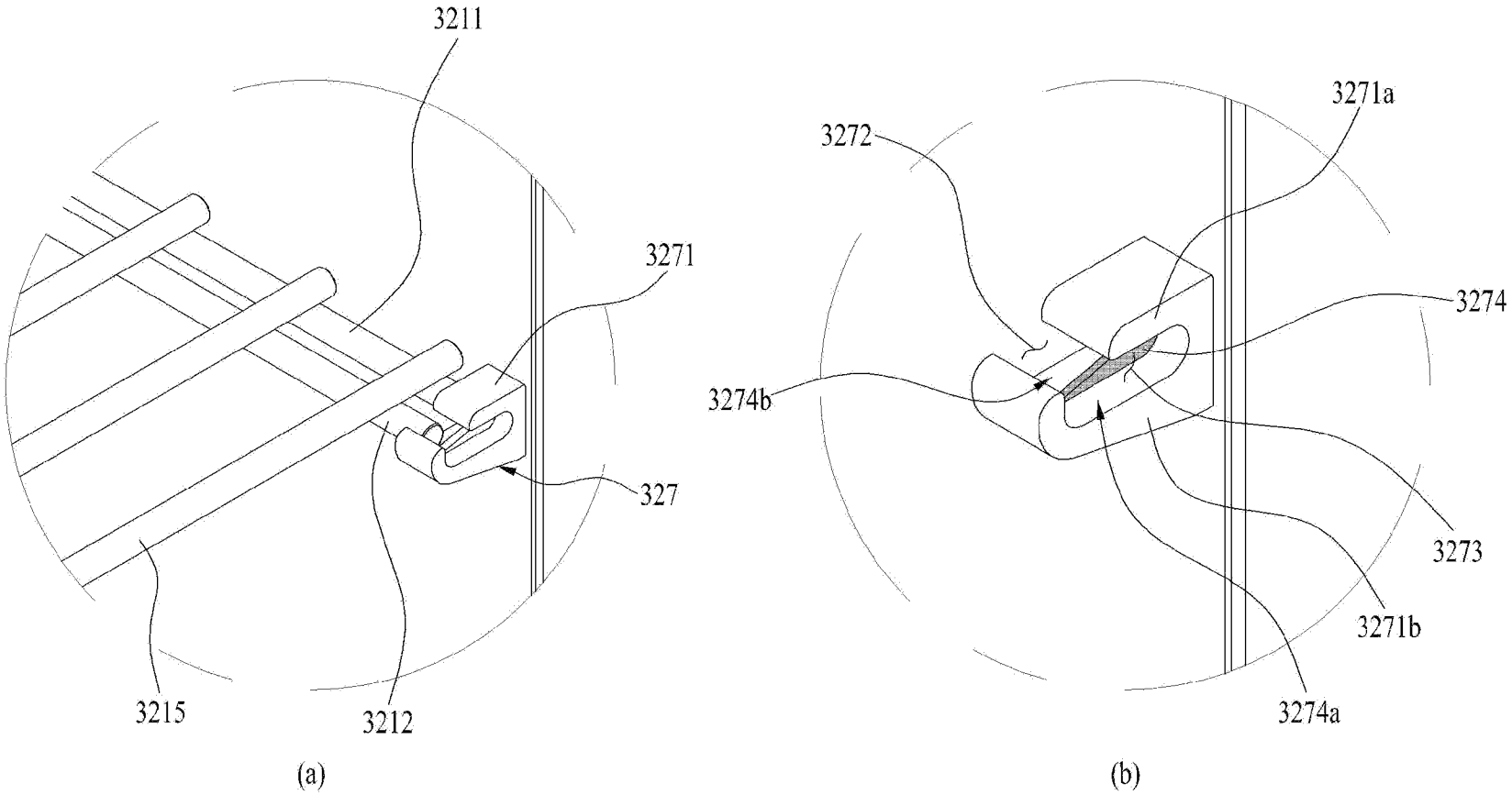

(a) and (b) in FIG. 38 show an example of a shelf fixing clip.

Figure 39:
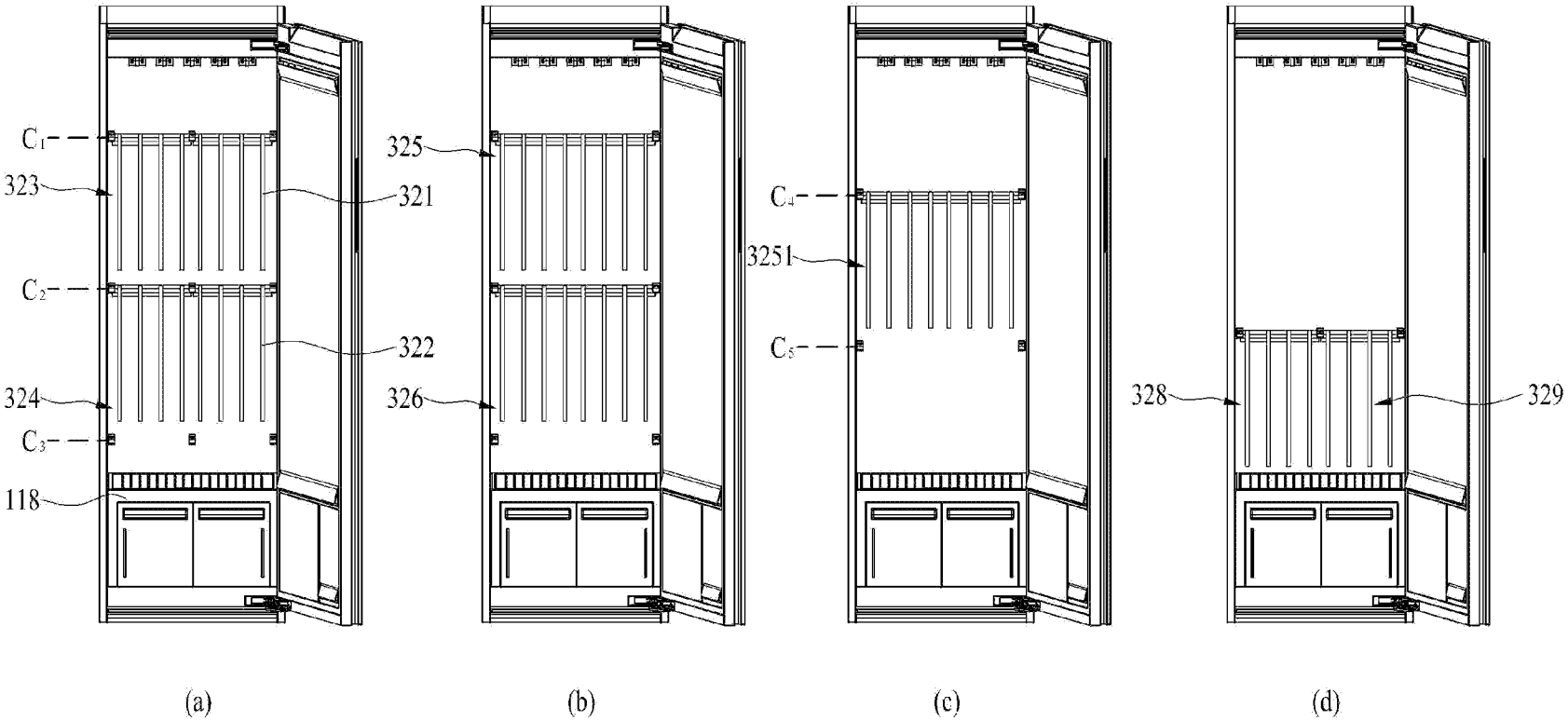

(a) and (d) in FIG. 39 show various embodiments of a mountable shelf.

Figure 40:
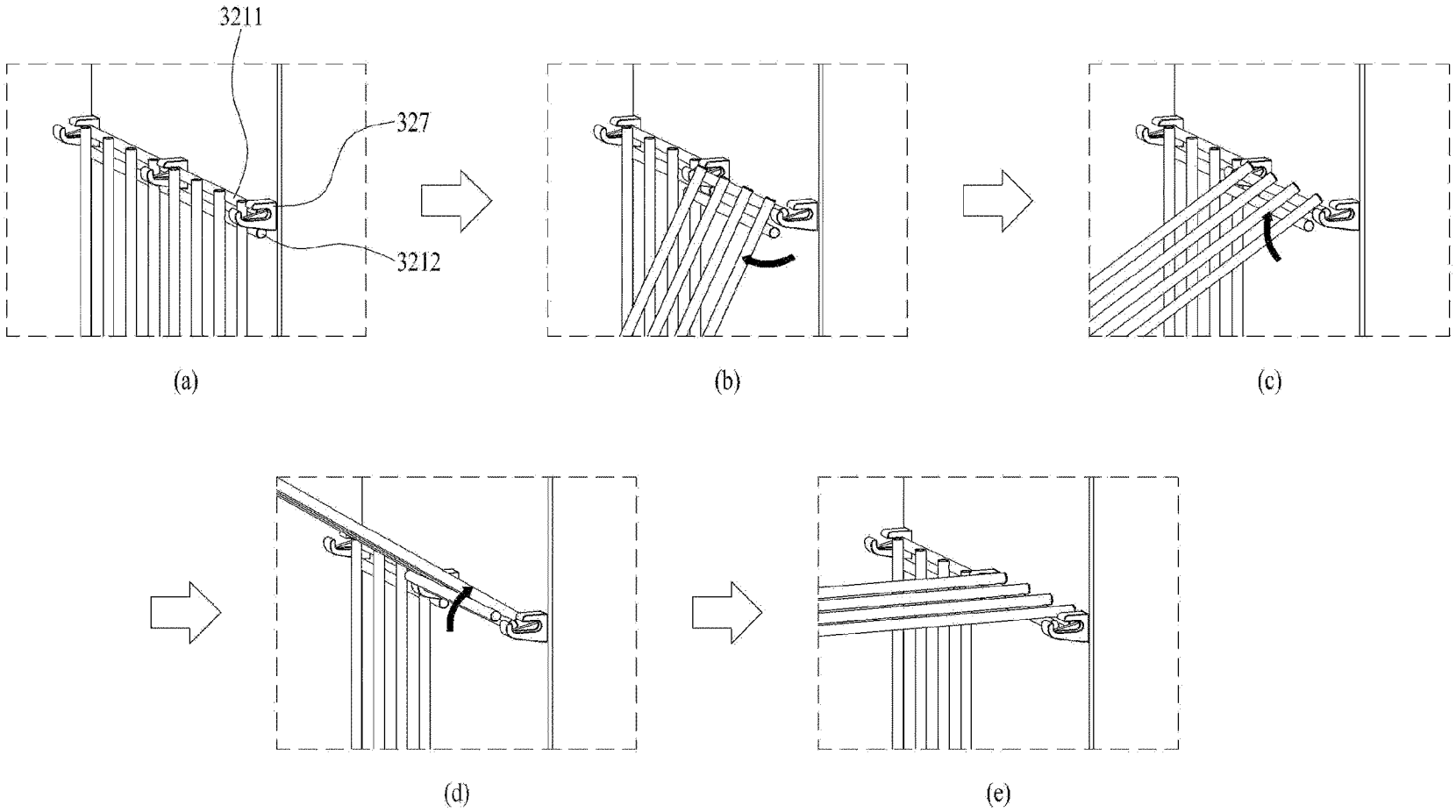

(a) and (e) in FIG. 40 show steps of installing or removing a mountable shelf for use.

Figure 41:
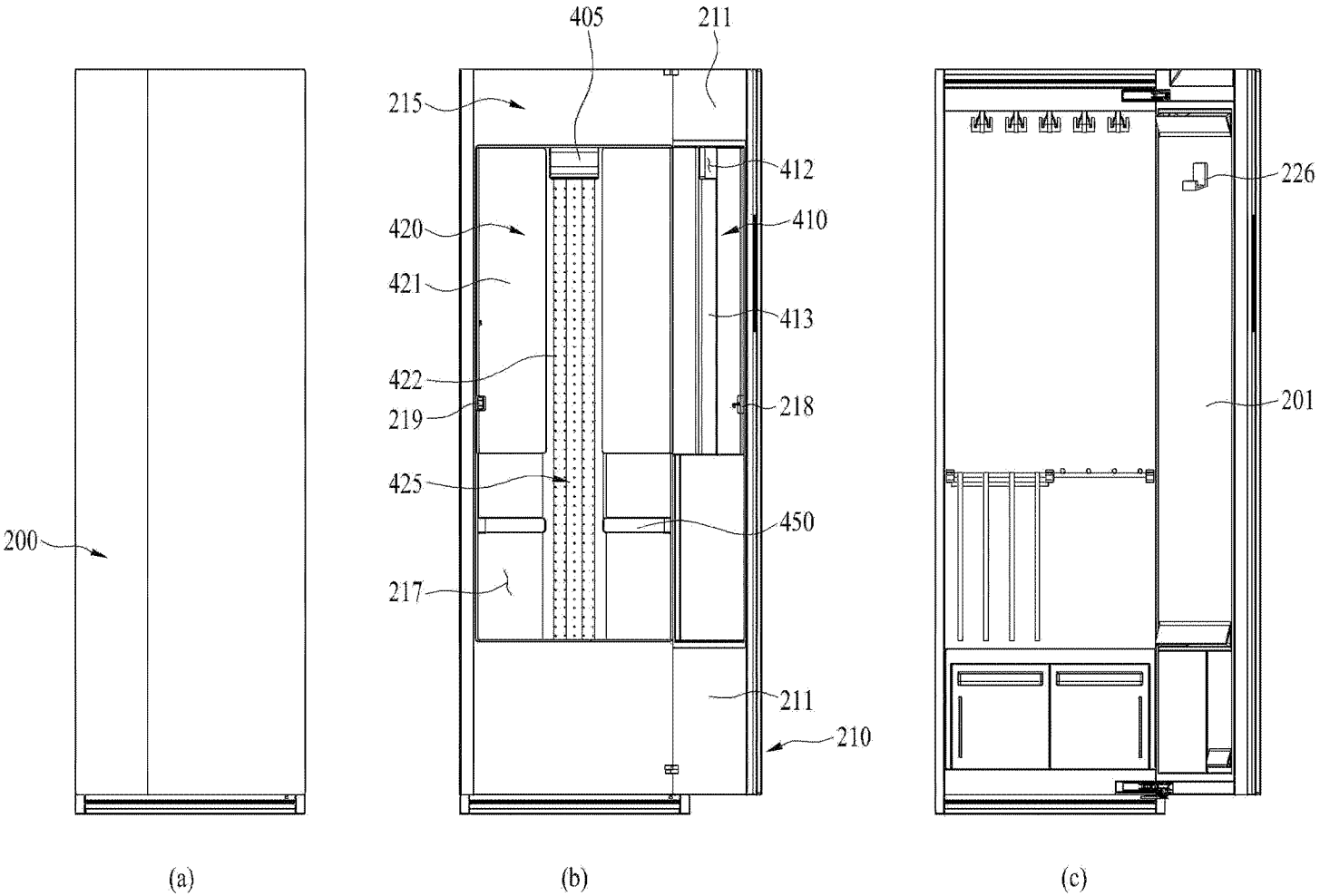

(a) and (c) in FIG. 41 show an example in which a pressor for removing wrinkles of laundry is accommodated inwardly of a main door.

Figure 42:
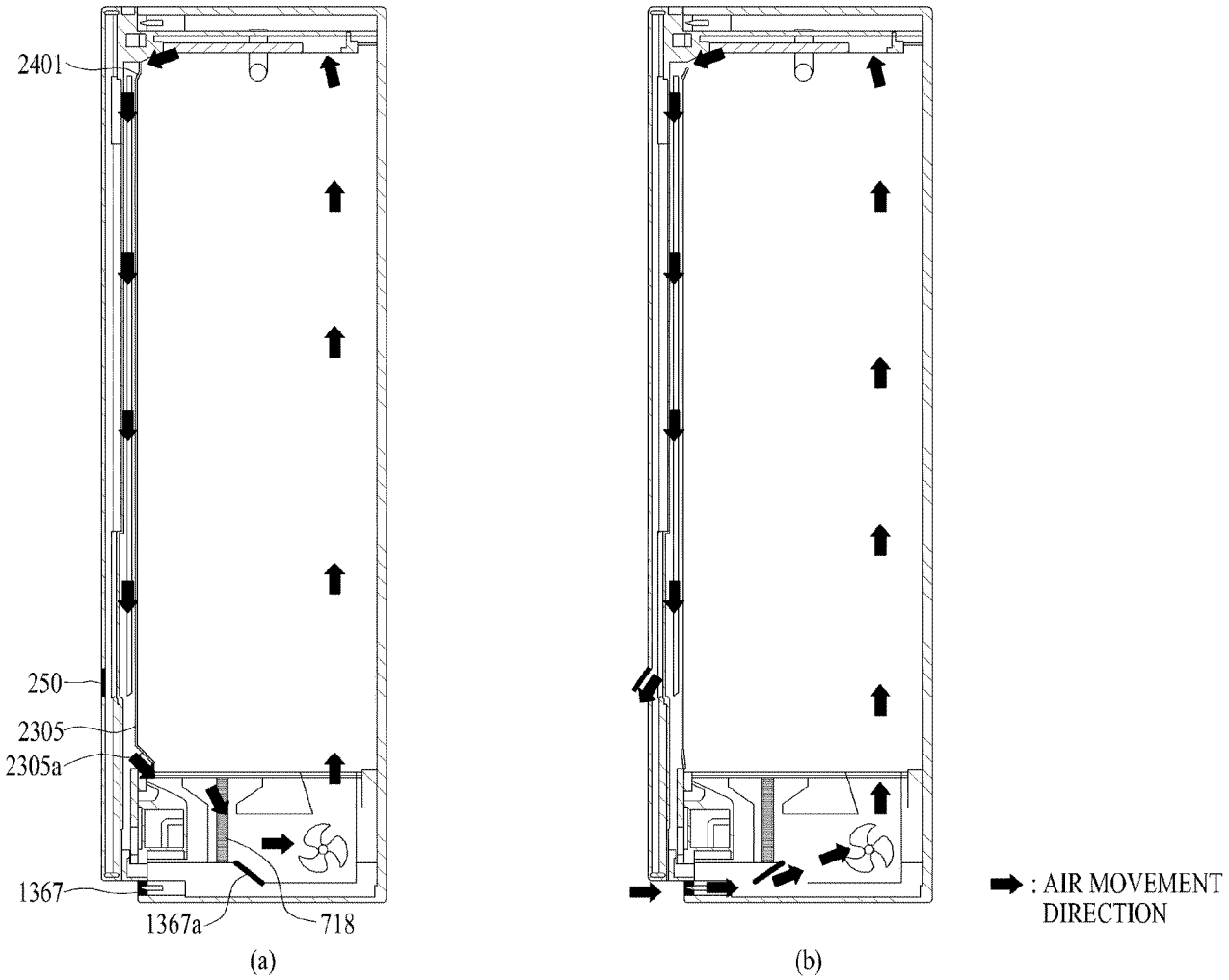

(a) in FIG. 42 shows an example of air circulation of a pressor. (b) in FIG. 42 shows an example of suction and circulation of outside air of a laundry treating apparatus.

Figure 43:
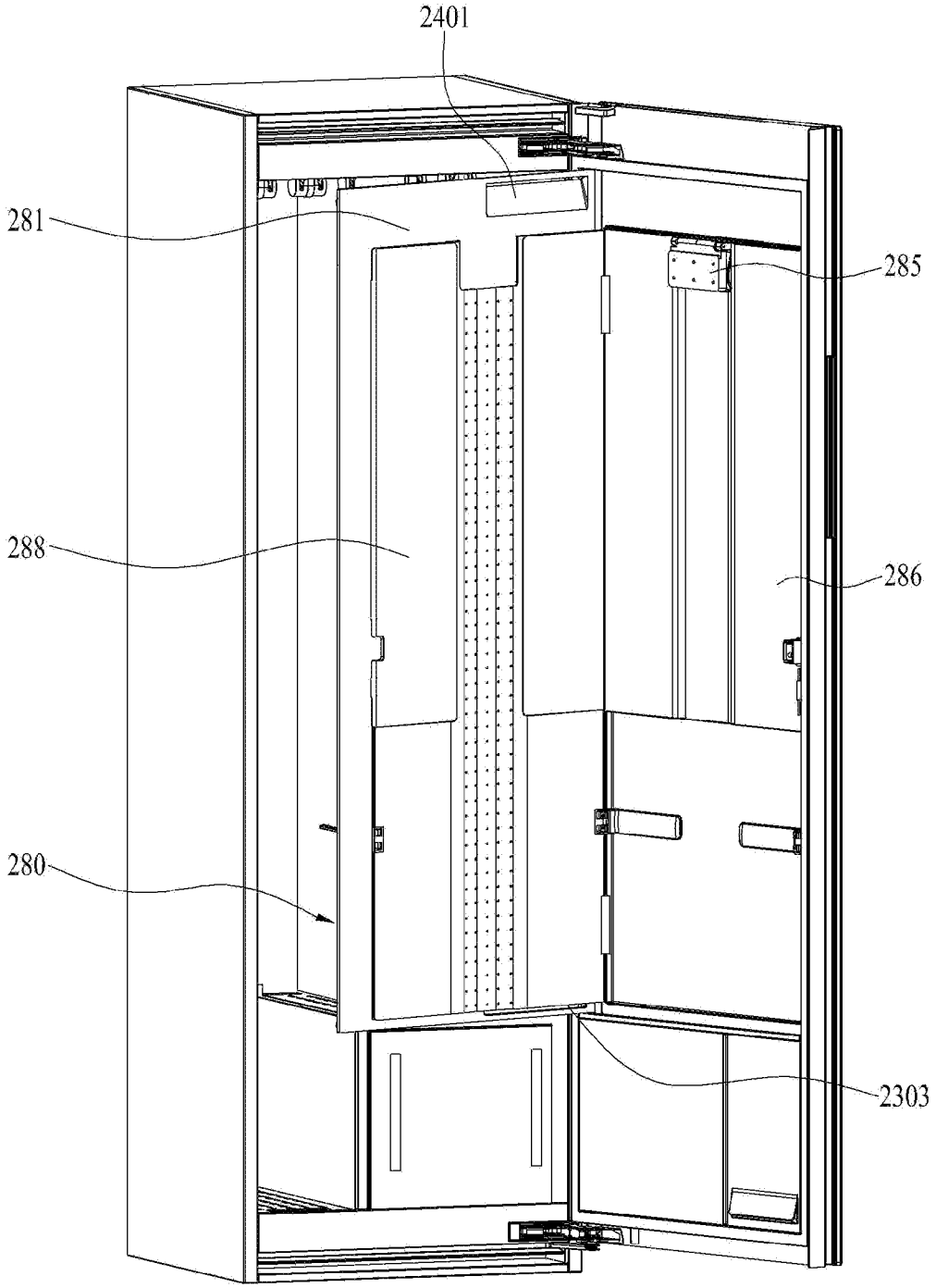

FIG. 43 shows an example in which an auxiliary door for accessing a pressor accommodated inwardly of a main door is located on an inner surface of the main door.

Figure 44:
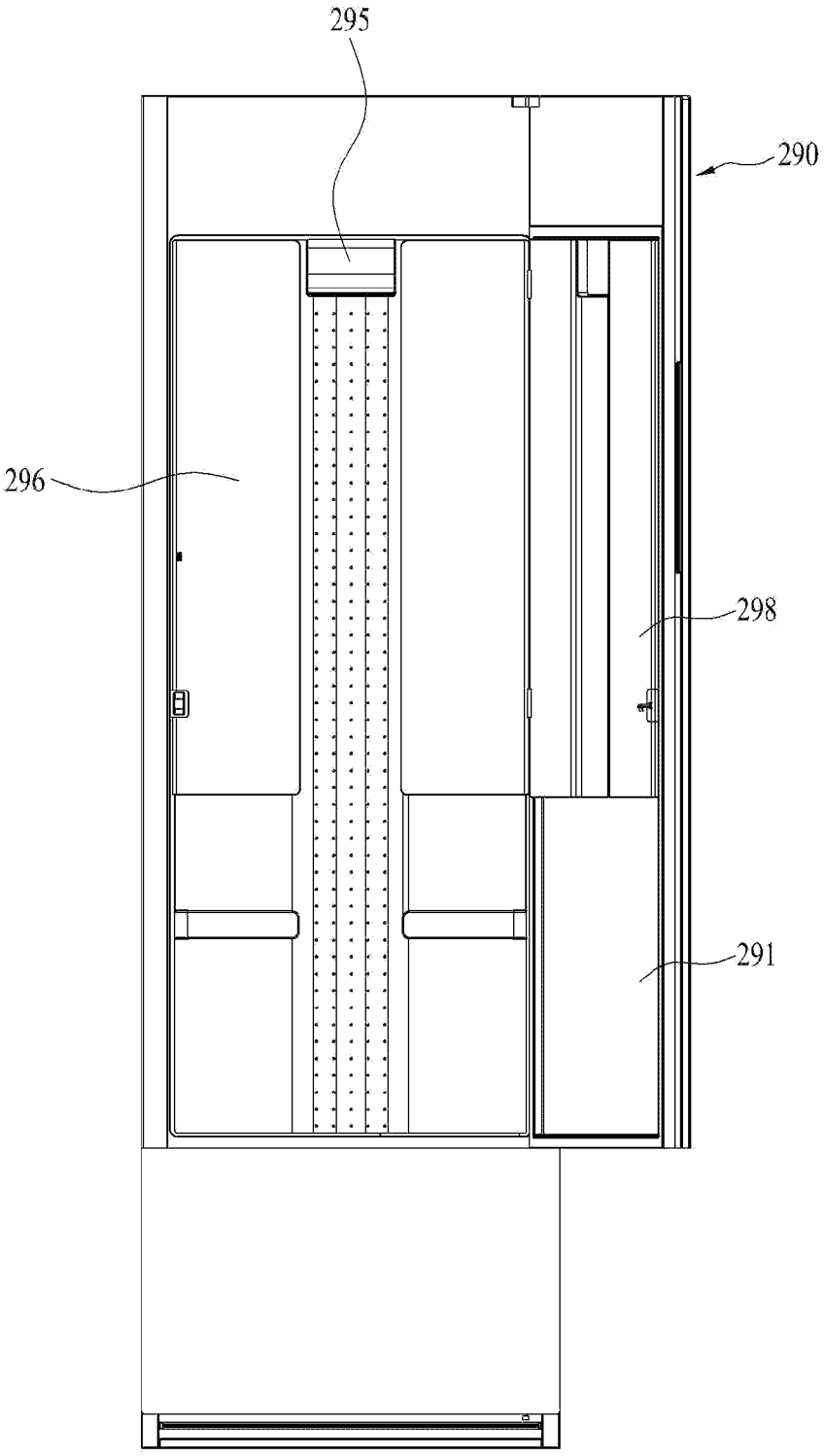

FIG. 44 shows a case in which an auxiliary door for accessing a pressor accommodated inwardly of a main door is a portion of the main door.

Figure 45:
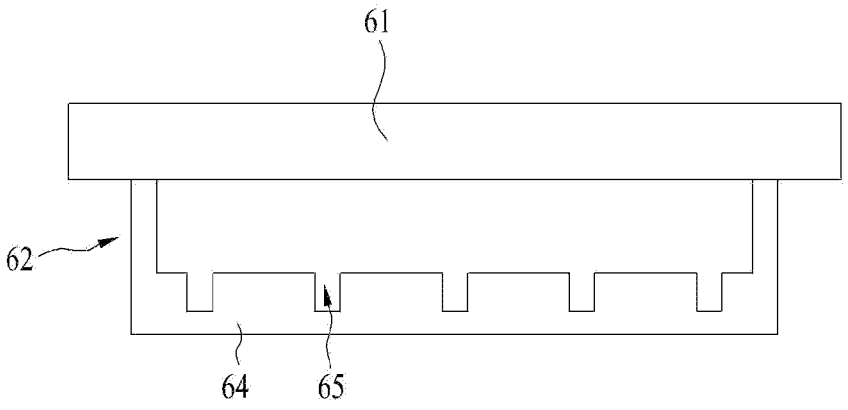
Figure 45:
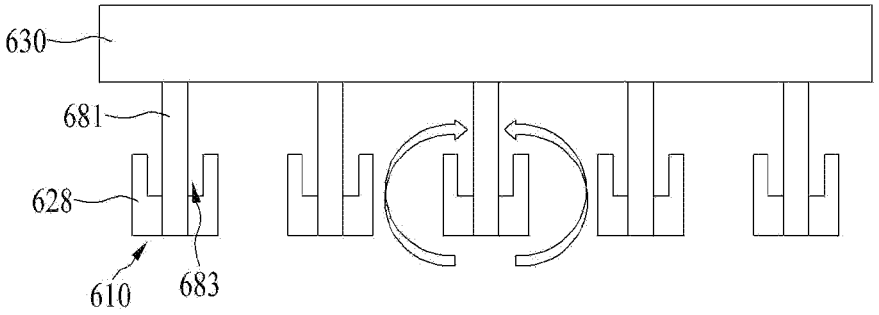

(a) in FIG. 45 shows a conventional hanger. (b) in FIG. 45 shows an example of an independently operable hanger described in the present disclosure.

Figure 46:
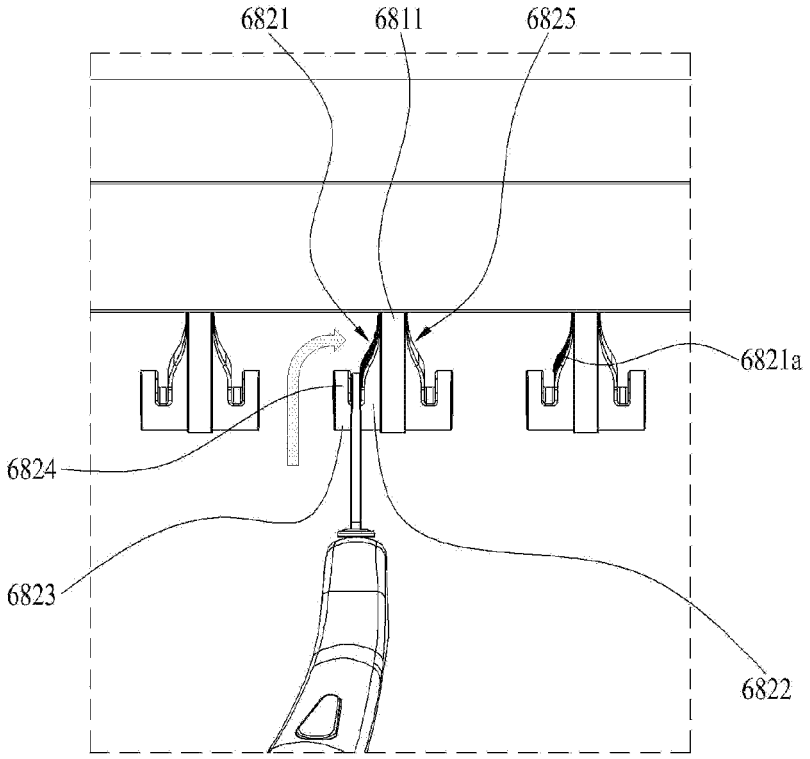
Figure 46:
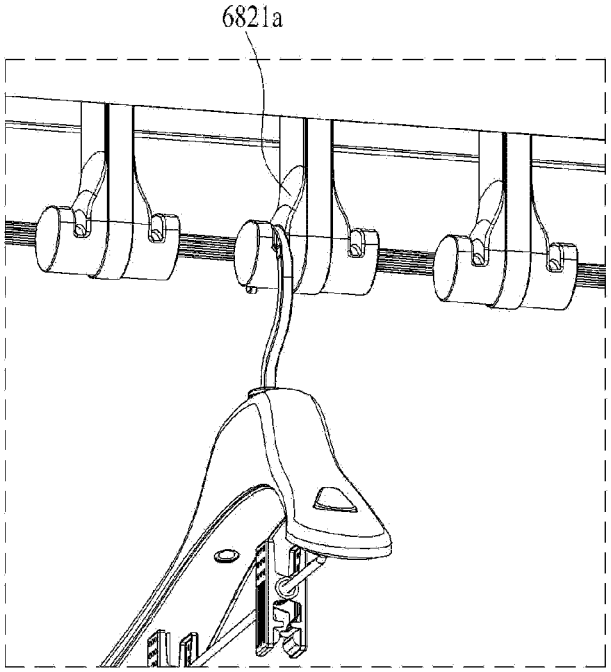

(a) and (b) in FIG. 46 show an example in which a clothes hanger is mounted.

Figure 47:
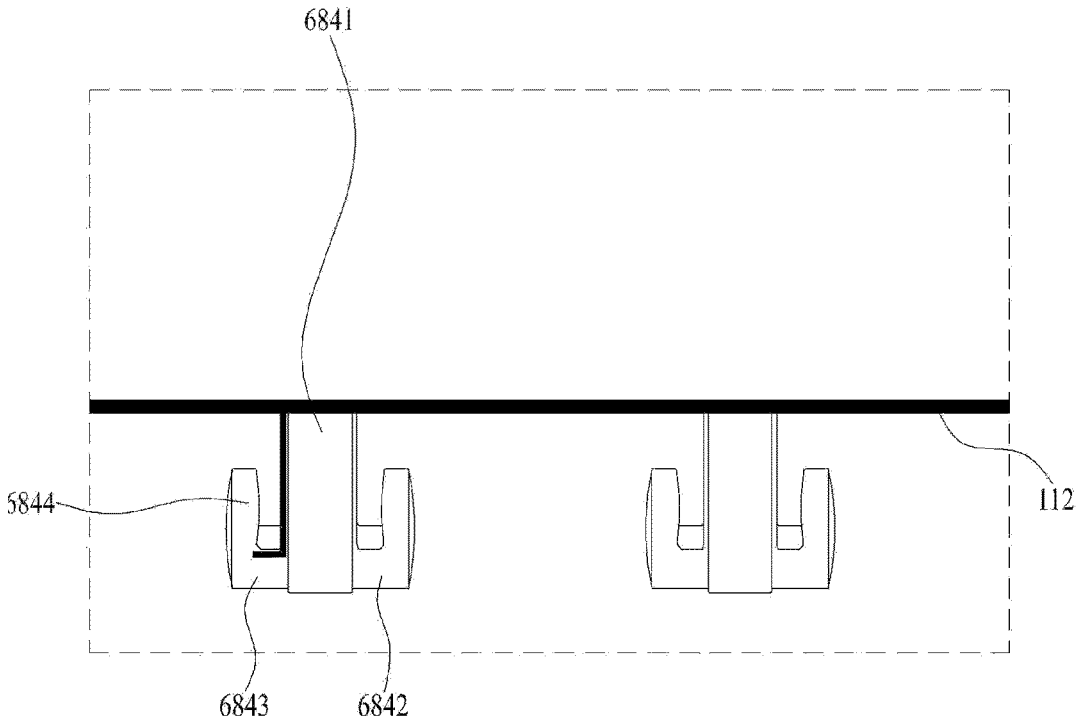

FIG. 47 shows another example of a hanger.

Figure 48:
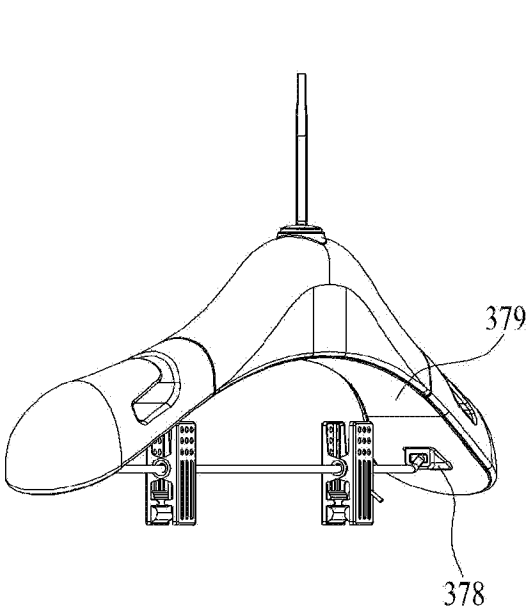
Figure 48:
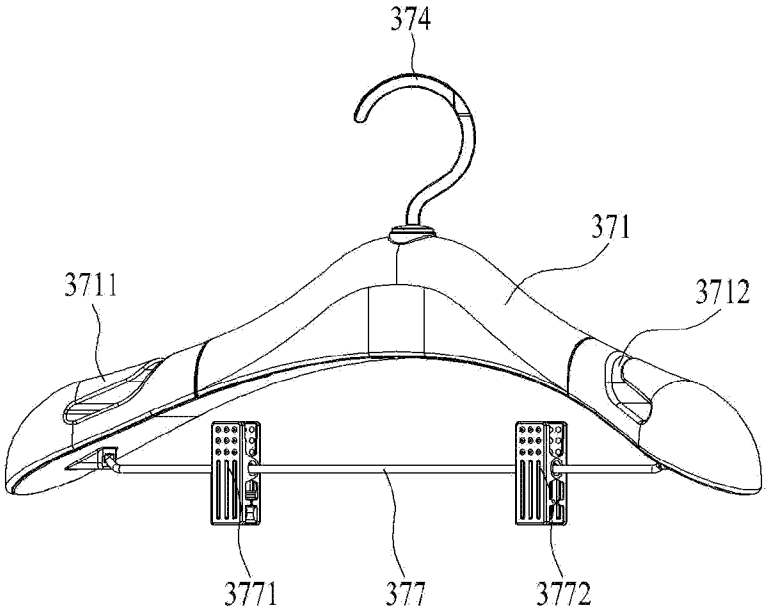

(a) and (b) in FIG. 48 show an example of a clothes hanger unit that may be mounted on a hanger hook.

Figure 49:
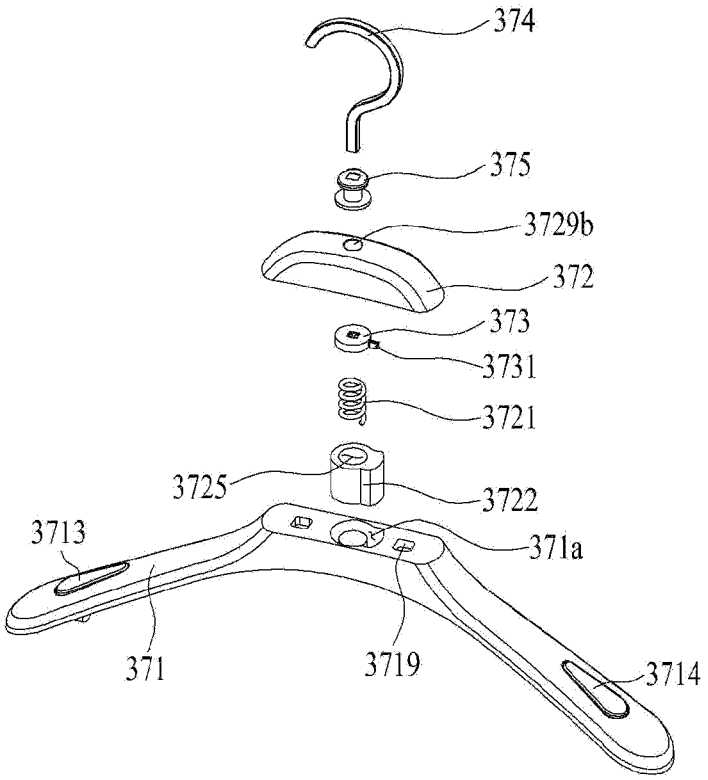
Figure 49:
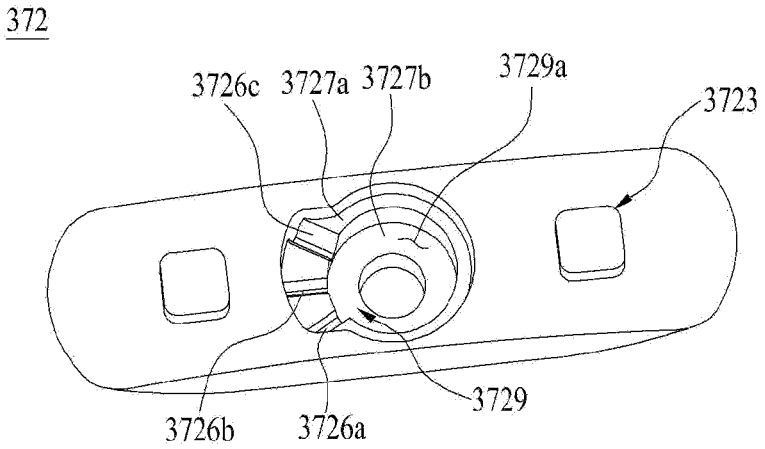

(a) in FIG. 49 is an exploded view of an example of a clothes hanger unit. (b) in FIG. 49 shows an example of a guide connecting portion.

Figure 50:
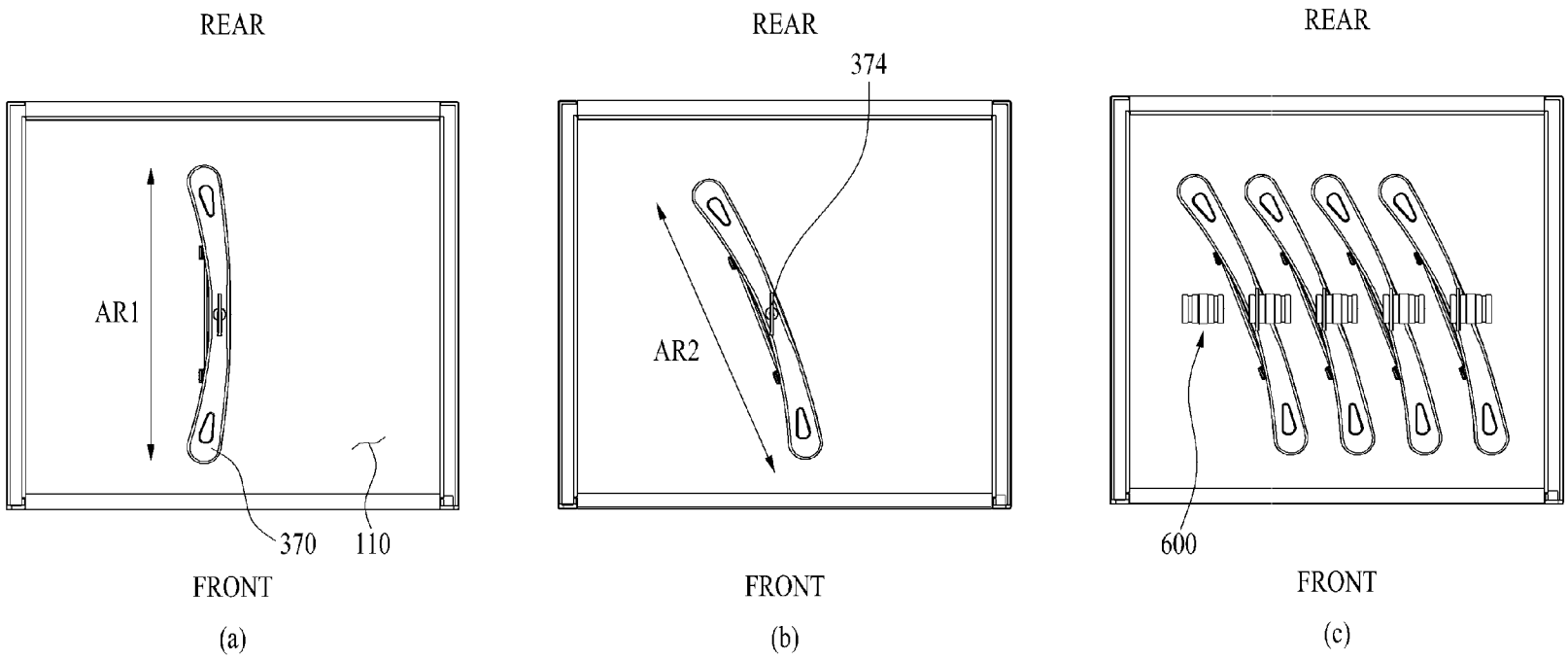

(a) to (c) in FIG. 50 show an example of use of a clothes hanger unit mounted inside a first chamber.

Figure 51:
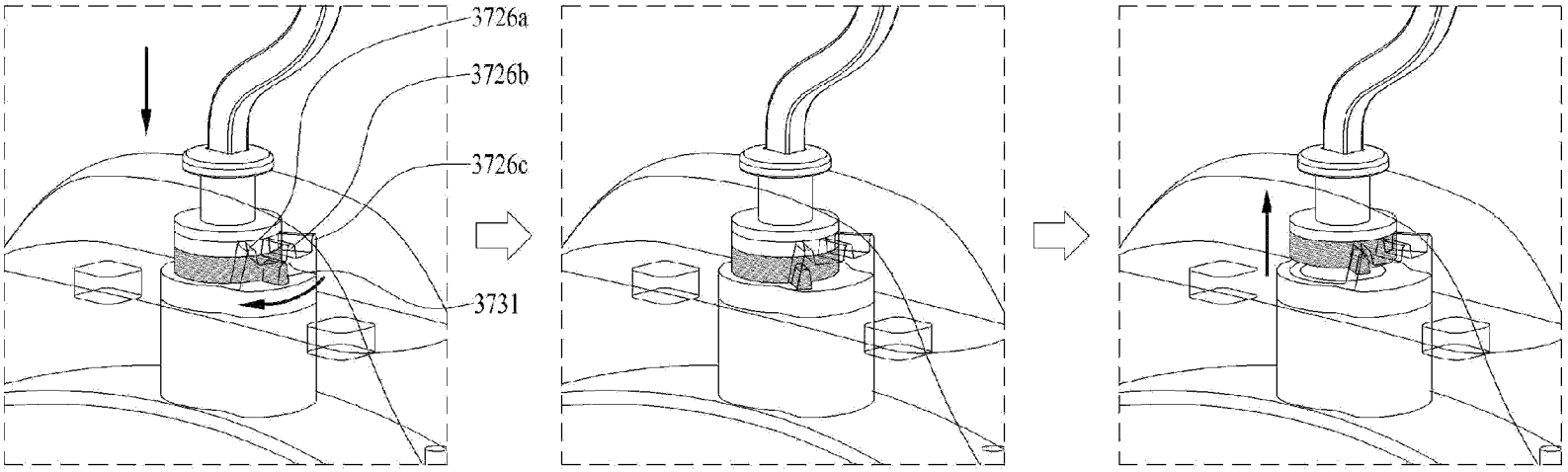

(a) to (c) in FIG. 51 show an example of a method for rotating and fixing a clothes hanger hook step-by-step.

Figure 52:
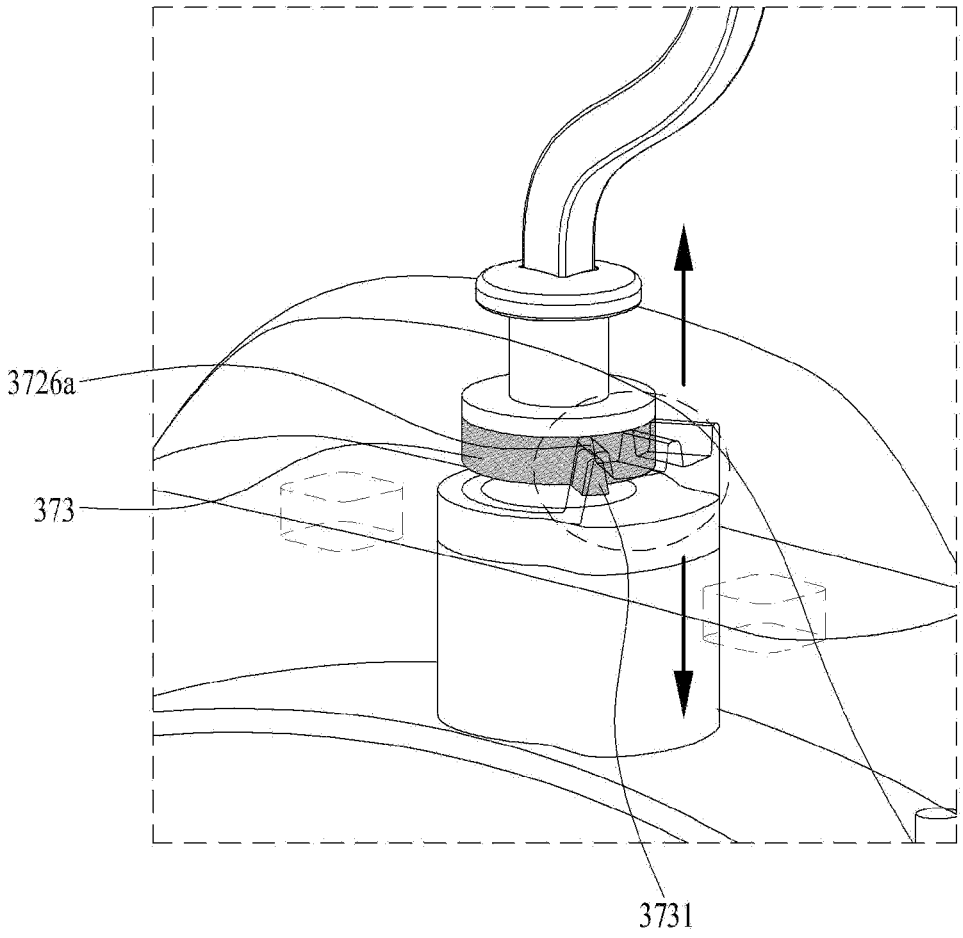

FIG. 52 shows an example in which a guide protrusion is inserted into a first guide groove.

Figure 53:
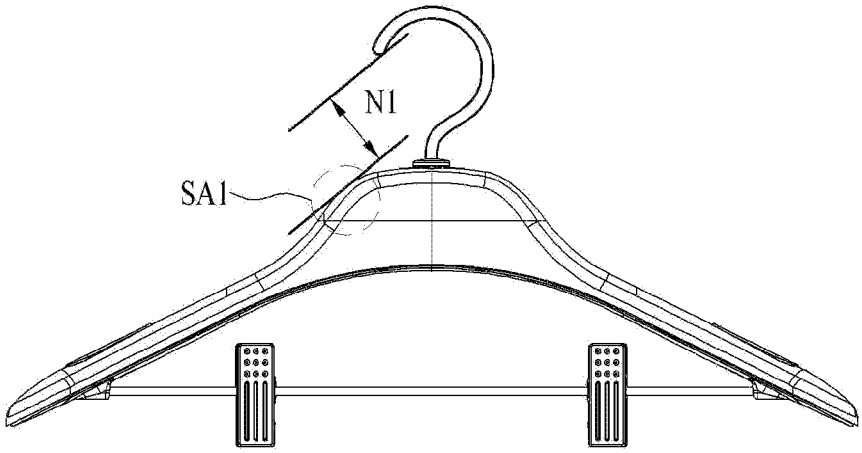
Figure 53:
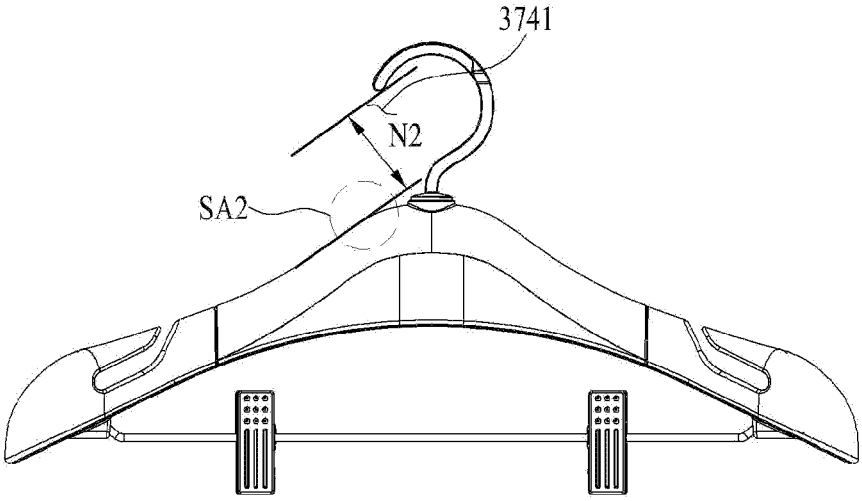

(a) in FIG. 53 shows an example of an opening defined in a hook of a conventional clothes hanger. (b) in FIG. 53 shows an example of a hook opening of a clothes hanger unit described in the present disclosure.

BEST MODE

Hereinafter, a preferred embodiment of the present disclosure will be described in detail with reference to the accompanying drawings. In one example, a configuration of a device or a method for controlling the same to be described below is only for describing an embodiment of the present disclosure, not for limiting the scope of the present disclosure, and reference numerals used the same throughout the specification refer to the same components.

Specific terms used in this specification are only for convenience of description and are not used as a limitation of the illustrated embodiment.

For example, expressions indicating that things are in the same state, such as "same", "equal", "homogeneous", and the like, not only indicate strictly the same state, but also indicate a state in which a tolerance or a difference in a degree to which the same function is obtained exists.

For example, expressions indicating a relative or absolute arrangement such as "in a certain direction", "along a certain direction", "parallel", "orthogonal", "central", "concentric", "coaxial", or the like not only strictly indicate such arrangement, but also indicate a state in which a relative displacement is achieved with a tolerance, or an angle or a distance that achieves the same function.

In order to describe the present disclosure, the description below will be achieved on the basis of a spatial orthogonal coordinate system with an X-axis, a Y-axis, and a Z-axis orthogonal to each other. Each axial direction (an X-axis direction, a Y-axis direction, or a Z-axis direction) means both directions in which each axis extends. Adding a '+' sign in front of each axial direction (a +X-axis direction, a +Y-axis direction, or a +Z-axis direction) means a positive direction, which is one of the two directions in which each axis extends. Adding a '−' sign in front of each axial direction (a −X-axis direction, a −Y-axis direction, or a −Z-axis direction) means a negative direction, which is the other of the two directions in which each axis extends.

Expressions referring to directions such as "front (+Y)/rear (−Y)/left (+X)/right (−X)/up (+Z)/down (−Z)" to be mentioned below are defined based on a XYZ coordinate axis. However, this is to describe the present disclosure such that the present disclosure may be clearly understood. In one example, each direction may be defined differently depending on the standard.

The use of terms such as 'first, second, third' in front of the components to be mentioned below is only to avoid confusion of the components referred to, and is independent of the order, importance, or master-slave relationship between the components. For example, an invention including only the second component without the first component may also be implemented.

The singular expression includes the plural expression unless the context clearly dictates otherwise.

In addition, herein, a first direction, a second direction, and a third direction refer to a height direction (the Z/−Z direction) of a cabinet 130, a depth direction (the Y/−Y direction) of the cabinet 130, and a width direction (the X/−X direction) of the cabinet 130, respectively, unless otherwise specified.

In addition, herein, an expression "at least one" means "one or more" or "at least one".

Figure 1:
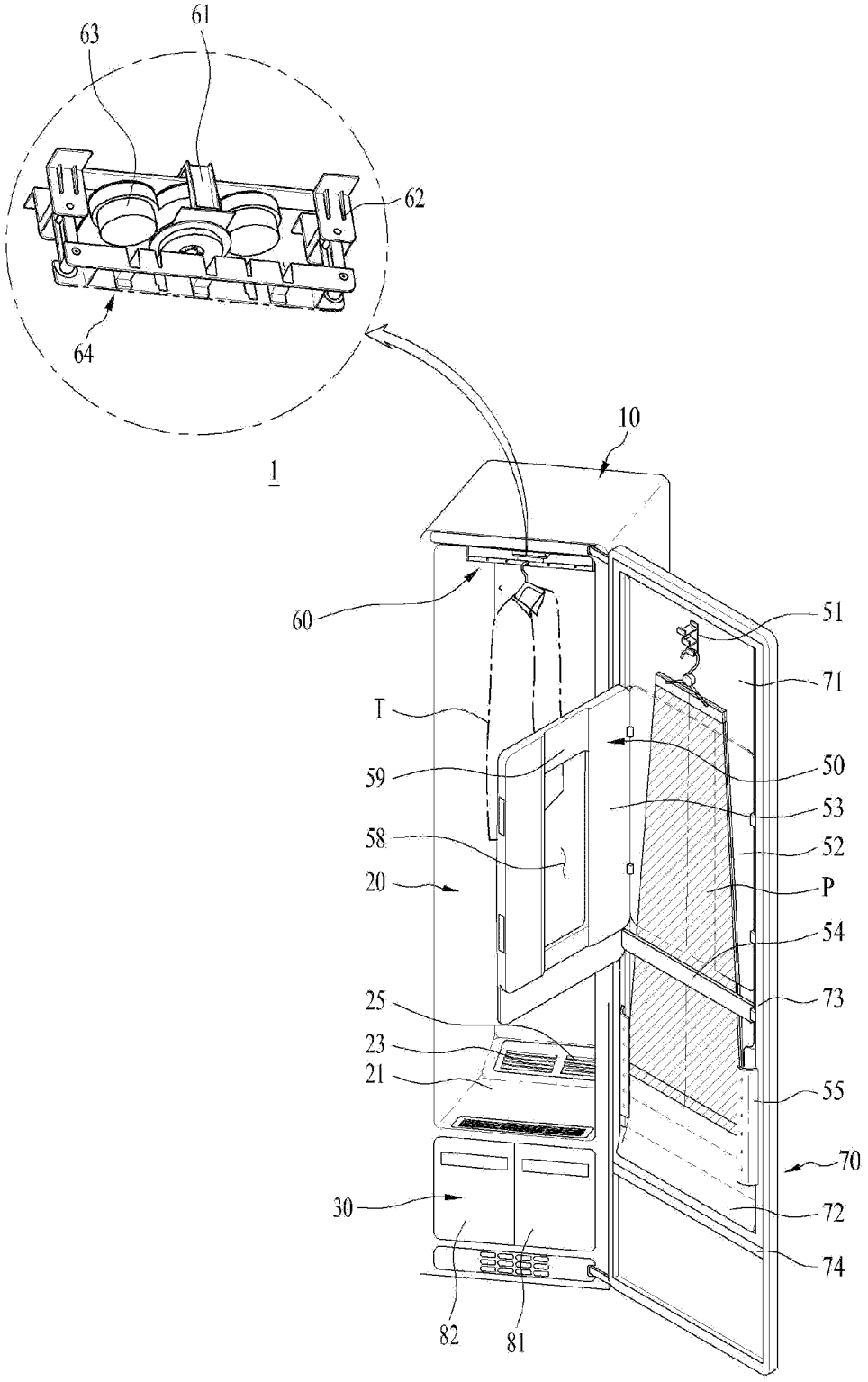
FIG. 1 is an example of a conventional laundry treating apparatus.

FIG. 1 shows an example of a conventional laundry treating apparatus 1. The laundry treating apparatus 1 includes a cabinet 10 including an inlet defined in one surface, a first chamber 20 positioned inside the cabinet 10 and accommodating laundry therein through the inlet, a second chamber 30 positioned beneath the first chamber 20 to define therein a space separated from the first chamber 20, a steam unit (not shown) disposed inside the second chamber 30 to generate steam and supply steam to the first chamber 20, and a door 70 that is pivotably coupled to the cabinet 10 to open and close the inlet. Considering a usage method of general users, preferably, the inlet is defined in a front surface of the cabinet 10.

In addition, the laundry treating apparatus 1 may further include a blower unit (not shown) located inside the second chamber 30 and sucking air of the first chamber 20, and a heat pump unit dehumidifying and heating the sucked air and then discharging the air to the first chamber 20.

The cabinet 10 may be made of a metal material, and may also be made of a plastic material as long as strength is able to be maintained. In addition, the first chamber 20 may be formed by plastic injection molding. The first chamber 20 may be coupled to the cabinet 10 by a frame (not shown). Alternatively, a space between the cabinet 10 and the first chamber 20 or between the cabinet 10 and the second chamber 30 may be filled with foamed plastic such as polyurethane.

The laundry including tops and bottoms may be hanged in the first chamber 20, and the laundry may be managed to be refreshed via the blower unit (not shown), the heat pump unit (not shown), and the steam unit (not shown) located inside the second chamber 30. That is, via the blower unit, the heat pump unit, and the steam unit located inside the second chamber 30, functions of sterilizing and deodorizing the laundry using steam and/or heated air and removing wrinkles formed by use may be performed.

The first chamber 20 may include a hanger assembly 60 for hanging the laundry at an upper portion of an interior of the first chamber 20. The hanger assembly 60 may accommodate therein a clothes hanger on which the laundry is hanged, and may be connected to a driver 63 capable of reciprocating the hanger assembly 60 in a left and right direction. The movement of the hanger assembly 60 may shake the laundry, and eventually may remove foreign substances including fine dust attached to the laundry. In addition, while shaking the laundry hanged on the hanger assembly 60, by exposing the laundry to steam or moisture supplied from the second chamber 30, some of the wrinkles of the laundry may be removed.

That is, the hanger assembly 60 may allow the laundry to be hanged in an unfolded state by its own weight inside the first chamber 20, so that the laundry may be evenly exposed to the dehumidified and heated air and/or the steam supplied from the second chamber 30.

In general, water boils at 100° C. under atmospheric pressure. Water vapor generated at this time may be referred to as steam. Moisture, on the other hand, refers to a form in which water droplets of 1 mm or smaller are suspended in air at room temperature, and is similar to fog, for example. In general, in a case of steam generated by boiling water, a sterilization power is superior to that of moisture because of a higher temperature than moisture. In addition, because water molecules move more actively at high temperature, steam has excellent permeability to the laundry. Therefore, steam may be used more than moisture to refresh the laundry.

The first chamber 20 has the driver 63 of the hanger assembly 60 located at the upper portion thereof, and is formed by a first chamber top surface (not shown) that forms a top surface of the first chamber, a first chamber bottom surface 21 that forms a bottom surface of the first chamber, left and right side surfaces 105 and 107 of the first chamber that connect the first chamber top surface and the first chamber bottom surface 21 to each other, and a first chamber rear surface (not shown) that forms a rear surface of the first chamber. When one surface in which the inlet to put the laundry into the apparatus is defined is the front surface, the rear surface of the first chamber will be located on an opposite side. FIG. 1 shows an example in which the inlet is defined in the front surface and the door is pivotably coupled to one side surface of the inlet.

An enlarged drawing in FIG. 1 shows the hanger assembly 60. The hanger assembly 60 may include a hanger bar 64 formed in a width direction of the door, hanger supports 62 for supporting the hanger bar at both ends, and a support frame 61 for fixing the hanger support 62 to a top surface of the cabinet or the top surface of the first chamber. In addition, the hanger assembly 60 may include the driver 63 that transmits power such that the hanger bar 64 may reciprocate in the width direction of the cabinet 10.

An air supply port 23 and a steam supply port 25 for supplying steam generated by the steam unit and air dehumidified and heated by the heat pump unit in the second chamber 30 to the first chamber, and an air suction port 22 for sucking air of the first chamber 20 by the blower unit may be located on the first chamber bottom surface 21.

As shown in FIG. 1, the air supply port 23 and the steam supply port 25 may be arranged in a region where the first chamber bottom surface 21 and the first chamber rear surface meet each other. In addition, the region where the first chamber bottom surface 21 and the first chamber rear surface meet each other may have a smoothly inclined shape. The air suction port 22 may be located on the first chamber bottom surface 21 close to the inlet. Accordingly, air inside the first chamber 20 will be discharged through the air supply port 23 and sucked through the air suction port 22 to circulate. After being discharged through the steam supply port 25, steam will also be condensed, then sucked through the air suction port 22, and then collected in a sump (not shown) for storing condensate.

In order to more smoothly discharge the condensate condensed inside the first chamber 20 into the second chamber 30 through the air suction port 22, the first chamber bottom surface 21 may be inclined downward from the first chamber rear surface in a direction of the inlet where the door is located.

As shown in FIG. 1, in the laundry treating apparatus 1, a water supply tank 81 for supplying water to the steam unit, and a drain tank 82 for discharging and storing the condensate collected in the sump (not shown) may be arranged in a front portion of the second chamber 30. In addition, a tank module frame (not shown) for defining a tank installation space (not shown) in which the water supply tank 81 and the drain tank 82 are installed may be disposed to separate the tank installation space (not shown) and the second chamber 30 from each other. That is, the tank installation space (not shown) and the second chamber 30 may be located beneath the first chamber 20, the tank installation space may be located close to the door 70, and the second chamber 30 may be located behind the tank installation space.

Each of the water supply tank 81 and the drain tank 82 may be detachable from the tank module frame (not shown). The tank module frame may divide an interior of the second chamber into a space in which mechanical apparatuses, such as the blower unit, the steam unit, and the heat pump unit, are arranged, and the tank installation space in which the water supply tank 81 and the drain tank 82 are arranged.

When the door 70 is closed, the door 70 may include a rear surface of the door 70 or a door inner surface 71 located to face the first chamber 20 of the door 70. The door 70 may be pivotably connected to the cabinet 10 in a hinged manner to open and close the inlet.

When the user closes the door 70, a front surface of the water supply tank 81 and a front surface of the drain tank 82 face the door inner surface 71, and when the user opens the door 70, the front surface of the water supply tank 81 and the front surface of the drain tank 82 may be exposed to the outside. In addition, the water supply tank 81 and the drain tank 82 respectively include a water supply tank window (not shown) and a drain tank window (not shown) on the front surfaces thereof, so that water levels of water stored in the water supply tank 81 and the drain tank 82 may be checked immediately.

The front surface of the water supply tank 81 and the front surface of the drain tank 82 may include a water supply tank handle (not shown) and a drain tank handle (not shown), respectively. When the user pulls the water supply tank handle and the drain tank handle, respectively, the water supply tank 81 and the drain tank 82 may be separated from the tank module frame (not shown) by pivoting about a front surface distal end of the water supply tank and a front surface distal end of the drain tank, respectively. In addition, the water supply tank 81 and the drain tank 82 will be seated on the tank module frame via the pivoting as well.

In a case of the conventional laundry treating apparatus 1, on the door inner surface 71 or the interior of the first chamber 20, the hanger bar 64 for hanging pants P upside down on the clothes hanger and then hanging the clothes hanger thereon, and a pressor 50 for pressing the pants P fixed by the hanger bar 64 and the clothes hanger may be located.

A reason for hanging the pants P upside down, that is, with a bottom hem up, is to evenly spread the pants P as a tensile force is applied to the pants P via a self-weight of the pants P because a waist portion of the pants P, that is, a pant waist of the pants P is heavier than the bottom hem of the pants P, that is, pant legs.

The pressor 50 may include a support plate 52 coupled to the door inner surface 71 to support the laundry, and a pivoting plate 53 for pressing the pants P by pivoting toward the support plate 52. When the pivoting plate 53 pivots toward and is coupled to the support plate 52, the pivoting plate 53 is able to press the pants P. Thereafter, the door 70 may be closed to expose the pants P to steam and dehumidified and heated air inside the first chamber 20, thereby removing wrinkles of the pants P. In this regard, the pressor 50 may include a pivoting plate through-hole 59 extending through the pivoting plate 53 in order to facilitate penetration of steam into the pants P, and may further include a depression 58 defined in a surface in contact with the pants P of both surfaces of the pivoting plate in order to prevent a seam disposed along a longitudinal direction of the pant legs of the pants P from being pressed. A portion of the support plate 52 corresponding to the portion where the seam is positioned may also be depressed to correspond to the depression 58.

Referring to FIG. 1, a groove for mounting the clothes hanger therein is defined in the hanger bar 64. The grooves of a certain number are defined in consideration of a spacing between the clothes, and positions of the grooves are fixed. Therefore, in order to adjust the spacing between the clothes, an adjacent groove should be skipped and the clothes should be mounted in a next groove. Therefore, in this case, the number of clothes that may be accommodated in an accommodation space is inevitably reduced.

In addition, because the hanger bar 64 is always located downwardly of the top surface of the first chamber because of the hanger support 62, the hanger bar 64 always has to occupy a certain space inside the first chamber 20. In addition, because power transmission between the driver 63 and the hanger bar 64 has a vertical structure, it takes up a lot of space between the cabinet 10 and the top surface of the first chamber 20.

In addition, because the hanger bar 64 is always located inside the first chamber 20, it is difficult to utilize the cabinet by dividing the accommodation space in a height direction of the cabinet.

FIG. 2 shows an example of a laundry treating apparatus including features of the present disclosure. Referring to (a) and (b) in FIG. 2, a laundry treating apparatus 1000 includes a cabinet 130 including an inlet 139 defined in one surface thereof, a top panel 132 for forming a top surface of the cabinet 130, a first chamber 110 positioned inside the cabinet 130 to accommodate therein the laundry through the inlet 139, a second chamber 120 positioned inside the cabinet 130 and positioned at a lower portion of the cabinet 130 to define therein a space separated from the first chamber 110, and a first chamber top surface 112 for forming a top surface of the first chamber 110.

In addition, the laundry treating apparatus 1000 may include a cutout 112*a* defined to extend through the first chamber top surface 112, a hanger assembly 600 including a hanger 610 which is inserted into the cutout 112*a*, and thus, is partially positioned inside the first chamber 110, and a hanger arranging portion 510 for individually moving the hanger 610 to inside or outside of the first chamber 110 through the cutout 112*a*.

The first chamber 110 (or a laundry treating chamber) may be a space that accommodates the laundry therein and cares the laundry. That is, it means a space in which treatment such as removing the foreign substances from the laundry, sterilizing the laundry, deodorizing the laundry, and supplying hot air to the laundry to dry the laundry is performed. Accordingly, the first chamber 110 may be referred to as the laundry treating chamber.

Herein, the first chamber 110 refers to the laundry treating chamber 110. In addition, terms including the first chamber as names, such as the first chamber top surface 112, a first chamber bottom surface 111, a first chamber rear surface 113, and both side surfaces of the first chamber, which mean a first chamber left surface 114 and a first chamber right surface 115, were used to mean the laundry treating chamber top surface 112, the laundry treating chamber bottom surface 111, the laundry treating chamber rear surface 113, the laundry treating chamber left surface 114, and the laundry treating chamber right surface 115, respectively.

Mechanical apparatuses for supplying hot air, steam, and aroma for caring for the laundry in the laundry treating chamber 110 (or the first chamber) may be located inside the second chamber 120 (or a machine room).

The hanger 610 may include a plurality of hangers. The plurality of hangers 610 may be arranged side by side in one of the first direction, the second direction, and the third direction. Preferably, considering accessibility from the inlet 139, the plurality of hangers 610 may be arranged along the third direction.

The cabinet 130 may include the top panel 132 for forming the top surface thereof, a base 131 (see FIG. 3 for forming a bottom surface thereof, a rear panel 133 (see FIG. 3 for connecting the top panel 132 and the base 131 to each other and forming a rear surface of the cabinet 130, and both side panels for forming both side surfaces of the cabinet 130, that is, a first side panel and a second side panel.

The inlet 139 may be defined in one surface of the cabinet 130. The user may accommodate the laundry inside the first chamber 110 through the inlet 139.

The laundry treating apparatus 1000 may further include a main door 200 that is pivotably disposed at one side of the cabinet 130 to open and close the inlet 139. The main door 200 may not only serve as a door for closing the inlet 139, but may also be in a form of a so-called door in door of separately including an auxiliary door 210 to have a pressor inside the main door 200 as shown in FIG. 41.

The main door 200 may include a main door inner surface 201 positioned at a side of the main door 200 facing the inlet 139. In addition, the main door inner surface 201 may include a door gasket 220 for sealing between the main door 200 and the cabinet 130 in tight contact with the cabinet 130 along an edge of the inlet 139. In this regard, the tight contact means a state of contact such that hot air or steam supplied to the first chamber or condensate generated from the first chamber is prevented from escaping to the outside.

The door gasket 220 may include a first chamber gasket 221 for sealing the first chamber 110 that is disposed on the main door inner surface 201 to correspond to the first chamber 110, and a second chamber gasket 222 disposed to correspond to the second chamber 120.

As shown in FIG. 39, the second chamber 120 may be located beneath an entirety of the bottom surface of the first chamber 110. In this case, based on a chamber front surface contact portion 118 (see FIG. 39 disposed between the first chamber 110 and the second chamber 120, the first chamber gasket 221 and the second chamber gasket 222 may be in contact with the chamber front surface contact portion 118 from the top and from the bottom, respectively. The chamber front surface contact portion 118 may refer to a portion surrounding a perimeter of a second chamber inlet 125. Accordingly, the first chamber 110 and the second chamber 120 may be separated from each other. Based on the chamber front surface contact portion 118, the first chamber gasket 221 and the second chamber gasket 222 will be responsible for sealing of a portion on the chamber front surface contact portion 118 and a portion beneath the chamber front surface contact portion 118, respectively.

Referring to (a) in FIG. 2, the second chamber 120 may occupy a portion of a lower portion of the first chamber 110. In this case, the chamber front surface contact portion may include a first front surface contact portion 1171 separating the first chamber 110 and the second chamber 120 from each other in the width direction (the third direction) of the cabinet 130, and a second front surface contact portion 1172 separating the first chamber 110 and the second chamber 120 from each other in the height direction (the second direction) of the cabinet 130.

That is, although each of a first surface 1111 and an extended surface 1114 may be an inner surface of the first chamber 110 and an inner surface of the second chamber 120, because a separation space is defined in general between the first chamber 110 and the second chamber 120 for insulation, the first front surface contact portion 1171 and the second front surface contact portion 1172 may form a front surface portion positioned between the first chamber 110 and the second chamber 120 when viewed from the front.

The first chamber gasket 221 may be in contact with a perimeter of the first chamber 110 including the first front surface contact portion 1171. That is, the first chamber gasket 221 may be in contact with a portion positioned between the cabinet 130 and the first chamber 110.

The second chamber gasket 222 may be in contact with the second chamber 120, including the first front surface contact portion 1171 and the second front surface contact portion 1172. The first front surface contact portion 1171 will come into contact with a portion of the second chamber gasket 222 in contact with the first chamber gasket 221 from below.

A space of the first chamber 110 positioned on a side of the second chamber 120 will be in contact with a separating gasket 223. The separating gasket 223 may seal the remaining space positioned on the side of the second chamber 120 including a portion of the second front surface contact portion 1172. When the separating gasket 223 comes into contact with the second front surface contact portion, the separating gasket 223 may come into contact with a side surface of a portion of the second front surface contact portion where the second chamber gasket 222 is in contact. Alternatively, because one side of the separating gasket 223 and one side of the second chamber gasket 222 meet each other, gaskets corresponding to the one sides meeting each other as such may not be formed as separate gaskets, but may be shared.

This is because, although there are largely two spaces to be sealed in a case of FIG. 39, there are three spaces to be sealed in the case of (a) in FIG. 2, so that the spaces are required to be sealed independently.

When the main door 200 may include a door liner assembly 230 that is disposed on the main door inner surface 201 and is to guide the condensate and discharge the condensate via air suction means 170 to be described later when the condensate condensed in the first chamber 110 flows down the main door inner surface 201.

The door liner assembly 230 may include a main liner 2301 positioned inwardly of the first chamber gasket 221 and an auxiliary liner 2302 positioned inwardly of the separating gasket 223.

In one example, as long as there is no separate space inwardly of the second chamber gasket 222 and the condensate does not enter from the outside of the second chamber gasket 222, the condensate is not generated, so that there is no need to have the door liner.

The main liner 2301 may be inclined toward the first chamber 110 from the inner surface of the door. This is to allow the condensate to flow down well. When the main door 200 closes the inlet 139, the main liner 2301 may enter the first chamber 110 by a predetermined distance. Referring to FIG. 8, when closing the main door 200, based on the main door inner surface 201, the main liner 2301 may protrude by a length greater than a maximum vertical distance D1 of a first bottom handle 1815 or a second bottom handle 1825 of the bottom cover assembly 180.

Preferably, the length at which the main liner 2301 is inserted into the first chamber 110 may be greater than D1, and may be smaller than D2, which is a minimum vertical distance at which a first bottom through-hole 1812 or a second bottom through-hole 1822 is located.

In one example, the main liner 2301 may be simply constructed such that the inner surface of the main door 200 is inclined, but may include a first communication hole 2303 for communicating with a pressor 400 at a location beneath the inclined surface of the main liner 2301 in order to have the pressor 400.

In addition, the main door inner surface 201 may include a door inclined portion 240 disposed on an upper portion of the main door inner surface 201 and inclined upwardly, and a door second communication hole 2401 defined at a top of the door inclined portion 240 so as to be in communication with the pressor 400.

The door inclined portion 240 may be inclined in a direction opposite to the main liner 2301. That is, when the main door 200 is closed, the main liner 2301 may be inclined toward the first chamber bottom surface 111, while the door inclined portion 240 may be inclined toward the first chamber top surface 112. The first communication hole 2303 may be defined as a portion between the inclined surface of the main liner 2301 and the main door inner surface 201 is opened. The second communication hole 2401 may be defined as a portion between the inclined surface of the door inclined portion 240 and the main door inner surface 201 is opened. This is to provide passages of steam and hot air for circulating steam and hot air through the laundry pressed by the pressor 400 when the pressor 400 is located inwardly of the main door 200.

The auxiliary liner 2302 may be disposed to discharge the condensate generated in a space defined between one side surface of the first chamber and one side surface of the second chamber via the air suction means 170 as shown in FIG. 2.

The main door 200 may be pivotably coupled to the cabinet 130 by a door hinge assembly 225. (b) in FIG. 2 shows an example in which a first door hinge 2251 and a second door hinge 2252 are arranged on upper and lower portions of one side surface of the cabinet, and the main door 200 is coupled by the first door hinge 2251 and the second door hinge 2252.

Referring to (a) in FIG. 2, unlike FIG. 39, the first chamber bottom surface 111 may be formed by a first surface 1111 and a second surface 1112 positioned lower than the first surface 1111.

That is, the first chamber bottom surface 111 may be stepped along the third direction, which is the width direction of the door. Because it may be advantageous to accommodate clothes that are longer than normal clothes, for example, a long coat and a dress in a space between the second surface 1112 and the first chamber top surface 112 than in a space between the first surface 1111 and the first chamber top surface 112, which is reduced in length due to a height of the second chamber 120, the laundry treating apparatus 1000 described in the present disclosure may include the stepped first chamber bottom surface 111.

In addition, the second chamber 120 may be located beneath the first surface 1111.

A length of the first surface 1111 along the third direction may be greater than a length of the second surface 1112.

The first surface 1111 may be connected to one of both of the side surfaces of the first chamber 110, the second surface 1112 may be connected to the other of both of the side surfaces of the first chamber 110, and the first surface 1111 and the second surface 1112 may be connected to each other by the extended surface 1114.

The extended surface 1114 may correspond to an outer side surface of the second chamber 120.

The condensate flowing down the main door inner surface 201 in the space between one side surface of the first chamber 110 and the extended surface 1114 and the space between the main liner 2301 and the second bottom cover 182 will be discharged via the second air suction hole 172 via the auxiliary liner 2302.

FIGS. 3 and 4 show a blower unit 700 and a steam unit 730 located inside the second chamber 120, respectively.

Referring to FIG. 3, the laundry treating apparatus 1000 may further include the blower unit 700 positioned inside the second chamber 120 to circulate air inside the first chamber 110, the air suction means 170 positioned on the first chamber bottom surface 111 so as to be in communication with the second chamber 120 and suck air inside the first chamber 110, and air supply means 150 positioned on the first chamber bottom surface 111, in communication with the second chamber 120, and supplying air sucked via the air suction means 170 into the first chamber 110 after passing through the blower unit 700.

The air suction means 170 may include a first air suction hole 171 and a second air suction hole 172 positioned in the first surface 1111 and the second surface 1112, respectively, and the air supply means 150 may include a first air supply hole 151 positioned in the first surface 1111, and a second air supply hole 152 positioned in the second surface 1112 or the extended surface 1114.

The blower unit 700 may include heat exchange means 740 that exchanges heat with air sucked thereinto. The blower unit 700 may include an inlet duct 711 for sucking air inside the first chamber 110 via the air suction means 170, a supply duct 713 for discharging air that is increased in temperature and is dried while passing through the heat exchange means 740 to the first chamber 110, and a connecting duct 712 that connects the inlet duct 711 and the supply duct 713 to each other and includes the heat exchange means 740 therein.

The heat exchange means 740 may include a first heat exchanger (or an evaporator) E that cools air sucked into the first chamber 110 to generate the condensate, and a second heat exchanger (or a condenser) C that heats air that has passed through the first heat exchanger E. For example, the heat exchange means 740 may be a heat pump. Accordingly, the laundry treating apparatus 1000 may include a compressor P for compressing a refrigerant circulating through the evaporator and the condenser, and an expander Ex for expanding the refrigerant that has passed through the condenser at locations outside the blower unit 700.

In addition, the blower unit 700 may further include a circulating fan 715 for circulating air. The circulating fan 715 may be disposed between the inlet duct 711 and the connecting duct 712, or may be located between the connecting duct 712 and the supply duct 713 as shown in FIG. 3.

The laundry treating apparatus 1000 may further include aromatizing means 750 for supplying aroma to air of the first chamber 110. The aromatizing means 750 may supply aroma into the first chamber 110 via a separate passage, but may also be connected to the supply duct 713 and supply aroma to air discharged via the supply duct 713. FIG. 3 shows that the aromatizing means 750 is positioned at the rear of the blower unit 700.

However, this is only an example, and the aromatizing means 750 may be mounted at any position capable of supplying aroma to the first chamber 110.

A water supply tank 810 and a drain tank 820 may be located in front of the inlet duct 711. Preferably, in the second chamber 120, by a tank module frame 129 (see FIG. 9) in which the water supply tank 810 and the drain tank 820 are installed, a space in which the blower unit 700, the steam unit 730, and the like are located and a space in which the water supply tank 810 and the drain tank 820 are located may be separated from each other.

The second chamber 120 may include a tank door 121 that is pivotably disposed in the second chamber 120 to open and close a second chamber inlet 125. The second chamber inlet 125 refers to a portion of a front surface of the second chamber 120 that is opened to access the tank module frame 129.

That is, the second chamber inlet 125 may be defined to face the inlet (or the cabinet inlet) 139 defined in the cabinet 130. In addition, the second chamber inlet 125 may be defined to face the main door inner surface 201 when the main door 200 is closed.

The water supply tank 810 and the drain tank 820 may be detachably coupled to a tank door inner surface 121*c* of the tank door 121 facing the interior of the second chamber 120. That is, when the tank door 121 is pivoted to open the second chamber inlet 125, the water supply tank 810 and the drain tank 820 coupled to the tank door inner surface 121*c* will also pivot and be exposed.

As described above, the second chamber gasket 222 may be disposed between the tank door 121 and the main door 200 to prevent the condensate from falling between the tank door 121 and the main door 200.

Referring to FIG. 4, the steam unit 730 for supplying steam to the laundry hanged in the first chamber 110 may be located inside the second chamber 120.

In addition, a controller 900 for controlling a movement of a hanger assembly 600, operations of the heat exchange means 740, the compressor P, and the circulating fan 715, and operations of various sensors may also be located inside the second chamber. However, this is only an example. The controller 900 may be located anywhere in the laundry treating apparatus 1000 as long as the controller 900 is able to control the movement of the hanger assembly 600, the operations of the heat exchange means 740, the compressor P, and the circulating fan 715, the operation of the steam unit 730, and the operations of the various sensors.

Although FIG. 4 shows that the controller 900 is located at a rear portion of the second chamber 120, the controller 900 may be positioned on the base 131 or between the first chamber top surface 112 and the top panel 132.

In addition, a portion of the rear panel 133 (see FIG. 3) corresponding to the second chamber may be formed as an auxiliary panel (not shown) separated from the rear panel 133, so that, when the auxiliary panel is opened, the controller 900 may be easily accessed as the controller 900 is exposed. This is for maintenance.

The steam unit 730 may include a steam generator 731 that generates steam, a steam heater 732 positioned inside the steam generator to heat water stored in the steam generator 731, a steam discharge nozzle 737 for discharging generated steam via the steam supply 160, and a steam supply passage 735 for connecting the steam discharge nozzle 737 and the steam generator 731 to each other to move steam.

Water for generating steam may be supplied via the water supply tank 810. When the water supply tank 810 is seated in the tank module frame by closing the tank door 121, a water supply check valve 814 located in a lower portion of the water supply tank 810 is opened, and water is able to be supplied to the steam generator 731 via the water supply check valve 814.

FIG. 5 shows an example of a dividing portion 119 capable of dividing the first chamber 110 into one or more accommodation spaces. The laundry treating apparatus 1000 may include the cabinet 130 with the inlet 139 defined in one surface thereof, the main door 200 pivotably disposed on the cabinet 130 to open and close the inlet 139, the first chamber 110 positioned inside the cabinet 130 and accommodating therein the laundry via the inlet 139, the first chamber top surface 112 for forming the top surface of the first chamber 110, and the second chamber 120 positioned inside the cabinet 130 and at the lower portion of the cabinet 130 to define a space separated from the first chamber 110.

In addition, the laundry treating apparatus 1000 may include the dividing portion 119 positioned between the first chamber top surface 112 and the second chamber 120 and directed in parallel with the first and second directions to divide the first chamber 110 into the one or more accommodation spaces, and a moving driver 530 for adjusting sizes of the one or more accommodation spaces by moving the dividing portion 119 along the third direction.

The dividing portion 119 may be located inside the first chamber 110. In other words, the dividing portion 119 may be positioned between the first chamber top surface 112 and the first chamber bottom surface 111.

When the bottom surface of the first chamber 111 includes the stepped first surface 1111 and second surface 1112, and when a vertical level of the first surface 1111 is higher than a vertical level of the second surface 1112, the dividing portion 119 may be positioned between the first surface 1111 and the first chamber top surface 112.

In addition, the dividing portion 119 may be disposed to face both of the side surfaces of the first chamber, and be located inside the first chamber 110.

Referring to FIG. 5, the dividing portion 119 may include a dividing wall 1191 in a form of a flat plate directed in parallel with the first direction and the second direction in order to divide the first chamber 110 into the one or more accommodation spaces.

The dividing wall 1191 may be made of any material as long as the dividing wall 1911 is able to move without bending while dividing the interior of the first chamber 110.

In addition, one side surface of the dividing wall 1191 may include a dividing wall shelf mounting portion 1195 for mounting a shelf.

As described above, in the conventional laundry treating apparatus, the bar-shaped hanger bar is disposed so as to reciprocate along the third direction always at the fixed position. This is to shake off fine dust or dust via the reciprocating motion.

However, when the hanger bar is located inside the first chamber 110 at the fixed position, a temporary wall for partitioning the accommodation space defined by the first chamber 110 is not able to be disposed. This is because an interference between the fixed hanger bar and the moving temporary wall occurs. In one example, a temporary wall having a height not enough to reach the hanger bar may be designed, but such temporary wall only simply divides the accommodation space, and steam and hot air are able to move through a space above the hanger bar, so that meaning of the division is lost.

Accordingly, FIG. 5 shows an example in which a plurality of hangers 610 may be independently driven in order to prevent an interference between the dividing portion 119 and the hanger assembly 600.

(a) to (c) in FIG. 6 schematically shows an example in which the dividing portion 119 moves inside the first chamber 110.

(a) to (c) in FIG. 6 illustrate the movement of the dividing portion 119 using the example in which the first chamber bottom surface 111 is composed of the first surface 1111 and the second surface 1112 having the different vertical levels. However, the description may also be applied even when a vertical level of the first chamber bottom surface 111 is uniform as in FIG. 39.

(a) in FIG. 6 shows an example in which the dividing portion 119 divides the first chamber 110 into a first accommodation space V1 and a second accommodation space V2. The hanger assembly 600 including the plurality of hangers 610 may be located at the upper portion of the first chamber. FIG. 6 shows five hangers 611, 612, 613, 614, and 615, but this is only an example. Even with a different number of hangers, the movement of the dividing portion and a position shift of the hanger resulted therefrom, which are features described in the present disclosure, may be applied.

(a) in FIG. 6 shows an example in which the first accommodation space V1 includes three hangers 613, 614, and 615 and the second accommodation space includes one hanger 611. Because the dividing portion 119 is located where one hanger 612 is located, in order to avoid the interference with the dividing portion 119, the one hanger 612 moves to a space between the first chamber top surface 112 and the top panel 132 and is not located inside the first chamber 110. That is, the hanger 612 may become invisible to the user by moving to the outside of the first chamber 110.

As described above, at least one of the plurality of hangers 610 is able to move into or to the outside of the first chamber 110 for a hanger arranging portion 510 to be described later.

In other words, at least one of the plurality of hangers 610 is able to move to the space above or below the first chamber top surface 112 by the hanger arranging portion 510.

To this end, the cutout 112*a* defined through the first chamber top surface 112 may include a plurality of cutout holes 1121 respectively corresponding to the plurality of hangers 610, and the hanger arranging portion 510 may individually move the plurality of hangers 610 into or to the outside of the first chamber 110 through the plurality of cutout holes 1121.

(a) in FIG. 6 shows an example in which the dividing portion 119 is located at a distance L1 from one of both of the side surfaces of the first chamber. A place spaced apart from one of both of the side surfaces of the first chamber by the distance L1 may be a place P1 where one hanger is located. Referring to (b) in FIG. 6, a state in which the dividing portion is moved from P1 to P2 where another hanger is located is shown. To this end, the dividing portion will move a distance of L2-L1.

In this case, a size of the first accommodation space V1 will decrease, and a size of the second accommodation space V2 will increase. That is, the sizes of the accommodation spaces divided via the movement of the dividing portion 119 may be variable.

(c) in FIG. 6 shows a state in which the dividing portion 119 has moved until it comes into contact with the other of both of the side surfaces of the first chamber 110. That is, the dividing portion 119 will be moved from the place P2 where said another hanger is located to a position P3 in contact with the other side surface, and a moved distance will be L3-L2. In this case, because the dividing portion 119 comes into contact with the other side surface, the first accommodation space V1 will disappear, and only the second accommodation space V2 will remain as a single space. That is, the size of the second accommodation space will soon become a maximum size that the first chamber may form.

Accordingly, the dividing portion 119 may divide the first chamber 110 into the one or more accommodation spaces.

In this regard, only laundry accommodated in the first accommodation space may be supplied with hot air and/or steam. In contrast, hot air and/or steam may be supplied only to laundry accommodated in the second accommodation space V2. Therefore, the user may efficiently use the space for accommodating the laundry without wasting energy.

(a) to (c) in FIG. 6 show an example in which a position of one of both ends of the first surface 1111 is disposed to correspond to the position where said one hanger 612 is located. That is, the dividing portion 119 may be constructed to move only on the first surface 1111. This is because a length of the second accommodation space V2 in the first direction is greater than a length of the first accommodation space V1 in the first direction when the dividing portion is at the position of P1 as shown in (a) in FIG. 6. That is, this is because it is enough that the dividing portion 119 moves only on the first surface 1111 in order to have various types of accommodation spaces.

For example, this is because, when the vertical level of the first chamber bottom surface 111 is uniform, there is no hanger in the second accommodation space with respect to the front when the dividing portion is located on the hanger 611 closest to a left side surface of the first chamber 110.

In addition, the two hangers adjacent to a right side surface of the first chamber 110 do not need to move independently of each other. This is because, when only one hanger is needed, the dividing portion may be located as shown in (a) in FIG. 6. Therefore, because there is already the case in which the space is divided such that the space near one side surface of the first chamber 110 has only one hanger, there is no need to divide the space such that a divided space near the other side surface of the first chamber 110 has only one hanger. Accordingly, on the other side surface of the first chamber 110, the hanger arranging portion 510 may be controlled such that the two hangers adjacent to the other side surface are simultaneously moved.

(a) to (c) in FIG. 6 show an example in which the dividing portion 119 is positioned where P1 or P2 the hanger is positioned, that is, where the cutout hole 1121 is positioned, or positioned P3 to be in contact with one side surface of the first chamber.

(a) to (c) in FIG. 6 show the example in which the dividing portion 119 moves to the position where the hanger or the cutout hole is located or completely moves to one side surface of the first chamber 110 as an example of the position to which the dividing portion 119 moves.

Alternatively, the position to which the dividing portion 119 moves may be anywhere inside the first chamber 110. The dividing portion 119 may be moved to the place where the hanger 610 is positioned or the place where the cutout hole 1121 is positioned. In addition, the dividing portion 119 may be located between one hanger 610 and another hanger 610. This is because, as a gap between hanger 610 and hanger 610 is a design problem, there is no concern that the laundry hanging on the hanger and the dividing portion come into contact with each other when a gap between the dividing portion 119 and the hanger 610 is large even when the dividing portion 119 is located between the hanger 610 and the hanger 610.

In addition, the dividing portion 119 may be located between one hanger 610 and one of both of the side surfaces of the first chamber close to the one hanger 610.

That is, the laundry treating apparatus 1000 may include the cabinet 130 having the inlet 139 defined in one surface thereof, the main door 200 pivotably disposed on the cabinet 130 to open and close the inlet 139, the first chamber 110 positioned inside the cabinet 130 and accommodating therein the laundry via the inlet 139, the first chamber top surface 112 for forming the top surface of the first chamber 110, the second chamber 120 positioned inside the cabinet 130 and at the lower portion of the cabinet 130 to define the space separated from the first chamber 110, the plurality of hangers 610 for hanging the laundry inside the first chamber 110, the dividing portion 119 located inside the first chamber 110 and directed in parallel with the first direction that is the height direction of the cabinet 130 and the second direction that is the depth direction of the cabinet 130 to divide the first chamber 110 into the one or more accommodation spaces, and the driver that moves the dividing portion 119 along the third direction that is the width direction of the cabinet 130, or moves the plurality of hangers 610 into the first chamber 110 or to the outside of the first chamber 110 based on the movement of the dividing portion 119, and the dividing portion 119 may be positioned between one of the plurality of hangers 610 and another of the plurality of hangers 610.

Referring to (a) in FIG. 6, after one hanger 612 moves to a space between the first chamber top surface 112 and the top panel 132, the dividing portion 119 will be positioned at P1. In this case, long clothes may be accommodated and treated in the second accommodation space V2. In addition, steam and hot air may be supplied only to the second accommodation space V2 to treat the accommodated clothes.

Referring to (b) in FIG. 6, for example, when clothes to be treated are a piece of long clothes and a piece of short clothes, or two pieces of short clothes, the user may use the laundry treating apparatus 1000 after moving the dividing portion 119 to the position of P2. When there are many clothes to be treated, because it may be necessary to use an entirety of the first chamber 110, as in (c) in FIG. 6, the entirety of the first chamber 110 may be used after completely moving the dividing portion 119 to one side surface of the first chamber 110.

Referring to (a) to (c) in FIG. 6, the example in which, when there is the dividing portion, the plurality of hangers 610 are placed inside or outside of the first chamber 110 has been described.

Even in the absence of the dividing portion 119, when the plurality of hangers 610 may be individually moved into or to the outside of the first chamber 110, the space of the first chamber may be utilized to the maximum. Unlike the hanger bar of the conventional laundry treating apparatus which is always located inside the first chamber, when necessary, it is also necessary to leave only some of the plurality of hangers arranged inside the first chamber 110 and to place all the rest outside the first chamber 110.

For example, a case in which a very large doll or a blanket is treated may be assumed. In other words, an object-to-be-dried such as the bulky doll, the blanket, and a duvet will also be able to be treated.

Accordingly, the laundry treating apparatus 1000 described in the present disclosure may individually position the plurality of hangers 610 between the first chamber top surface 112 and the top panel 132. In addition, the laundry treating apparatus 1000 may include the dividing portion 119 including the movable dividing wall 1191 for variably adjusting the sizes of the accommodation spaces inside the first chamber 110. In addition, the hanger assembly 600 including the plurality of hangers 610 may be capable of reciprocating to shake off the fine dust.

(a) in FIG. 7 shows a case in which the bottom cover assembly 180 is disposed on the first chamber bottom surface 111, and (b) in FIG. 7 shows a case in which the bottom cover assembly 180 is removed.

The first chamber bottom surface 111 may include the first surface 1111 and the second surface 1112 having the different vertical levels. The second chamber 120 may be positioned at the lower portion of the first surface 1111.

A width of the first surface 1111 may be greater than a width of the second surface 1112.

(a) and (b) in FIG. 7 show a state in which the tank door 121 is coupled to the second chamber inlet 125. The tank door 121 may include a first window 121*a* and a second window 121*b* formed to extend in the first direction through the tank door. The first window 121*a* and the second window 121*b* are arranged to check water levels of the water supply tank 810 and the drain tank 820 coupled to the tank door inner surface 121*c*, respectively. That is, the user may immediately check the water levels of the water supply tank 810 and the drain tank 820 without having to open the main door 200 and open the tank door 121 again.

When the first window 121*a* is located closer to one side than the other side of the tank door 121, the second window 121*b* may be located closer to the other side than one side of the tank door 121. When the water level of the water supply tank 810 is able to be checked via the first window 121*a*, the water level of the drain tank 820 is able to be checked via the second window 121*b*.

Referring to (a) in FIG. 7, the laundry treating apparatus 1000 shows a state in which a first bottom cover 181 and a second bottom cover 182 for respectively protecting the first surface 1111 and the second surface 1112 are mounted. That is, the first bottom cover 181 may be positioned on the first surface 1111, and the second bottom cover 182 may be positioned on the second surface 1112. This is to reduce friction with the first chamber bottom surface 111 when the dividing portion 119 moves along the third direction, and to prevent damage to the first chamber bottom surface 111.

Accordingly, specifically, the dividing portion 119 may be positioned between the first bottom cover 181 and the first chamber top surface 112.

Referring to (b) in FIG. 7, a state in which the first surface 1111 and the second surface 1112 are exposed by removing the first bottom cover 181 and the second bottom cover 182 is shown.

The first surface 1111 may include the first air suction hole 171 for sucking air inside the first chamber 110, and the first air supply hole 151 for supplying air into the first chamber 110. (b) in FIG. 7 shows a state in which the first air suction hole 171 is closed by the cover, but the controller 900 may control the cover to open the first air suction hole 171 when necessary. The first air suction hole 171 may be located closer to the inlet 139 than the first air supply hole 151. This is because a circulating passage is considered. That is, air discharged to the first chamber 110 via the first air supply hole 151 will rise along the first direction, then change a direction thereof on the top surface of the first chamber, and then move forward. In this regard, a passage in which a portion of air enters the main door 200 and another portion of air descends again along the first direction will be formed.

Accordingly, the first air supply hole 151 may be located at the rear of the first air suction hole 171.

The second surface 1112 may include a second air suction hole 172 for sucking air inside the first chamber 110. The second air supply hole 152 may also be located in the second surface 1112. That is, the second air supply hole 152 may be located at the rear of the second air suction hole 172. However, alternatively, the second air supply hole may be located in the extended surface 1114 to simplify the passage.

In addition, referring to (a) and (b) in FIG. 7, the first surface 1111 and the second surface 1112 may be depressed toward the base 131. This is for the bottom surface to form a smooth plane when the first bottom cover 181 and the second bottom cover 182 are coupled to the first surface 1111 and the second surface 1112, respectively.

FIG. 8 is a top view of the first bottom cover 181 and the second bottom cover 182. The first surface 1111 may further include a first steam supply port 161 positioned at a rear portion of the first surface. The first steam supply port 161 may be exposed even when the first bottom cover 181 is installed. This is to prevent the first steam supply port 161 from being heated by steam discharged from the first steam supply port 161 when the first bottom cover 181 is made of a metal material to minimize the damage caused by the dividing portion.

Accordingly, the first steam supply port 161 may be located in a portion that is not depressed along an edge of the first surface 1111.

In addition, the first steam supply port 161 may be formed in a form of a nozzle to increase a discharge speed of steam. That is, to increase the discharge speed of steam by reducing a size of a cross-section of the first steam supply port 161.

The first air supply hole 151 may be located in the first surface 1111 between the first air suction hole 171 and the first steam supply port 161 along the second direction.

In addition, the first air suction hole 171 may be located closer to the inlet 139 than the first steam supply port 161.

This will also be applied to the second air suction hole 172 and the second steam supply port 162 defined in and located on the second surface. Considering the widths of the first surface 1111 and the second surface 1112, a width of the first air suction hole 171 may be greater than a width of the second air suction hole 172. In addition, a width of the first steam supply port 161 may be greater than a width of the second steam supply port 162.

The first bottom cover 181 may further include a first bottom handle 1815 positioned between the inlet 139 and the first air suction hole 171 and defined as a portion of the first bottom cover 181 is depressed.

Similarly, the second bottom cover 182 may further include a second bottom handle 1825 positioned between the inlet 139 and the second air suction hole 172 and defined as a portion of the second bottom cover 182 is depressed. This is to use the first bottom handle 1815 or the second bottom handle 1825 when removing the first bottom cover 181 or the second bottom cover 182 from the first surface 1111 or the second surface 1112.

In one example, the first bottom cover 181 may include a plurality of first bottom through-holes 1812 defined through the first bottom cover 181, and the second bottom cover 182 may include a plurality of second bottom through-holes 1822 defined through the second bottom cover 182.

This is to guide the condensate generated inside the first chamber 110 and discharge the condensate through the first air supply hole 151, or to smoothly suck and discharge air inside the first chamber.

FIG. 8 shows that the plurality of first bottom through-holes 1812 and the plurality of second bottom through-holes 1822 are formed in a shape of rectangles arranged along the second direction with rounded corners rather than circles as an example.

In addition, the first bottom cover 181 and the second bottom cover 182 may further include a plurality of first bottom grooves 1813 and a plurality of second bottom grooves 1823 defined in a depressed shape without extending through the first bottom cover 181 and the second bottom cover 182, respectively. The number and arrangement of first bottom through-holes 1812 and the number and arrangement of first bottom grooves 1813 may be arbitrarily determined, and only the first bottom through-holes 1812 may be defined without the first bottom grooves 1813. This is also the case of the second bottom through-holes 1822 and the second bottom grooves 1823 located in the second bottom cover 182.

The laundry treating apparatus 1000 may further include aromatizing means 750 positioned at the rear portion of the first surface 1111 to supply aroma to air discharged into the first chamber 110.

The aromatizing means 750 may be positioned adjacent to each of both sides of the first steam supply port 161, but this is only an example. The aromatizing means 750 may be positioned elsewhere.

That is, the aromatizing means 750 may include a first aromatizing kit 751 located on one side of the first steam supply port 161 along the third direction and supplying aroma to air discharged through the first air supply hole 151, and a second aromatizing kit 752 located on the other side of the first steam supply port 161 and supplying aroma to air discharged through the second air supply hole 152.

The first aromatizing kit 751 and the second aromatizing kit 752 may be inserted into and coupled to aromatizing kit installation portions (not shown) located on both sides of the first steam supply port 161, respectively.

A front gasket 1192*a* for sealing between the first accommodation space V1 and the second accommodation space V2 may be included at a location in front of the dividing portion 119.

(a) in FIG. 9 shows a state in which the water supply tank 810 or the drain tank 820 is mounted in the tank module frame 129. The tank module frame 129 provides a space in which the water supply tank 810 and the drain tank 820 coupled to the tank door 121 are installed inside the second chamber 120. In addition, the steam unit 730 and the blower unit 700 located in the second chamber 120 may be connected to the water supply tank 810 and the drain tank 820, respectively.

The water supply tank 810 will be connected to the steam unit 730 and supply water necessary for the steam generation to the steam unit 730. The drain tank 820 will provide a space for storing the condensate condensed and discharged from the heat exchange means 740 or the first chamber 110.

Although the water supply tank 810 and the drain tank 820 are different from each other in terms of whether a water supply check valve is included and functions, the tanks 810 and 820 are very similar to each other in shape, so that the description of the water supply tank 810 may be applied to the drain tank 820 as well.

The tank door 121 is a door pivotably coupled to the second chamber 120 to open and close the second chamber inlet 125. That is, the second chamber 120 and the tank door 121 may be coupled to each other in a hinge manner via a hinge shaft disposed at a lower portion of the second chamber 120 along the width direction of the second chamber 120. That is, the water supply tank 810 and the drain tank 820 may be detachably coupled to the tank door inner surface 121*c*, and may be seated in the tank module frame 129 when the tank door 121 is closed.

Because shapes of the water supply tank 810 and the drain tank 820 of the laundry treating apparatus 1000 are not exposed to the outside because of the tank door 121, a simple finishing treatment in design may be achieved. While achieving the simple finishing treatment, the user may know the water level as soon as the main door 200 is opened via the first window 121*a* and the second window 121*b*. In addition, when the tank door 121 is pivoted and opened, water may be supplied via the water supply tank lid 812 in a tilted state of the water supply tank 810 without completely separating the water supply tank 810 from the tank door 121.

In addition, the water supply tank 810 and the drain tank 820 may be coupled to the tank door inner surface 121*c* of the tank door 121 located at a side facing the second chamber inlet 125. Referring to (b) in FIG. 9, when the tank door 121 is opened, upper portions of the water supply tank 810 and the drain tank 820 may be exposed to the user. Specifically, when the tank door 121 is opened, the water supply tank 810 also pivots and tilts, so that the water supply tank lid 812 will be exposed. Accordingly, the user may supply water to the water supply tank 810 via the water supply tank lid 812 without removing the water supply tank 810 from the tank door 121.

A filter 1712 may be positioned inside the inlet duct 711 connected to the first air suction hole 171. The filter 1712 may filter foreign substances including the fine dust from air entering via the inlet duct 711.

The water supply tank 810 may include the water supply tank body 811 that has an open top surface and defines a space for storing water, and the water supply tank lid 812 that is coupled to the top surface to form a lid of the water supply tank body. The water supply tank body 811 may include a water supply main body 8111 that forms an outer appearance of a space in which water is stored except for a bottom surface, and a water supply bottom surface 8112 that is coupled to the water supply main body 8111 to form the bottom surface of the water supply tank 810.

The water supply main body 8111 may be made of a transparent material to check whether water is stored, and the water supply bottom surface 8112 may be made of a translucent or opaque material such that the complex structure is not seen by the water supply check valve 814 and the tank module frame 129.

The water supply bottom surface 8112 may include a side surface 8112*c* that is bent downwardly and extends from a perimeter of the bottom surface of the water supply tank 810 such that not only the bottom surface of the water supply tank 810 may be formed, but also the water supply tank 810 may erect on an external floor surface.

The water supply tank 810 or the drain tank 820 may erect on the external floor surface without falling by being supported by the side surface 8112*c*. Even when the water supply tank 810 erects by the side surface 8112*c*, the water supply check valve 814 will not be exposed to the outside.

The water supply bottom surface 8112 may include a water supply bottom communication hole 8112*a* connected to the water supply check valve 814 for water supply. When the water supply tank 810 is seated in the tank module frame 129, the water supply check valve 814 connected to the water supply bottom communication hole 8112*a* may be connected to a water supply passage (not shown) that connects the water supply tank 810 and the steam generator 731 to each other.

The water supply check valve 814 capable of supplying water or stopping the supply of water from the water supply tank 810 to the steam unit 730 will be located below the water supply bottom surface 8112. When the water supply check valve 814 is coupled to the tank door inner surface 121*c*, water may be supplied when the water supply check valve 814 is coupled to the passage connecting portion 1293 and then the passage connecting portion 1293 is coupled to the tank module frame 129. Alternatively, the passage connecting portion 1293 may be located in the tank module frame 129, and when the tank door inner surface 121*c* pivots to close the second chamber inlet, the water supply check valve 814 may be coupled to the passage connecting portion 1293 to supply water.

Referring to (a) in FIG. 9, the water supply tank 810 may include backlight means 830 that is positioned on each of rear surfaces of the water supply tank 810 and the drain tank 820, and irradiates light to each of the water supply tank 810 and the drain tank 820. The backlight means 830 may be formed on each of the rear surfaces of the water supply tank 810 and the drain tank 820, or may be disposed on the tank module frame 129.

The backlight means 830 will make it easier for the user to check the water level via the first window 121*a* and the second window 121*b*.

The backlight means 830 may be composed of at least one LED (light emitting diode).

(a) and (b) in FIG. 10 show states in which the water supply tank body 811 and the water supply tank lid 812 are coupled to each other and are separated from each other, respectively.

The water supply tank 810 may include the water supply tank body 811 that has the open top surface and defines the space for storing water, the water supply tank lid 812 coupled to the top surface of the water supply tank body 811 to protect an upper portion of the water supply tank body 811, and a water supply opening 8122 defined through the water supply tank lid 812 to supply water from the outside to the water supply tank body 811 via the water supply tank lid 812.

The water supply bottom surface 8112, which is the bottom surface of the water supply tank 810, may include the water supply bottom communication hole 8112*a* for supplying water by being connected to a water supply check valve 814. When the water supply tank 810 is seated in the tank module frame 129, the water supply check valve 814 connected to the water supply bottom communication hole 8112*a* will be connected to a water supply passage (not shown) that connects the water supply tank 810 and the steam generator 731 to each other.

Referring to (a) and (b) in FIG. 9, the water supply check valve 814 capable of supplying water or stopping the supply of water from the water supply tank 810 to the steam unit 730 will be located below the water supply bottom surface 8112. When the water supply check valve 814 is coupled to the tank door inner surface 121*c*, water may be supplied when the water supply check valve 814 is coupled to the passage connecting portion 1293 and then the passage connecting portion 1293 is coupled to the tank module frame 129. Alternatively, the passage connecting portion 1293 may be located in the tank module frame 129, and when the tank door inner surface 121*c* pivots to close the second chamber inlet, the water supply check valve 814 may be coupled to the passage connecting portion 1293 to supply water.

Referring to (a) in FIG. 10, the water supply tank lid 812 may include a water supply tank lid top surface 812*a* that forms a top surface of the water supply tank lid 812, and a water supply tank lid rear surface 812*b* that forms a rear surface of the tank lid 812 by being bent from the water supply tank lid top surface 812*a*.

A portion of the water supply tank lid top surface 812*a* may be inclined downwards rearwardly. When the water supply tank 810 pivots via the tank door 121, the water supply tank lid 812 is exposed to the user, and the inclined portion of the water supply tank lid top surface 812*a* is able to form a surface that is relatively horizontal to the user via the pivoting, so that it may be easier for the user to supply water via the water supply tank lid 812. Such shape is also the same for the drain tank 820.

The front surface of the water supply tank lid 812 may include a lid detachment device 8121 used to remove the water supply tank lid 812 from the water supply tank body 811.

After completely removing the water supply tank lid 812 or the drain tank lid (not shown) from the water supply tank 810 or the drain tank 820 via the lid detachment device 8121, the water supply tank lid 812 or the drain tank lid (not shown) may be washed.

The lid detachment device 8121 may not protrude from or be depressed into a front surface of the water supply tank lid 812 for aesthetics, and may be flush with the front surface of the water supply tank lid 812 to form a smooth surface.

When the user presses the lid detachment device 8121, the water supply tank 810 will be separated into the water supply tank body 811 and the water supply tank lid 812 as shown in (b) in FIG. 10. (b) in FIG. 10 shows that a first body hook coupling portion 8111*a* and a second body hook coupling portion 8111*b* for coupling the water supply tank lid 812 and the water supply tank body 811 to each other are located at an upper portion of the water supply tank body 811 and respectively located on a front surface and a rear surface of the water supply tank body 811.

This is only an example, and the water supply tank body 811 and the water supply tank lid 812 may be coupled to each other by another method. In addition, the first body hook coupling portion 8111*a* and the second body hook coupling portion 8111*b* may be disposed at different positions.

That is, one end of the lid detachment device 8121 may have a hook shape, so that the lid detachment device 8121 may be coupled to the first body hook coupling portion 8111*a*. In addition, one end of the water supply tank lid rear surface 812*b* may also have the hook shape, so that the water supply tank lid rear surface 812*b* may be coupled to the second body hook coupling portion 8111*b*.

(a) in FIG. 11 is a cross-sectional view showing a state in which the water supply tank lid 812 is coupled to the water supply tank body 811.

The water supply tank lid 812 will serve as a lid for preventing the foreign substances from entering the water supply tank body 811. In addition, water may be supplied to the water supply tank body 811 via the water supply tank lid 812.

To this end, the water supply tank lid 812 may include the water supply opening 8122 positioned in the water supply tank lid top surface 812*a*. The water supply opening 8122 may be defined in a portion of the downwardly inclined portion that connects the water supply tank lid top surface 812*a* and the water supply tank lid rear surface 812*b* to each other. This is also the case for the drain tank 820.

A portion where the water supply tank lid top surface 812*a* and the water supply opening 8122 meet may be bent inwardly of the water supply tank lid via the water supply opening 8122 to form a water supply tank handle 8124 serving as a handle of the water supply tank. The water supply tank handle 8124 may be formed in an under-cut shape.

In addition, the water supply tank lid 812 may further include a water level sensor for checking the water level of the water supply tank 810. (a) in FIG. 11 shows a case in which a buoy is used as an example of the water supply water level sensor 813 disposed in the water supply tank 810. In addition, the water supply water level sensor 813 may include contact sensing means (not shown) for notifying whether the buoy is in contact.

That is, in the state in which the water supply tank 810 or the drain tank 820 is tilted, the user may supply water via the water supply tank lid 812. Specifically, when water is supplied via the water supply opening 8122, water will be supplied to the water supply tank body 811 via the water supply tank lid communication hole (not shown) of the water supply tank lid 812 in communication with the water supply tank body 811. The water supply tank lid communication hole may be located in a bottom surface of the water supply tank lid.

In this regard, it is difficult for the user to identify how much water is supplied, so that a water level sensor may be required therefor.

When the water level of the water supply tank 810 is low, the buoy will fall. When the buoy rises as water is filled in the tank and the buoy touches the contact sensing means located on the water supply tank lid 812, a signal that water supply is no longer necessary will be sent to the controller 900.

In addition, the controller 900 may notify the user of the fact that the water supply is not necessary via a speaker or a display that may be disposed in the laundry treating apparatus, or a user's smartphone.

Step of separating the water supply tank lid 812 from the water supply tank body 811 will be described as follows with reference to (b) and (c) in FIG. 11. When the user presses the lid detachment device 8121, the hook disposed at one end of the lid detachment device 8121 will be separated from the first body hook coupling portion 8111*a*. Because the hook that is positioned to correspond to the second body hook coupling portion 8111*b* and disposed at one end of the water supply tank lid rear surface 812*b* is still hook-coupled to the second body hook coupling portion 8111*b*, the water supply tank lid 812 may pivot around the hook located on the water supply tank lid rear surface 812*b*. Eventually, when the water supply tank lid 812 pivots, the water supply tank lid 812 may also be separated from the second body hook coupling portion 8111*b*, so that the water supply tank lid 812 may be separated from the water supply tank body 811. At a time of coupling, the water supply tank lid 812 may be coupled to the water supply tank body 811 in a reverse order.

(a) in FIG. 12 shows a position of the aromatizing means 750 and a position of the second air supply hole 152. The aromatizing means 750 may include the first aromatizing kit 751 that is located on one side of the first steam supply port 161 along the third direction and supplies aroma to air discharged via the first air supply hole 151, and the second aromatizing kit 752 that is disposed on the other side of the first steam supply port 161 and supplies aroma to air discharged via the second air supply hole 152.

The first aromatizing kit 751 and the second aromatizing kit 752 may be inserted into and coupled to the aromatizing kit installation portions (not shown) located on both of the sides of the first steam supply port 161.

A separate passage may be formed to supply aroma supplied from the first aromatizing kit 751 and the second aromatizing kit 752 into the first chamber 110. However, for simplification of the passage, via the circulating duct 710 connected to the first air supply hole 151 and the second air supply hole 152, specifically, the supply duct 713, aroma may be mixed with air to be supplied to the first chamber 110.

(a) in FIG. 12 shows a state in which the second air supply hole 152 is defined in the extended surface 1114 extending the first surface 1111 and the second surface 1112 rather than in the second surface 1112. Preferably, the extended surface 1114 may be directed in a direction parallel to the dividing portion 119.

That is, the first air supply hole 151 and the second air supply hole 152 may be defined in different surfaces, but may be positioned perpendicular to each other. Although the second air supply hole 152 may be defined in the second surface 1112, it will be advantageous that the second air supply hole 152 is located in the extended surface 1114 rather than in the second surface 1112 for a length of a passage for supplying hot air and simplification of the passage.

Because the dividing portion 119 is also movable only on the first surface, there is no problem in supplying hot air to the second accommodation space V2 even when the second air supply hole 152 is defined in the extended surface 1114.

The aromatizing means 750 may also supply aroma via the first air supply hole 151 and the second air supply hole 152. The first aromatizing kit 751 may be connected to the first air supply hole 151 and the second aromatizing kit 752 may be connected to the second air supply hole 152. Alternatively, the supply duct 713 may be connected to the first aromatizing kit 751 and the second aromatizing kit 752 before being separated and coupled to the first air supply hole 151 and the second air supply hole 152.

As in (b) in FIG. 12, when the dividing portion 119 is located at the position (P1 in (a) in FIG. 6) spaced apart from one of both of the side surfaces of the first chamber by the distance L1, the dividing portion 119 may divide the first chamber 110 into the first accommodation space and the second accommodation space.

Alternatively, the dividing portion 119 may move to any position along the third direction inside the first chamber 110. That is, the first chamber may be divided into the first accommodation space V1 and the second accommodation space V2 as the dividing portion 119 is located between one hanger 610 and another hanger 610. In addition, the dividing portion 119 may be in contact with one side surface of the first chamber 110 and the interior of the first chamber 110 may be used as one accommodation space.

In this regard, each accommodation space may supply hot air, steam, and/or aroma via each steam supply port, each air suction hole, and each air supply hole.

That is, the first accommodation space V1 may supply hot air, steam, and/or aroma via the first steam supply port 161, the first air suction hole 171, and the first air supply hole 151.

The second accommodation space V2 may supply hot air, steam, and/or aroma via the second steam supply port 162, the second air suction hole 172, and the second air supply hole 152.

On the other hand, the first steam supply port 161 may be located on the first surface 1111, and the second steam supply port 162 may be located on the second surface 1112 instead of on the extended surface 1114. This is because steam may be more uniformly supplied to the accommodation spaces when steam is supplied from the bottom surface than from the side surface.

Such divided spaces may independently supply hot air, steam, and/or aroma. Therefore, the user may use only a necessary space among both of the spaces, or may use both of the spaces by hanging different types of clothes in both of the spaces and then setting treatment cycle and time differently for both of the spaces. Dividing the first chamber 110 into the different spaces by the dividing portion 119 and then independently controlling the different spaces using the respective air supply means, the respective steam supplies, and the respective aromatizing means may be referred to as dual air, dual steam, and dual aroma.

That is, the laundry treating apparatus 1000 described in the present disclosure may divide the space by the dividing portion 119. When the laundry is treated by supplying hot air, steam, and/or aroma to the laundry using only one space, this may be referred to as single care. When both of the accommodation spaces are used independently of each other, this may be referred to as separated care.

When the first chamber 110 of the laundry treating apparatus 1000 is divided by the dividing portion 119, an amount of steam, a steam supply time, a hot air supply amount, and a dry time may be set differently for the spaces. Therefore, the amount of steam and the dry time optimized for each laundry may be set. This has an effect of saving time and cost for the user.

As described above, when the dividing portion 119 is used, the space of the first chamber 110 may be used in the divided manner in one laundry treating apparatus. In order to supply aroma to each space, a plurality of aroma kits may be arranged and may supply the aroma to the spaces, respectively. To this end, the first aromatizing kit 751 may supply the aroma to the first accommodation space and the second aromatizing kit 752 may supply the aroma to the second accommodation space. Because the aroma will be supplied via the first air supply hole 151 and the second air supply hole 152, respectively, the aroma may be supplied to the divided space no matter where the dividing portion 119 is located.

(a) to (d) in FIG. 13 shows an example of the first aromatizing kit 751. The second aromatizing kit 752 will also have the same shape as the first aromatizing kit 751 except that the installation location is different.

The first aromatizing kit 751 may be located in the aromatizing kit installation portion (not shown) disposed on the first chamber bottom surface 111 on the side of the first steam supply port 161 along the third direction.

Referring to (d) in FIG. 13, the first aromatizing kit 751 may include an opening 7511*a* defined in a front surface thereof, and may include a first aromatizing kit body 7511 for accommodating therein a pad 7511*b* containing an aromatizing agent via the opening 7511*a*, and a first aromatizing kit cover 7512 that is pivotably coupled to the first aromatizing kit body 7511 to open and close the opening.

The first aromatizing kit cover 7512 may include a plurality of first aromatizing kit cover holes 7513 defined through the first aromatizing kit cover 7512. The aroma may be supplied from the pad disposed inside the first aromatizing kit 751 via the first aromatizing kit cover holes 7513.

In addition, the first aromatizing kit 751 may include, at a portion thereof below the plurality of first aromatizing kit cover holes 7513, a first aromatizing kit adjustment guide hole 7515 defined through the first aromatizing kit cover 7512 and extending along the first direction, an aromatizing kit adjustment plate 7516 coupled to an inner surface of the first aromatizing kit cover 7512 so as to adjust the number of plurality of first aromatizing kit cover holes 7513, and an aromatizing kit adjustment handle 7514 located on an outer surface of the first aromatizing kit cover 7512, coupled to the aromatizing kit adjustment plate 7516 via the aromatizing kit adjustment guide hole 7515, and moving along the aromatizing kit adjustment guide hole 7515.

Referring to (a) to (c) in FIG. 13, as the aromatizing kit adjustment handle 7514 is moved along the first direction, the aromatizing kit adjustment plate 7516 may close the plurality of first aromatizing kit cover holes 7513, so that the number of opened holes among the plurality of first aromatizing kit cover holes 7513 may be adjusted.

Therefore, even with the same aroma, the aroma will be able to be supplied to the laundry by adjusting a degree to which the aroma is supplied.

Referring to FIGS. 14 and 34, when the dividing portion 119 moves along the third direction, the hanger in a movement section of the dividing portion 119 must move to the space between the top panel 132 and the first chamber top surface 112 via the hanger arranging portion 510. Therefore, when the clothes hanger or the like is hung on the hanger that needs to be moved to the space between the top panel 132 and the first chamber top surface 112 by the hanger arranging portion 510, there is a risk that the dividing portion 119 may be damaged or the hanger may be damaged.

In addition, there is a risk that the dividing portion 119 may be damaged when the dividing portion moves in a case in which the first bottom cover 181 is not installed normally and one side thereof is floating, or the first aromatizing kit 751 or the second aromatizing kit 752 is not installed properly and protrudes.

Referring to FIG. 14, in order to prevent such problem, the aromatizing means 750 may include a first aromatizing kit installation sensor 7518 and a second aromatizing kit installation sensor 7528 for determining whether the first aromatizing kit 751 and the second aromatizing kit 752 are normally installed in the respective aromatizing kit installation portions (not shown), respectively.

The first aromatizing kit installation sensor 7518 and the second aromatizing kit installation sensor 7528 may be formed in a shape of a reed switch.

In addition, the first aromatizing kit cover 7512 and the second aromatizing kit cover (not shown) may include magnets at positions corresponding to the first aromatizing kit installation sensor 7518 and the second aromatizing kit installation sensor 7528, respectively. When the first aromatizing kit 751 and the second aromatizing kit 752 are not installed properly, there is no change in a current flowing through the reed switch. Therefore, the controller 900 may transmit, to the user, a message instructing the user to check the first aromatizing kit 751 and the second aromatizing kit 752 via the display or the speaker.

In addition, the first surface 1111 may include bottom sensors 1111*a*, 1111*b*, 1111*c*, and 1111*d* in portions corresponding to four corners of the first bottom cover 181. Similarly, the bottom sensors 1111*a*, 1111*b*, 1111*c*, and 1111*d* may be in the form of the reed switch. In addition, magnets may be arranged on the bottom surface of the first bottom cover 181 in the portions corresponding to the bottom sensors 1111*a*, 1111*b*, 1111*c*, and 1111*d*. Accordingly, when one or more of the corners of the first bottom cover 181 is lifted, the controller 900 may sense the same and transmit, to the user, of a message instructing the user to check a state of the first bottom cover 181 via the display or the speaker.

Referring to FIG. 34, a hanger hook 682 disposed in each of the plurality of hangers 610 may include a clothes hanger check sensor 359 that checks whether the clothes hanger is hanged. When sensing that the clothes hanger is hanged, instead of moving the dividing portion 119, the controller 900 may transmit, to the user, a message instructing the user to remove the clothes hanger via the display or the speaker.

The display (not shown) may be disposed on the front surface of the main door 200 when the inlet 139 is closed by the main door 200. The speaker (not shown) may be disposed at any position of the laundry treating apparatus 1000 as long as it may alert the user via sound.

Referring to FIG. 15, the laundry treating apparatus 1000 may further include space adjusting means 910 that is located between the first chamber top surface 112 and the top panel 132 and at a front portion of the first chamber 110, and senses an input of the user to move the dividing portion 119.

When the first chamber 110 is used by dividing the interior of the first chamber 110 by moving the dividing portion 119 via the space adjusting means 910, one laundry treating apparatus 1000 may simultaneously perform care of clothes of different fabrics or may separate clothes of different users and perform care on the clothes.

Because the conventional laundry treating apparatus is not able to divide the space inside the first chamber, it was not able to perform the care of the clothes of the different fabrics at the same time. Therefore, when the types of fabrics are different, it was necessary to separate the clothes and perform the care of the clothes separately, so that it took a lot of time.

When the space adjusting means 910 senses the user's input, the dividing portion 119 may move to the position P1 or P2 of one of the plurality of hangers 610 or to the one side surface of the first chamber 110 in response to the user's input.

Alternatively, the space adjusting means 910 may be formed as one or more input buttons or a touch-type display to which one or more position settings may be input. Via the space adjusting means 910, the user may input and store at least one position to which the dividing portion 119 may move, and then use the stored position.

That is, the user may set the position of the dividing portion 119 discretionally.

Alternatively, in the laundry treating apparatus 1000, the position of one of the plurality of hangers 610 or the position of the one side surface of the first chamber 911 may be set to an initial default value.

Specifically, the space adjusting means 910 may be positioned between the first chamber top surface 112 and the top panel 132 and on a first front surface cover 1361 positioned at a front surface of the first chamber 110. On the first front surface cover 1361, the space adjusting means 910 may be formed in a shape of a button as shown in (a) in FIG. 15 or may be of a touch type using the touch display.

(a) to (d) in FIG. 15 show an example in which five hangers are arranged as an example of the plurality of hangers 610. The five hangers may be referred to as a first hanger 611, a second hanger 612, a third hanger 613, a fourth hanger 614, and a fifth hanger 615 from the left for convenience. Herein, description is made using an example with the five independent hangers and five cutout holes corresponding thereto, but this is only used for convenience, and the numbers of hangers and cutout holes are not limited thereto.

(a) to (d) in FIG. 15 show an example in which the dividing portion 119 moves to the position of one of the hangers or a position of one of the cutout holes 1121 in which the one hanger is located.

Accordingly, referring to (a) in FIG. 15, the dividing portion 119 may be located at P1 where the second hanger 612 is located, at P2 where the third hanger is located, or at P3 so as to be in contact with one of both of the side surfaces of the first chamber connected to the first surface 1111.

The reason why the dividing portion does not move to the position of the first hanger 611 is to allow each divided accommodation space to include at least one hanger. Accordingly, the dividing portion 119 may be located at P1 or P2. In addition, the reason why the dividing portion is not located at the fourth hanger 614 is that, as in the case in which the dividing portion 119 is located at the first hanger 611, one divided accommodation space includes only one hanger and thus there is no need to duplicate the same case. Therefore, the dividing portion may move directly from P2 to P3, which is the one of both of the side surfaces of the first chamber connected to the first surface 1111 without moving to a place where the fourth hanger 614 or the fifth hanger 615 is located.

That is, the dividing portion 119 may divide the interior of the first chamber 110 into the one or more accommodation spaces. This is because the entirety of the first chamber 110 may be utilized as the dividing portion 119 is located on the one side surface.

In addition, the dividing portion 119 may separate the accommodation spaces such that each accommodation space has at least one hanger. In addition, based on the one of both of the side surfaces of the first chamber connected to the first surface 1111, the dividing portion 119 may control two hangers of the plurality of hangers 610 located close to the one side surface to move together by the hanger arranging portion 510. This will be described later via the hanger arranging portion 510.

However, this is only an example, and the hanger arranging portion 510 may be formed using a different method or may have a different structure.

The space adjusting means 910 may move the dividing portion 119 to a preset position in order to divide the space of the first chamber. (a) to (d) in FIG. 15 show the example in which the five hangers are arranged. To this end, the space adjusting means 910 may include three adjusting means, namely, a first adjusting means 911, a second adjusting means 912, and a third adjusting means 913. This may vary depending on the number of hangers, so that the number of adjusting means it is not limited to three.

In (a) in FIG. 15, currently, the dividing portion 119 is at the position of the third hanger 613 of the five hangers. Therefore, each of the divided accommodation spaces on the both sides may include two hangers. When the user presses or touches the first adjusting means 911, the dividing portion 119 may be located at P1, which is the position of the second hanger 612.

In addition, when the user presses or touches the second adjusting means 912 again, the dividing portion 119 will move to P2, which is the position of the third hanger. In addition, when the user presses or touches the third adjusting means 913 again, the dividing portion 119 will move to the position of P3. In one example, when the dividing portion 119 is at P1, which is the position of the second hanger 612, the dividing portion 119 may move to the position of P3 immediately when the user presses or touches the third adjusting means 913.

In order for the dividing portion 119 to move along the third direction inside the first chamber 110, some of the plurality of hangers 610 protruding into the first chamber 110 must be moved to the location above the first chamber 110, that is, between the first chamber top surface 112 and the top panel 132.

To this end, the plurality of hangers 610 may be individually moved by the hanger arranging portion 510 while the dividing portion 119 moves. That is, the hanger arranging portion 510 may move the plurality of hangers 610 to the location between the first chamber top surface 112 and the top panel 132 or into the first chamber.

For example, at P2, which is the initial position of the dividing portion 119, the third hanger 613 is in a state of being moved to the outside of the first chamber. In this regard, when the user presses the first adjusting means 911, the second hanger 612 located at P1, which is a position to which the dividing portion 119 is to be moved first, may move to the outside of the first chamber, and when the dividing portion 119 reaches the position of P1, the third hanger 612 may protrude into the first chamber 110 again. In one example, the third hanger 613 may be moved into the first chamber 110 as soon as the dividing portion 119 leaves the position of the third hanger 613.

When the dividing portion 119 moves from the initial position P2 to P3, the fourth hanger 614 and the fifth hanger 615 may move to the outside of the first chamber 110 before the dividing portion 119 moves. In addition, when the dividing portion 119 reaches P3 or the dividing portion 119 passes the position of the fifth hanger 615, the third hanger 613, the fourth hanger 614, and the fifth hanger 615 will protrude into the first chamber 110 again.

Such movement of the hanger may be referred to as a pop-up hanger, and such movement may be performed as the controller 900 controls the hanger arranging portion 510.

FIGS. 16 to 32 illustrates the driver 500 that is disposed in the laundry treating apparatus 1000 described in the present disclosure so as to move the plurality of hangers 610 in various directions and move the dividing portion 119.

For example, the laundry treating apparatus 1000 may include the driver 500 that moves or pivots the hanger 610.

The driver 500 may move the hanger 610 in at least one of the first direction (or the height direction of the cabinet), the second direction (or the depth direction of the cabinet), and the third direction (or the width direction of the cabinet).

The driver 500 may be positioned between the first chamber top surface 112 and the top panel 132. However, alternatively, referring to FIG. 19, the driver 500 may be located inside the first chamber.

For example, the driver 500 may move the hanger 610 in the first direction and the second direction.

Alternatively, the driver 500 may move the hanger 610 in all of the first direction (or the height direction of the cabinet), the second direction (or the depth direction of the cabinet), and the third direction (or the width direction of the cabinet).

The plurality of hangers may be arranged. Therefore, the driver 500 may include the hanger arranging portion 510 for moving one or more of the plurality of hangers 610 along the first direction, a transport driver 540 for moving the hanger assembly 600 along the second direction, and a reciprocating portion 520 for reciprocating the hanger assembly 600 along the third direction.

Therefore, the laundry treating apparatus 1000 may include the cabinet 130 having the inlet 139 defined in one surface thereof, the main door 200 pivotably disposed on the cabinet 130 to open and close the inlet 139, the first chamber 110 positioned inside the cabinet 130 and accommodating therein the laundry via the inlet 139, the second chamber 120 positioned inside the cabinet 130 and at the lower portion of the cabinet 130 to define the space separated from the first chamber 110, the plurality of hangers 610 for hanging the laundry inside the first chamber 110, the dividing portion 119 located inside the first chamber 110 and directed in parallel with the first direction and the second direction to divide the first chamber 110 into the one or more accommodation spaces, and the driver 500 that moves the dividing portion 119 along the third direction, or moves the hanger 610 into the first chamber 110 or to the outside of the first chamber 110 when moving the dividing portion 119.

The laundry treating apparatus 1000 may include at least one of the hanger arranging portion 510, the transport driver 540, the reciprocating portion 520, and the moving driver 530.

The laundry treating apparatus 1000 may include only some of those. This is because the four drivers 510, 520, 530, and 540 may operate independently of each other.

Alternatively, the driver 500 may move the hanger assembly 600 in one of the first direction, the second direction, and the third direction or pivot the hanger assembly 600 clockwise or counterclockwise using only one driving motor. To this end, the driver 500 may further include a device, for example, a clutch or a driving limiting device, for allowing the movements in the directions to be in association with each other or limiting movements in the other directions except for a movement in one direction.

The driver 500 may include the moving driver 530 for moving the dividing portion 119, and the hanger arranging portion 510 for selectively moving the hanger into the first chamber or to the outside of the first chamber.

FIG. 16 shows an example of the hanger assembly 600 and the driver 500. The laundry treating apparatus 1000 may include the driver 500 disposed between the first chamber top surface 112 and the top panel 132 to move the plurality of hangers 610 or the dividing portion 119.

The driver 500 may include the hanger arranging portion 510 for moving the hanger 610 along the first direction, the transport driver 540 for moving the hanger assembly 600 including the plurality of hangers 610 along the second direction, and the reciprocating portion 520 for reciprocating the hanger assembly along the third direction. In addition, the laundry treating apparatus may include the moving driver 530 for moving the dividing portion 119 along the third direction.

Referring to FIG. 16, the laundry treating apparatus 1000 may include the cabinet 130 having the inlet 139 defined in one surface thereof, the top panel 132 that forms the top surface of the cabinet 130, the first chamber 110 positioned inside the cabinet 130 and accommodating therein the laundry via the inlet 139, the first chamber top surface 112 that forms the top surface of the first chamber 110, the second chamber 120 positioned inside the cabinet 130 and at the lower portion of the cabinet 130 to define the space separated from the first chamber 110, the cutout 112*a* defined through the first chamber top surface 112 in the first direction that is the height direction of the cabinet 130, the hanger assembly 600 including the hanger 610 that is inserted into the first chamber 110 through the cutout 112*a* to hang the laundry and a hanger support 605 positioned outside the first chamber 110 so as to support the hanger 610, and the reciprocating portion 520 that is located farther away from the inlet 139 than the hanger assembly 600 along the second direction that is the depth direction of the cabinet 130 and reciprocates the hanger assembly 600 in the third direction that is the width direction of the cabinet 130.

In general, one surface may mean the front surface. In addition, the hanger capable of the reciprocating motion is referred to as a moving hanger.

The reciprocating portion 520 may include a power motor rotation shaft assembly 522 directed in parallel with the first direction, and include a power motor assembly 521 that rotates the power motor rotation shaft assembly 522 using a rotating magnetic field, and a moving body 526 that is coupled to the power motor rotation shaft assembly 522 in a direction parallel to the first direction and converts the rotational motion of the power motor assembly 521 into a reciprocating motion along the third direction so as to reciprocate the hanger assembly 600 coupled thereto in a direction parallel to the second direction and the third direction.

Accordingly, the power motor rotation shaft assembly 522 may be disposed in parallel with the first direction. That is, the rotational motion of the power motor assembly 521 will be converted into the reciprocating motion via the moving body 526 positioned beneath the power motor assembly 521 and transmitted to the hanger support 605.

Referring to FIG. 16, the moving body 526 may be located at the rear of the hanger support 605. That is, the reciprocating portion 520 may be connected to a hanger supporting stage 620 so as to reciprocate the hanger supporting stage 620 in the third direction, and may be located farther away from the inlet 139 than the hanger supporting stage 620 along the second direction.

In other words, the reciprocating portion 520 and the moving body 526 may be coupled to each other to be perpendicular to each other, and the moving body 526 and the hanger support 605 may be coupled to each other to be in parallel with each other.

Therefore, the reciprocating portion 520, the moving body 526, and the hanger support 605 may be positioned between the first chamber top surface 112 and the top panel 132 in an L-shape. This may reduce a size of a space required to implement the moving hanger.

Accordingly, in the space between the first chamber top surface 112 and the top panel 132, the drivers for the movements in the different directions, for example, the moving driver 530, the transport driver 540, and the hanger arranging portion 510, may be additionally installed.

The reciprocating portion 520 may be located on the first chamber top surface 112 to be spaced apart from the hanger assembly 600. Preferably, in consideration of noise and vibration, the reciprocating portion 520 may be located at the rear of the hanger assembly 600. Specifically, the reciprocating portion 520 may be located at the rear of the hanger support 605.

In this regard, the first chamber top surface 112 is a case in which it is assumed that the hanger assembly 600 and the reciprocating portion 520 are located on the same surface. That is, when the hanger assembly 600 and the reciprocating portion 520 are orthogonally projected onto the first chamber top surface 112 along the first direction, the hanger assembly 600 and the reciprocating portion 520 may be located at different positions spaced apart from each other.

The hanger support 605 and the reciprocating portion 520 may be positioned between the top panel 132 and the first chamber top surface 112, and the reciprocating portion 520 may reciprocate the hanger support 605 in the third direction. This is to remove the foreign substances including the fine dust from the hanged laundry.

The foreign substances will be filtered via a filter 718 equipped inside the blower unit 700.

The hanger support 605 may include a hanger support frame 630 for pivotably supporting the hanger 610, the hanger supporting stage 620 that reciprocates the hanger support frame 630 and the hanger 610 in the third direction and guides the hanger support frame 630 and the hanger 610 to move in the second direction, and a movement guide hole 625 that is defined to extend through the hanger supporting stage 620 and extends in the second direction.

The hanger supporting stage 620 is capable of the reciprocating motion in the third direction by the reciprocating portion 520. Therefore, when the hanger supporting stage 620 is in the reciprocating motion, the hanger support frame 630 coupled to the hanger supporting stage 620 will reciprocate, and eventually the hanger 610 coupled to the hanger support frame 630 will reciprocate.

The laundry treating apparatus 1000 may further include the transport driver 540 for moving the hanger support frame 630 in the second direction along the movement guide hole 625. This is possible because a space occupied by the reciprocating portion 520 is reduced.

The transport driver 540 may be positioned on the hanger supporting stage 620 and between the hanger support frame 630 and at least one of both of the side surfaces of the cabinet 130.

In addition, the laundry treating apparatus 1000 may further include the dividing portion 119 for dividing the first chamber 110 into the one or more accommodation spaces, and the moving driver 530 positioned between the top panel 132 and the first chamber top surface 112 and moving the dividing portion 119 along the third direction in the first chamber 110.

Referring to FIG. 16, the moving driver 530 may be positioned between the hanger supporting stage 620 and at least one of both of the side surfaces of the cabinet 130.

In addition, the laundry treating apparatus 1000 may include the hanger arranging portion 510 for moving the hanger 610 into or to the outside of the first chamber 110.

In addition, the hanger support frame 630 may include a plurality of pivoting support frames 632 that are opened toward the first chamber top surface 112 to have a cross-section in a U-shape. That is, each of the pivoting support frames 632 may have an inverted U-shape or a channel shape with one side open. In addition, a top surface of the pivoting support frame may be in a form of a bent plane rather than a smooth curved surface like in the U-shape.

In addition, the hanger support frame 630 may further include movement support frames 631 that are disposed between the plurality of pivoting support frames 632 so as to connect the plurality of pivoting support frames 632 to each other and allow the hanger support frame 630 to be coupled to the hanger supporting stage 620 so as to be movable in the second direction that is the width direction of the cabinet.

Referring to FIG. 16, the hanger arranging portion 510 may be located on one side surface of the pivoting support frame 632.

FIG. 17 shows a hanger bar 64 of the conventional laundry treating apparatus and a driver 63 for reciprocating the hanger bar 64 in the width direction of the cabinet.

Referring to (a) in FIG. 17, the hanger bar 64 is disposed in the width direction of the cabinet in a form of a bar, and the hanger bar 64 includes a plurality of hanger grooves defined therein to hang the laundry. In addition, the hanger bar 64 may be supported by support bars 62 at both ends thereof. The support bar 62 may reciprocate together with the hanger bar 64 while supporting the same during the reciprocating motion of the hanger bar 64 by the driver 63.

The driver 63 may be positioned above or below the top surface of the first chamber 110. The driver 63 may include a motor for generating a rotational force, a rotation shaft rotated by the motor, an eccentric body that converts the rotation of the rotation shaft into eccentric rotation, and motion conversion means 69 that converts the rotational motion of the eccentric body into a reciprocating motion.

(b) in FIG. 17 is a side view taken along a line E-E'. Referring to (b) in FIG. 17, the motion conversion means 69 has a slot or a groove elongated in the depth direction of the cabinet, and is able to convert the rotational motion of the eccentric body into the reciprocating motion. Therefore, the hanger bar 64 may reciprocate in the width direction of the cabinet.

The driver 63 may be positioned above the hanger bar 64. Accordingly, it may be seen that the driver 63 and the hanger bar 64 are positioned on one vertical line AS1. However, a length of the reciprocating motion (a length from the driver 63 to the hanger bar 64 along the height direction of the cabinet) is inevitably increased. Accordingly, when the driver 63 is located below the top surface of the first chamber, a length of the support bar 62 is inevitably increased, and sizes, especially lengths along the height direction of the cabinet, of the driver 63 and the hanger bar 64 inside the first chamber are inevitably increased.

Even when the driver 63 is positioned between the first chamber top surface 112 and the top panel 132, the vertical coupling of the driver 63 and the hanger bar 64 may inevitably result in a great difference in a vertical level between the first chamber top surface 112 and the top panel 132 of the cabinet.

(a) in FIG. 18 shows another example of the coupling of the hanger assembly and the driver (or the reciprocating portion). A reciprocating portion 580 that generates a rotational force may include a power motor assembly that generates the rotational force, an eccentric body 582 that is coupled to a power motor rotation shaft assembly rotating by a magnetic field at a center of the power motor assembly, but rotates by being spaced apart from the power motor assembly in a radial direction of the rotation shaft assembly, and a moving body 596 that converts the rotational motion of the eccentric body 582 into a reciprocating motion along the width direction of the cabinet 130.

Therefore, a hanger assembly 6610 including a plurality of hangers will reciprocate in the width direction of the cabinet by the moving body 596.

In addition, the reciprocating portion 580 may further include a motion guide 5961 for guiding the reciprocating motion of the moving body 596. (a) and (b) in FIG. 18 show that the motion guides 5961 are arranged adjacent to front and rear surfaces of the moving body 596, respectively, so as to guide the moving body 596 to reciprocate only in the width direction of the cabinet.

(b) in FIG. 18 is a side view taken along a line K-K'. Referring to (b) in FIG. 18, it may be seen that the reciprocating portion 580 is located above the hanger assembly 6610. That is, it may be seen that the hanger assembly 6610 and the reciprocating portion 580 are positioned on one vertical line AS1. Accordingly, as in FIG. 17, it may be seen that the hanger assembly 6610 and the reciprocating portion 580 are vertically coupled to each other. In this case, there are advantages of shortening a force transmission path and being able to withstand structural and mechanical deformation more, but there is a problem in that the space occupied is increased.

In general, the reciprocating portion 580 may be positioned between the first chamber top surface 112 and the top panel 132. In this case, although the space between the first chamber top surface 112 and the top panel 132 increases, such space will not be used efficiently.

(a) in FIG. 19 shows another example of the coupling of the hanger assembly and the driver 500 (or the reciprocating portion 520). The reciprocating portion 520 that generates the rotational force may include the power motor assembly 521 that generates the rotational force, an eccentric body 5253 that is coupled to a power motor rotation shaft assembly 522 rotating by a magnetic field at a center of the power motor assembly, but rotates by being spaced apart from the power motor assembly in a radial direction of the rotation shaft assembly, and a moving body 526 that converts the rotational motion of the eccentric body 5253 into a reciprocating motion along the width direction of the cabinet 130.

Therefore, the hanger assembly 610 including the plurality of hangers will reciprocate in the width direction of the cabinet by the moving body 526.

In addition, the reciprocating portion 520 may further include a motion guide 5291 for guiding the reciprocating motion of the moving body 526. (a) and (b) in FIG. 19 show that the motion guide 5291 as a member that guides the moving body 526 to reciprocate only in the width direction of the cabinet 130 so as to be parallel to the width direction of the cabinet on a front surface of the hanger assembly 600 and a rear surface of the moving body 526.

(b) in FIG. 19 is a side view taken along a line F-F'. Referring to (b) in FIG. 19, it may be seen that the reciprocating portion 520 and the hanger assembly 610 are located at different positions. That is, it may be seen that the hanger assembly 610 and the reciprocating portion 520 are at the different positions with respect to the first chamber top surface 112.

That is, the hanger assembly 610 and the reciprocating portion 520 may be spaced apart from each other in the width direction of the cabinet 130 or the depth direction of the cabinet.

With respect to the first chamber top surface 112, it may be seen that, when the hanger assembly 610 and the reciprocating portion 520 are orthogonally projected onto the first chamber top surface 112 along the height direction of the cabinet 130, the hanger assembly 610 is located at a first position on the first chamber top surface 112, and the reciprocating portion 520 is located at a second position different from the first position on the first chamber top surface 112.

Referring to (b) in FIG. 19, it may be seen that the position of the hanger assembly 610 is a position on the vertical line AX1, while the position of the reciprocating portion 520 is a position on another vertical line AX2.

Specifically, in the laundry treating apparatus 1000, the hanger 610 may be disposed in a direction parallel to the power motor rotation shaft assembly 522, and the reciprocating portion 520 that is disposed in the width direction of the cabinet or the depth direction of the cabinet to be spaced apart from the hanger 610 and reciprocates the hanger assembly 600 in the width direction of the cabinet 130 may be included.

Accordingly, unlike FIGS. 17 and 18, it may be seen that the hanger assembly 600 and the reciprocating portion 520 are horizontally coupled to each other. Strictly speaking, it may be seen that the moving body 526, which performs motion conversion, is coupled to the hanger assembly 600 at a different position, and the power motor assembly 521 is located on the moving body 526.

In this case, compared to the vertical coupling, a coupling height H2 of the hanger assembly 600 and the reciprocating portion 520 may be lower than a coupling height H1 of the hanger assembly 6610 and the reciprocating portion 580 in FIG. 18.

In general, the driver 500 may be positioned between the first chamber top surface 112 and the top panel 132, and as a result, the space between the first chamber top surface 112 and the top panel 132 may be more compactly used.

In addition, the reciprocating portion 520 and the hanger assembly 600 may be integrally formed with each other. Specifically, the moving body 526 and the hanger assembly 600 may be integrally formed with each other. Even when the moving body 526 and the hanger assembly 600 are integrally formed with each other, the moving body 526 will convert and transmit the rotational force such that the hanger assembly 600 may reciprocate in the width direction of the cabinet 130.

(a) in FIG. 20 shows another example in which a hanger assembly 563 including a hanger bar 564, and a reciprocating portion 560 for reciprocating the hanger assembly 563 in the width direction of the cabinet 130 are spaced apart from each other with respect to the first chamber top surface 112.

That is, as in FIG. 19, the hanger assembly 563 and the reciprocating portion 560 may be spaced apart from each other in the width direction of the cabinet 130 or the depth direction of the cabinet.

With respect to the first chamber top surface 112, it may be seen that, when the hanger assembly 563 and the reciprocating portion 560 are orthogonally projected onto the first chamber top surface 112 along the height direction of the cabinet 130, the hanger assembly 563 is located at a first position on the first chamber top surface 112, and the reciprocating portion 560 is located at a second position different from the first position on the first chamber top surface 112.

Referring to (b) in FIG. 20, it may be seen that the position of the hanger assembly 563 is a position on a vertical line AY1, while the position of the reciprocating portion 560 is a position on another vertical line AY2. Although the hanger assembly 563 and the reciprocating portion 560 are positioned inside the first chamber 110, spaces, particularly vertical dimensions, occupied by the hanger assembly 563 and the reciprocating portion 560 inside the first chamber 110 will be smaller than in the case of FIG. 17. Therefore, space may be used more efficiently. That is, as shown in FIG. 20, a space behind the hanger bar 564 will also be usable.

In addition, the reciprocating portion 560 and the hanger assembly 563 may be integrally formed with each other. Specifically, a moving body 576 and the hanger assembly 563 may be integrally formed with each other. Even when the moving body 576 and the hanger assembly 563 are integrally formed with each other, the moving body 576 will perform a function of converting and transmitting a rotational force such that the hanger assembly 563 may reciprocate in the width direction of the cabinet 130.

FIG. 21 is a schematic diagram of a layout of the driver shown in FIG. 16. The laundry treating apparatus 1000 may include the cabinet 130 having the inlet 139 defined in one surface thereof, the main door 200 pivotably disposed on the cabinet 130 to open and close the inlet 139, the first chamber 110 positioned inside the cabinet 130 and accommodating therein the laundry via the inlet 139, the second chamber 120 positioned inside the cabinet 130 and at the lower portion of the cabinet 130 to define the space separated from the first chamber 110, the plurality of hangers 610 for hanging the laundry inside the first chamber 110, the dividing portion 119 located inside the first chamber 110 and directed in parallel with the first direction and the second direction to divide the first chamber 110 into the one or more accommodation spaces, and the driver 500 that moves the dividing portion 119 along the third direction, or moves the hanger 610 into the first chamber 110 or to the outside of the first chamber 110 when moving the dividing portion 119.

In addition, the driver 500 may include the hanger arranging portion 510 for moving the hanger 610 along the first direction, the transport driver 540 for moving the hanger assembly 600 including the plurality of hangers 610 along the second direction, and the reciprocating portion 520 for reciprocating the hanger assembly along the third direction. In addition, the laundry treating apparatus may include the moving driver 530 for moving the dividing portion 119 along the third direction.

The plurality of hangers 610 may be arranged. FIG. 21 shows an example in which the plurality of hangers 610 are arranged. A position of the driver 500 indicated on the first chamber top surface 112 based on the hanger assembly 600 including the hangers 610 is as follows.

The reciprocating portion 620 may be spaced apart from the hanger assembly 600 at a different location. Preferably, the reciprocating portion 620 may be located farther away from the inlet 139 than the hanger assembly 600.

That is, the reciprocating portion 620 may be located at the rear of the hanger assembly 600. This is because it is more advantageous in terms of noise and vibration than in a case in which the reciprocating portion 620 is located in front of or on one side of the hanger assembly 600.

As described above, because of the position of the reciprocating portion 620, a difference in a vertical level between the first chamber top surface 112 and the top panel 132 may be reduced.

In addition, the transport driver 540 may be located on a side of the hanger 610 and on the hanger support 605. Ultimately, the transport driver 540 has to move the hanger 610 along the second direction, which is the depth direction of the cabinet, so that a relative distance between the transport driver 540 and the hanger 610 should not vary.

However, whenever the hanger assembly 600 is in the reciprocating motion, the positions of the transport driver 540 and the hanger 610 may change. To prevent such problem, when the hanger assembly 600 reciprocates by the reciprocating portion 620, the transport driver 540 will also reciprocate, which will fix the relative distance to the hanger 610.

Accordingly, the transport driver 540 may be positioned on the side of the hanger 610 and on the hanger support 605.

However, this is only an example, and as long as the transport driver 540 may reciprocate together with the hanger assembly 600, it may be located anywhere on the hanger assembly 600.

The hanger arranging portion 510 may move the hanger 610 along the first direction, which is the height direction of the cabinet, such that the hanger 610 may be positioned inside or outside the first chamber 110. When the plurality of hangers 610 are arranged, the hanger arranging portion 510 may move at least one among the plurality of hangers 610.

FIG. 21 shows an example in which the hanger arranging portion 510 is positioned on one side of the plurality of hangers 610 to move the plurality of hangers 610. However, this is only an example. The hanger arranging portion 510 may be located at a different location, and selectively move only some of the plurality of hangers 610.

In order to prevent a relative position thereof with respect to the hanger 610 from changing, the hanger arranging portion 510 may also be constructed to reciprocate together with the hanger assembly 600.

That is, the hanger arranging portion 510 and the transport driver 540 may be positioned on the hanger support 605 to reciprocate together with the hanger.

Finally, the moving driver 530 may be positioned on one side of the hanger assembly 600 to be spaced apart from the hanger assembly 600. In order to prevent interference with the reciprocating portion 520, preferably, the moving driver 530 may be positioned at a location different from those of the reciprocating portion 520 and the hanger assembly 600.

FIG. 21 shows an example in which the moving driver 530 is located on one side of and is spaced apart from the hanger support 605. This is to prevent the hanger assembly 605 from colliding with the moving driver 530 during the reciprocating motion.

(a) in FIG. 22 shows an example of the hanger arranging portion 510. The hanger arranging portion 510 may move the plurality of hangers 610 individually into or to the outside of the first chamber 110 based on the movement of the dividing portion 119. The hanger arranging portion 510 may selectively move some of the hangers located in a section in which the dividing portion is located or moves of the plurality of cut-out holes defined through the first chamber top surface 112 into or to the outside of the first chamber 110 in the pivoting manner.

That is, the hanger arranging portion 510 may be positioned to correspond to each of the plurality of hangers 610 on the first chamber top surface 112, and may pivotably move each hanger to the space between the first chamber top surface 112 and the top panel 132 or into the first chamber via the plurality of cutout holes 1121 defined through the first chamber top surface 112.

In general, the plurality of hangers 610 will be located inside the first chamber 110. However, the hanger at the location where the dividing wall 1191 is located is not able to be located inside the first chamber 110. Accordingly, at this time, the hanger arranging portion 510 will allow the hanger at the location where the dividing wall 1191 is located to pivot so as to move to the outside of the first chamber 110. Specifically, the hanger arranging portion 510 will move the corresponding hanger to the space between the first chamber top surface 112 and the top panel 132.

In addition, when the dividing wall 1191 moves from the first position to the second position different from the first position, the hanger located at the first position will move into the first chamber 110 again after the dividing wall 1191 moves, and a hanger at the second position will have to move to the outside of the first chamber 110 before the dividing wall 1191 moves.

That is, the hanger arranging portion 510 will be able to pivot the plurality of hangers 610 individually so as to be moved in the first direction. That is, the hanger arranging portion 510 may selectively position the plurality of hangers 610 outside or inside the first chamber 110, that is, above or below the first chamber top surface 112 in the height direction of the cabinet 130.

Therefore, the hanger arranging portion 510 may include a plurality of arranging motors for moving hangers that need to be moved individually or together because the hanger arranging portion 510 has to move the plurality of hangers 610 individually.

For example, as shown in FIG. 15, in the case of the laundry treating apparatus in which the five hangers are arranged and the dividing portion 119 may move to the positions of P1, P2, and P3, the hanger arranging portion 510 will include two arranging motors to move the second hanger 612 and the third hanger, respectively. In addition, the hanger arranging portion 510 will further include one arranging motor for moving the fourth hanger 614 and the fifth hanger 615.

That is, the number of arranging motors may not be the same as the number of hangers. Depending on a design, an arranging motor may be disposed individually so as to move each hanger that needs to be moved, and hangers that are able to move together among the plurality of hangers 610 may share the same arranging motor rotation shaft using one arranging motor. This may vary depending on the design.

In addition, considering a high rotation speed of a general motor, the hanger arranging portion 510 may further include a reduction gear (not shown) or a planetary gear (not shown) for lowering the rotation speed of each of the at least one arranging motor. The reduction gear or the planetary gear may be located inside each of the at least one arranging motor. In contrast, the hanger arranging portion 510 may connect the arranging motor rotation shaft disposed in each of the at least one arranging motor to the at least one hanger driven by the at least one arranging motor to have different rotation ratios using a belt and a pulley.

(b) in FIG. 22 shows an example of the hanger support frame 630 for supporting the plurality of hangers 610 and the transport driver 540 for moving the hanger support frame 630 along a hanger guide rail 628 (see FIG. 16). The hanger support frame 630 may pivotably support one end of each of the plurality of hangers 610. In addition, the hanger support frame 630 may include hanger racks 635 formed at both ends thereof along the third direction of the hanger support frame 630. The transport driver 540 may be coupled to the hanger rack 635.

When the transport drivers 540 respectively move the hanger racks 635 via the pivoting, eventually the hanger support frame 630 disposed between the hanger racks will move along the second direction. That is, the transport driver 540 may move the hanger assembly 600 in a direction away from or closer to the inlet 139.

(c) in FIG. 22 shows an example of a hanger supporting stage 620 and the reciprocating portion 520 for supporting the hanger support frame 630.

The hanger assembly 600 may include the plurality of hangers 610 for hanging the laundry, the hanger support frame 630 for supporting the plurality of hangers 610 so as to be able to pivot and linearly move, and the hanger supporting stage 620 positioned between the first chamber top surface 112 and the top panel 132 to support the hanger support frame 630.

(c) in FIG. 22 shows the hanger supporting stage 620 of the hanger assembly that is coupled to the reciprocating portion 520 to reciprocate the hanger assembly 600 in the third direction.

(d) in FIG. 22 shows an example of the moving driver 530 that moves the dividing wall 1191. The moving driver 530 may be coupled to the first chamber top surface 112 via an interference preventing groove 629 defined as one side of the hanger supporting stage 620 is cut and depressed. A length R1, which is a depressed length of the interference preventing groove along the third direction, may be greater than T1, which is a length along the third direction of a moving motor support that supports a moving motor 531 disposed in the moving driver 530.

This is to avoid interference with the moving driver 530 when the hanger supporting stage 620 reciprocates along the third direction.

The moving driver 530 shown in (d) in FIG. 22 may include a moving member 535 for moving the dividing wall 1191 along the third direction, movement guides 6321, 4323, 5331, and 5333 for moving the moving member 535 along the third direction, and the moving motor 531 and a moving gear 536 for rotating a movement guide 532.

However, this is only an example. As long as the moving driver 530 is able to move the dividing wall 1191 along the third direction, the moving driver 530 may be replaced by another method or another component.

FIGS. 23 to 25 illustrate an example of the hanger arranging portion 510 in detail. FIG. 23 shows a state in which one hanger is raised above the first chamber top surface 112 by the hanger arranging portion 510.

The first chamber 110 may include a cutout 112*a* defined through the first chamber top surface 112. The cutout 112*a* may include a plurality of cutout holes 1121 (see FIG. 27). The plurality of cutout holes 1121 may correspond to the respective positions of the plurality of hangers 610 and may be defined through the first chamber top surface 112.

In addition, the hanger assembly 600 may include the plate-shaped hanger supporting stage 620 positioned between the first chamber top surface 112 and the top panel 132 so as to support the hanger assembly 600.

In addition, the hanger supporting stage 620 may include a plurality of movement guide holes 625 (see (d) in FIG. 22) positioned to respectively correspond to the plurality of cutout holes 1121, extending through the hanger supporting stage 620, and extending along the second direction.

That is, the hanger supporting stage 620 may be positioned between the first chamber top surface and the top panel 132, and the hanger support frame 630 may be positioned on the hanger supporting stage 620.

Therefore, the plurality of hangers 610 may be movably coupled to the hanger support frame 630, and may move into or to the outside of the first chamber 110 by respectively passing through the plurality of movement guide holes 625 and the plurality of cutout holes via the hanger arranging portion 510. This is the same principle as that of a landing gear of an airplane. That is, only when necessary, the plurality of hangers 610 may be individually positioned inside the first chamber.

That is, the hanger arranging portion 510 may individually move the plurality of hangers 610 to be located above or below the first chamber top surface 112 along the first direction.

To this end, the hanger arranging portion 510 may include an arranging motor assembly 511 including the one or more arranging motors 5111, 5112, and 5113. This is because, as described above, all of the plurality of hangers 610 may not need to be individually moved. The arranging motor assembly 511 is required to move the hanger at the location at which the dividing portion 119 is positioned or the hanger positioned in the section in which the dividing portion 119 moves, and the number thereof may vary depending on a design.

That is, FIG. 23 shows, as an example, the hanger assembly including the five hangers 611, 612, 613, 654, and 615 and the arranging motor assembly 511 including the three arranging motors 5111, 5112, and 5113. Therefore, the first arranging motor 5111 may pivot and move the second hanger 612. The second arranging motor 5112 may pivot and move the third hanger 613. In addition, the third arranging motor 5113 may pivot and move the fourth hanger 614 and the fifth hanger 615 together at the same time.

That is, arranging motor rotation shafts 5111*a*, 5111*b*, and 5111*c* arranged in the arranging motors 5111, 5112, and 5113 and rotated by the arranging motors 5111, 5112, and 5113, respectively, may be coupled to at least one of the plurality of hangers, and pivot and move the at least one hanger to the outside of or into the first chamber 110.

The hanger support frame 630 may be formed in a shape in which a plurality of square wave forms are repeated. This may also be referred to as a meander line shape or a concave-convex shape.

The hanger support frame 630 may be formed such that a length thereof along the third direction is greater than a length thereof along the second direction. That is, the hanger support frame 630 may be formed long along the width direction of the cabinet 130.

The hanger support frame 630 may include a plurality of pivoting support frames 632 that are opened toward the first chamber top surface 112 and have a cross-section in the U-shape. That is, each of the pivoting support frames 632 may have an inverted U-shape or a channel shape with one side open. In addition, the top surface of the pivoting support frame may be in the form of the bent plane rather than the smooth curved surface like in the U-shape.

In addition, the hanger support frame 630 may further include the movement support frames 631 that are disposed between the plurality of pivoting support frames 632 so as to connect the plurality of pivoting support frames 632 to each other and allow the hanger support frame 630 to be coupled to the hanger supporting stage 620 so as to be movable in the second direction that is the width direction of the cabinet.

The movement support frame 631 may be connected to the hanger supporting stage 620 to move the hanger support frame 630 along the second direction. To this end, the hanger assembly 600 may further include the hanger guide rail 628 disposed between the movement guide holes 625 so as to guide the hanger support frame 630 to move along the depth direction of the cabinet 130, and the movement support frame 631 may have a groove depressed along the second direction such that the hanger guide rail 628 is inserted thereinto.

The hanger guide rail 628 may serve to guide the hanger support frame 630 when moving closer to or farther from the inlet 139 by the transport driver 540. A plurality of hanger guide rails 628 may be arranged. This is for a more stable guide.

The movement support frames 631 may connect the plurality of pivoting support frames 632 to each other to form the hanger support frame 630 integrally.

The hanger support frame 630 may further include hanger racks 6351, 6352 at both ends thereof.

The hanger support frame 630 may further include a first hanger rack 6351 and a second hanger rack 6352 arranged at both of the ends thereof. In addition, the hanger support frame 630 may further include the movement support frames 631 respectively at a location between the first hanger rack 6351 and one of the plurality of pivoting support frames 632 closest to the first hanger rack 6351 and a location between the second hanger rack 6352 and another of the plurality of pivoting support frames 632 closest to the second hanger rack 6352.

Accordingly, the movement support frame 631 may connect the plurality of pivoting support frames 632 and the hanger racks 6351 and 6352 to each other to eventually form the hanger support frame 630 of the square wave shape or the meander line shape.

Each of the one or more arranging motors 5111, 5112, and 5113 may be located between two of the plurality of pivoting support frames 632. That is, each of the one or more arranging motors 5111, 5112, and 5113 may be disposed on one side of the pivoting support frame 632 into which a hanger to be pivoted is inserted.

Each of the arranging motor rotation shafts 5111*a*, 5111*b*, and 5111*c* included in each of the one or more arranging motors 5111, 5112, and 5113 may be coupled to the hanger inserted into the pivoting support frame 632 through one surface of the pivoting support frame 632 along the second direction in order to be connected to the hanger to be pivoted by the hanger arranging portion 510.

For example, referring to FIG. 23 and (a) and (b) in FIG. 24, a state in which the first arranging motor rotation shaft passes through one surface of the pivoting support frame into which the second hanger 612 is inserted and is connected to the second hanger 612 for coupling of the first arranging motor 5111 and the second hanger 612 is shown. In addition, a state in which the first arranging motor 5111 pivots and moves the second hanger 612 to the location above the first chamber top surface 112 is shown.

In addition, a state in which the second arranging motor rotation shaft passes through one surface of the pivoting support frame into which the third hanger 613 is inserted and is connected to the third hanger 613 is shown. In addition, a state in which the second arranging motor 5112 pivots and moves the second hanger 612 to the location below the first chamber top surface 112 is shown.

In FIG. 23, because the first hanger 611 is not located in the section in which the dividing portion 119 is located or moves, the first hanger 611 does not have a separate arranging motor.

In addition, because the fourth hanger 614 and the fifth hanger 615 may move together as described above, a state in which the third arranging motor rotation shaft extends through both surfaces of the pivoting support frame into which the fourth hanger 614 is inserted and one surface of the pivoting support frame into which the fifth hanger 615 is inserted, and thus the fourth hanger 614 and the fifth hanger 615 are connected to each other is shown. In addition, a state in which the third arranging motor 5113 pivots and moves the fourth hanger 614 and the fifth hanger 615 to the location below the first chamber top surface 112 is shown.

Therefore, the hanger arranging portion 510 may be coupled to the hanger support frame 630, and may selectively pivot and move the plurality of hangers 610 into or to the outside of the first chamber 110.

In particular, the hanger arranging portion 510 may be connected to at least one hanger with at least a portion thereof positioned in a portion facing the first surface 1111 in the first chamber top surface 112 of at least one of the plurality of cutout holes 1121.

In addition, the number of one or more arranging motors included in the hanger arranging portion 510 may be different from the number of the one or more hangers.

This is because the two hangers closest to one side surface of the cabinet are able to pivot and move together.

The number of plurality of cutout holes 1121 are the same as the number of plurality of hangers 610 because the cutout hole and the hanger are in one-one correspondence with each other. In addition, the positions of the plurality of cutout holes 1121 are the same as the positions of the plurality of hangers 610. This is because each of the plurality of hangers 610 is inserted into each of the plurality of cutout holes 1121 in the one-to-one correspondence.

In addition, the number of plurality of pivoting support frames 632 for supporting the plurality of hangers 610 will be the same.

However, the number of one or more hangers among the plurality of hangers 610 connected to the hanger arranging portion 510 and moved into or to the outside of the first chamber 110 may be equal to or greater than the number of one or more arranging motors 5111, 5112, and 5113.

(c) in FIG. 24 is a side view of the hanger support frame 630, the hanger assembly 600, and the transport driver 540. The transport driver 540 may be connected to the hanger racks to move the hanger support frame 630 along the second direction by being guide by the plurality of movement guide holes 625 and the plurality of cutout holes 1121.

Referring to FIG. 23 and (c) in FIG. 24, the transport driver 540 may include a first transport driver 541 and a second transport driver 542 that are arranged at both ends of the hanger support frame 630 and are to be connected to the first hanger rack 6351 and the second hanger rack 6352 extending along the second direction, respectively.

The first hanger rack 6351 may be located at one of both of the ends of the hanger support frame 630 and extend along the second direction rearwardly from the hanger support frame 630. The first hanger rack 6351 may be located at one of both of the ends of the hanger support frame 630 and extend along the second direction rearwardly from the hanger support frame 630.

The first transport driver 541 may include a first transport motor 5411 that generates a rotational force to move the hanger support frame 630, a first transport motor rotation shaft 5412 disposed in the first transport motor 5411 to rotate, and a first transport gear 5415 connected to the first transport motor rotation shaft 5412 and coupled to the first hanger rack 6351.

In addition, the second transport driver 542 may include a second transport motor 5421 that generates a rotational force to move the hanger support frame 630, a second transport motor rotation shaft 5422 disposed in the second transport motor 5421 to rotate, and a second transport gear 5425 connected to the second transport motor rotation shaft 5422 and coupled to the second hanger rack 6352.

That is, on a principle similar to a rack and a pinion, the transport driver 540 may move the hanger support frame 630 closer to or farther from the inlet 139.

Considering the high rotation speed of the general motor, the transport driver 540 may further include a reduction gear (not shown) or a planetary gear (not shown) for lowering the rotation speed of each of the at least one transport motor. The reduction gear or the planetary gear may be located inside each of the at least one transport motor. In contrast, the transport driver 540 may connect the transport motor rotation shaft disposed in each of the at least one transport motor to the hanger assembly 600 driven by the at least one transport motor to have different rotation ratios using a belt and a pulley.

Although the case in which the transport drivers 540 are arranged at both of the sides of the hanger support frame 630, respectively, this is only an example. Alternatively, the transport driver 540 may be disposed at one side of the hanger support frame 630 to move the hanger support frame 630.

The hanger assembly 600 may further include the hanger guide rail 628 for stably guiding the movement of the hanger support frame 630, by the transport driver 540, on the hanger supporting stage 620. The hanger guide rail 628 may be inserted into the groove positioned at a lower portion of the movement support frame 631 to move the hanger support frame 630 more stably.

(a) to (d) in FIG. 25 illustrate an operation related to the dividing portion 119 and the hanger arranging portion 510. When briefly describing the operation, the driver 500 may move the hanger 610 to the outside of or into the first chamber 110 based on the position of the dividing portion 119.

The laundry treating apparatus 1000 may further include the driver 500 that moves the dividing portion 119 along the third direction that is the width direction of the cabinet 130, or moves the hanger 610 into the first chamber 110 or to the outside of the first chamber 110 based on the movement of the dividing portion 119.

FIG. 25 shows, as an embodiment, that the hanger 610 is moved to the outside of the first chamber 110 when the dividing portion 119 is disposed where the hanger 610 is located. In addition, the driver 500 may move the hanger 610 into the first chamber 110 while moving the dividing portion 119 from where the hanger 610 is located to another position or after the movement is completed.

Alternatively, the dividing portion 119 may move not only to the location where the hanger 610 or the cutout hole 1121 is located, but also to a location between one hanger and another hanger 610 or at a location between the hanger and one side surface of the first chamber 110.

In (a) in FIG. 25, when the dividing portion 119 is disposed where one hanger is located, the driver 500 may move the one hanger to the outside of the first chamber 110 via the cutout 112*a*.

Strictly, before the dividing portion 119 is disposed where one hanger is located, the driver 500 will move the one hanger to the outside of the first chamber 110 via the cutout 112*a*.

When the controller 900 senses an input of a place (the first position) where the dividing portion 119 is to be positioned via the space adjusting means 910, the driver 500 will move one hanger disposed at the place (the first position) where the dividing portion 119 is to be positioned to the outside of the first chamber 110 and then will move the dividing portion 119 to the place where said one hanger was located.

In addition, when the controller 900 senses an input of another place (the second position) where the dividing portion 119 is to be positioned via the space adjusting means 910, in order to move the dividing portion 119 to the place (the second position) where another hanger is located, the driver 500 will move said another hanger to the outside of the first chamber 110 and then move the dividing portion 119 to the place where the another hanger was located. In addition, the driver 500 will move said one hanger that was located at the first position into the first chamber 110.

This will be described specifically as follows.

The first chamber top surface 112 may include the plurality of cutout holes 1121 defined through the first chamber top surface 112.

The plurality of cutout holes 1121 may include a plurality of hanger hole portions 11211 into which the plurality of hangers 610 are respectively inserted. The hanger hole portions 11211 may be defined for the plurality of hangers 610 to reciprocate along the third direction or move to be located above or below the first chamber top surface 112 along the first direction by the driver 500.

Therefore, a width along the third direction of the hanger hole portion 11211 may be greater than twice the amplitude during the reciprocating motion of the hanger 610 such that each hanger 610 may reciprocate along the third direction.

The hanger hole portion 11211 may have a rectangular shape. In addition, the hanger hole portion 11211 will be larger than an outer shape of each of the plurality of hangers.

However, the hanger hole portion 11211 may be defined in another form. For example, the plurality of cutout holes 1121 may be defined in a T-shape.

This is to consider that the plurality of hangers 610 pass through the plurality of cutout holes 1121 via the pivoting.

That is, each of the plurality of cutout holes 1121 may further include a linear hole portion 11212 defined along the second direction from the hanger hole portion 11211.

That is, because the linear hole portion 11212 and the hanger hole portion 11211 refer to portions of one cutout hole, the linear hole portion 11212 and the hanger hole portion 11211 may be adjacent to each other and in communication with each other.

The linear hole portion 11212 may be used when the hanger inserted into the corresponding movement guide hole 625 moves in the direction toward or away from the inlet.

The hanger hole portion 11211 may be used when the hanger corresponding thereto reciprocates in the third direction to be described later. Accordingly, a length along the third direction of the hanger hole portion 11211 may be greater than twice the amplitude at which each of the plurality of hangers moves during the reciprocating motion. Here, the amplitude refers to a maximum movement distance that the hanger may deviate from a center of the hanger hole portion 11211 to one side during the reciprocating motion.

However, the shape of the plurality of cutout holes 1121 may be different. The T-shape is obtained considering that the plurality of hangers 610 move in the direction closer to the inlet and then move into or to the outside of the first chamber 110 via the pivoting by the hanger arranging portion 510.

On the contrary, when the plurality of hangers 610 move into or to the outside of the first chamber 110 via the rotation by the hanger arranging portion 510 in place, the shape of the plurality of cutout holes 1121 may be changed. For example, the shape of the cutout hole 1121 may be a simple rectangular shape or an I-shape.

(a) in FIG. 25 is a case in which the main door 200 is opened and the dividing portion 119 is located in a cutout hole located in the middle along the third direction among the plurality of cutout holes. At this time, the hanger arranging portion 510 has already moved the hanger where the dividing portion 119 to the location above the first chamber 110, that is, the location between the first chamber top surface 112 and the top panel 132 via the cutout hole 1121 and the movement guide hole 625 corresponding thereto.

In addition, the rest of the hangers are in a state of being moved forward inside the first chamber 110 by the transport driver 540.

The laundry treating apparatus 1000 may move the hanger assembly 600 in the direction closer to the inlet 139 based on whether the main door 200 is opened. That is, when the main door 200 is opened, the transport driver 540 may move the hanger assembly 600 closer to the inlet 139. This is to make it easier for the user to hang the laundry.

Thereafter, when the main door 200 is closed, the transport driver 540 may move the hanger assembly 600 to an original position, that is, to a position of the hanger hole portion 11211. This is to prepare for the reciprocating motion.

Referring to (b) in FIG. 33, whether the hanger arranging portion 510 may move along the third direction may vary depending on whether the main door 200 is opened. That is, when the main door 200 is opened, the dividing portion 119 may be movable, and when the main door 200 is closed, the dividing portion 119 may be fixed in position at a position set when the main door 200 is opened.

This is to prevent the hanger assembly 600 from colliding with the dividing portion 119 and being damaged during the reciprocating motion along the third direction because the hanger assembly 600 may be in the reciprocating motion when the main door 200 is closed.

Accordingly, when the user opens the main door 200, the space of the first chamber 110 may be divided to have a desired size via the space adjusting means 910 located on the first front surface cover 1361.

(b) and (c) in FIG. 25 show that, when the user selects a target position of the dividing portion 119 via the space adjusting means 910, a hanger corresponding to the target position to which the dividing portion 119 is to be moved moves to the outside of the first chamber via the cutout hole corresponding thereto.

First, a length of the hanger inserted into the first chamber 110, specifically, a length of the hanger body 681 (see FIG. 45) may be different from a length of the linear hole portion 11212 along the second direction. A hanger hook 682 (see FIG. 45) with the largest width in the second direction in the hanger will be inserted via the hanger hole portion 11211, and the hanger body 681 will be inserted via the linear hole portion 11212. To this end, in consideration of the length of the hanger during the pivoting, the hanger may move from M1, which is a position when the main door 200 is opened, to M2, which is a position to which the hanger will be pivoted by the hanger arranging portion 510.

When the hanger reaches the position to which it may be pivoted by the hanger arranging portion 510, the hanger arranging portion 510 will pivot the hanger to move to the location above the first chamber top surface 112 via the cutout hole 1121.

Referring to (d) in FIG. 25, when the hanger located at the target position pivots and moves to the outside of the first chamber 110, the dividing portion 119 will move from the initial position currently located to the target position. In addition, the hanger arranging portion 510 will move the hanger located at the initial position into the first chamber 110 in the pivoting manner.

When the driver 500 moves from the initial position (or a first movement position), which is the position before the dividing portion 119 moves, to the target position (or a second movement position different from the first movement position) different from the initial position, the driver 500 will move the hanger 610 to the outside of the first chamber 100.

That is, the driver 500 may move the hanger 610 to the outside of the first chamber 100 as the dividing portion 119 moves.

After the dividing portion 119 moves, the hanger 610 will be moved into the first chamber 110.

Preferably, the plurality of hangers 610 may be arranged. Therefore, as the dividing portion 119 moves, the driver 500 will move at least one of the plurality of hangers 610 into or to the outside of the first chamber 110.

That is, the driver 500 will move the at least one of the plurality of hangers 610 to the location above or below the first chamber top surface 112 based on the movement of the dividing portion 119.

When the dividing portion 119 is moved to be in contact with one side surface of the first chamber 100 and the space inside the first chamber 100 is used as one space, the plurality of hangers 610 will all be moved into the first chamber 110 by the driver 500.

(a) to (d) in FIG. 25 are an assumption that the hanger support frame 630 is not formed integrally, but is formed independently for each hanger. Accordingly, conversely, when the hanger located at the target position moves from M1, which is the position when the main door 200 is opened, to M2, which is the position to which the hanger will be pivoted by the hanger arranging portion 510, the plurality of hangers 610 may all move together. This is because the hanger support frame 630 may move together by the transport driver 540.

In addition, after the corresponding hanger pivots and moves to the outside of the first chamber 110 and the dividing portion moves to the target position, the transport driver 540 may move the plurality of hangers 610 back to the position of when the main door 200 is opened.

Thereafter, when the main door 200 is closed, the transport driver 540 may move the plurality of hangers 610 to the positions of the hanger hole portions 11211.

For the convenience of the user, the hanger constructed to move toward the inlet 139 when the main door 200 is opened may be referred to as a welcome hanger.

FIG. 26 shows the reciprocating portion 520 for reciprocating the hanger assembly 600 in the third direction. That is, the reciprocating portion 520 may reciprocate the plurality of hangers 610 along the width direction of the cabinet 130.

The reciprocating portion 520 may include the power motor assembly 521 for generating the rotational force, the power motor rotation shaft assembly 522 disposed in the power motor assembly 521 to rotate, a power motor support 523 positioned between the first chamber top surface 112 and the top panel 132 to support the power motor assembly 521, and the moving body 526 that converts the rotational motion of the power motor assembly 521 into a reciprocating motion along the width direction of the cabinet 130 and transmits the reciprocating motion to the hanger assembly 600.

In addition, considering the high rotation speed of the general motor, the reciprocating portion 520 may further include a reduction gear (not shown) or a planetary gear (not shown) for lowering the rotation speed of each of the at least one power motor. The reduction gear or the planetary gear may be located inside each of the at least one power motor. In contrast, the reciprocating portion 520 may connect the power motor rotation shaft disposed in each of the at least one power motor to the moving body 526 driven by the at least one power motor to have different rotation ratios using a belt and a pulley.

FIG. 26 and (a) in FIG. 27 show an example in which a plurality of power motors 521, a plurality of power motor rotation shafts 522, and a plurality of power motor supports 523 are arranged along the third direction. However, otherwise, the reciprocating portion 520 may include one power motor assembly 521, one power motor rotation shaft assembly 522, and one power motor support 523. This may be changed in consideration of a size and a force of the power motor assembly 521.

The power motor assembly 521 may be supported by the power motor support 523 such that the power motor rotation shaft assembly 522 is directed in a direction parallel to the first direction. The power motor support 523 may be coupled to the first chamber top surface 112 to prevent interference with the motions of the hanger supporting stage 620 and the moving body 526, and the moving body 526 may be coupled so as to be able to reciprocate by the eccentric body 525 coupled to a free end of the power motor rotation shaft assembly 522.

The reciprocating portion 520 may be located farther from the inlet 139 than the hanger supporting stage 620. That is, the reciprocating portion 520 may be located at the rear of the hanger supporting stage 620 and the hanger support frame 630.

In addition, the moving body 526 that converts the rotational force of the power motor assembly 521 into the reciprocating motion along the third direction to reciprocate the hanger assembly 600 may be located at the same vertical level as the hanger supporting stage 620.

That is, the moving body 526 may be coupled to the hanger supporting stage 620 horizontally. Accordingly, the moving body 526 may be connected to the hanger supporting stage 620 in a form of one smooth plane.

This is to efficiently use the space between the first chamber top surface 112 and the top panel 132 because the vertical level difference between the first chamber top surface 112 and the top panel may be reduced.

In addition, in the conventional laundry treating apparatus 1, the motion conversion means 527 for the reciprocating motion of the hanger bar is exposed to the interior of the first chamber 110, so that the noise may be loud. On the other hand, in the laundry treating apparatus 1000 described in the present disclosure, because both the moving body 526 and the hanger supporting stage 620 for the reciprocating motion are located outside the first chamber 110, that is, between the first chamber top surface 112 and the top panel 132, noise and vibration may be relatively reduced.

(a) in FIG. 27 shows an example in which the plurality of power motors 521, the plurality of power motor rotation shafts 522, and the plurality of power motor supports 523 are arranged along the third direction. In such case, the size of the power motor may be reduced than when using one power motor for the same power, so that it is efficient in terms of space utilization.

That is, the reciprocating portion 520 may include the first power motor assembly 5211 and the second power motor assembly 5212 for generating the rotational forces, the first power motor rotation shaft assembly 5223 and the second power motor rotation shaft assembly 5224 respectively arranged in the first power motor assembly 5211 and the second power motor assembly 5212 to rotate, the first power motor support 523 and a second power motor support positioned between the first chamber top surface 112 and the top panel 132 to respectively support the first power motor assembly 5211 and the second power motor assembly 5212, and the moving body 526 that converts the rotational motions of the first power motor assembly 5211 and the second power motor assembly 5212 into the reciprocating motion along the width direction of the cabinet 130 and transmits the reciprocating motion to the hanger assembly 600.

The moving body 526 may be located at the rear of the hanger supporting stage 620, convert the rotational forces of the first power motor assembly 5211 and the second power motor assembly 5212 into the reciprocating motion, and then transmit the reciprocating motion to the hanger supporting stage 620.

To this end, the moving body may include motion transfer means 529 formed long in the third direction to reciprocate the hanger supporting stage, and motion conversion means 527 protruding rearwardly from a surface opposite to a surface of the motion transfer means 529 connected to the hanger supporting stage.

(a) in FIG. 27 shows an example in which two motion conversion means 527 are arranged.

The motion conversion means 527 may include a slot assembly 528 that passes through the motion conversion means in the first direction and extends along the second direction. Each motion conversion means 527 may include a first slot 5281 and a second slot 5282.

(a) in FIG. 27 is only one example. The moving body 526 may include one motion conversion means or two or more motion conversion means.

Referring to (a) in FIG. 27 and (a) and (b) in FIG. 28, at the free end of the power motor rotation shaft assembly 522, the disk-shaped eccentric body 525 coupled to the power motor rotation shaft assembly 522, and an eccentric protrusion 5251 that is positioned radially apart from a center of the power motor rotation shaft assembly 522 and protrudes in a direction away from the rotation shaft from the eccentric body 525 may be included.

Accordingly, the moving body 526 may be connected to the eccentric protrusion 5251 to convert the rotational motion into the reciprocating motion and transmit the reciprocating motion to the hanger assembly 600.

That is, when the eccentric protrusion 5251 is inserted into the slot assembly 528 and rotates, the eccentric protrusion 5251 will perform a circular motion. That is, the eccentric protrusion 5251 will revolve around the power motor rotation shaft assembly 522.

Accordingly, the rotational motion of the eccentric protrusion 5251 may transmit a force in the second direction and the third direction. In this regard, because the slot assembly 528 is defined long in the second direction, the eccentric protrusion 5251 coupled to the slot assembly 528 may freely move in the second direction within the slot assembly 528 without interference.

That is, preferably, the slot assembly 528 may be defined long in a direction perpendicular to a direction of the reciprocating motion of the reciprocating portion 520. Specifically, the slot assembly 528 may be defined long in a direction perpendicular to a direction of the reciprocating motion of the moving body 526.

Accordingly, the eccentric protrusion 5251 may not be able to transmit the force to the moving body 526 via the slot assembly 528 in the second direction, but may be able to transmit only the force in the third direction to the moving body 526 via the slot assembly 528.

To this end, a length along the second direction of the slot assembly 528 may be greater than a rotation radius of the eccentric protrusion 5251.

The force converted into the reciprocating motion by the motion conversion means 527 will be transmitted to the hanger supporting stage 620 via the motion transfer means 529.

To this end, referring to (d) in FIG. 27, the hanger supporting stage 620 may include a plurality of motion body connecting portions 627 protruding toward the moving body 526. In addition, in order to correspond to the plurality of motion body connecting portions 627, the moving body 526 may include a plurality of hanger supporting stage connecting portions 5295 depressed corresponding to the protruding shape of the plurality of motion body connecting portions 627.

The moving body 526 will reciprocate the hanger supporting stage 620, and the hanger supporting stage 620 will reciprocate the hanger support frame 630. As a result, the plurality of hangers 610 will reciprocate.

To this end, a length of the hanger hole portion 11211 along the second direction should be greater than twice the amplitude of the plurality of hangers 610. On the other hand, a length of the movement guide hole 625 along the second direction is independent of the amplitude of the plurality of hangers 610. This is because the hanger supporting stage reciprocates together with the plurality of hangers 610.

The motion body connecting portion 627 and the hanger supporting stage connecting portion 5295 may have forms of a male and a female with shapes corresponding to each other, and the number of motion body connecting portions 627 and the number of hanger supporting stage connecting portions 5295 will be the same.

In addition, in order to stably guide the moving body 526 to reciprocate along the third direction, the moving body 526 may further include at least one motion guide hole 5292 defined through the moving body 526 in the first direction and extending along the third direction, and a motion guide 5292 coupled to the first chamber top surface 112 and inserted into the at least one motion guide hole 5292 so as to support the moving body 526 and guide the reciprocating motion of the moving body.

(a) in FIG. 27 shows an example in which the motion guide 5292 is composed of a first motion guide 5291 and a second motion guide 5291.

(b) in FIG. 27 shows the plurality of cutout holes 1121 and the moving driver 530 for moving the dividing portion 119.

As described above, the moving motor support 533 will be inserted into the interference preventing groove 629 defined in one surface of the hanger supporting stage 620 and will be coupled to the first chamber top surface. Accordingly, the position of the moving motor 531 may be fixed even when the hanger support frame 630 moves or the hanger supporting stage 620 reciprocates.

The moving driver 530 may include the moving motor 531 positioned between the first chamber top surface 112 and the top panel 132 and generating a rotational force to rotate the moving motor rotation shaft 5311, the moving gear 536 connected to the moving motor rotation shaft 5311 to transmit the rotational force of the moving motor 531, and the movement guide 532 that changes the rotation of the moving gear 536 into a motion along the third direction.

Considering the high rotation speed of the general motor, the moving driver 530 may further include a reduction gear (not shown) or a planetary gear (not shown) for lowering the rotation speed of each of the at least one moving motor. The reduction gear or the planetary gear may be located inside each of the at least one moving motor. In contrast, the moving driver 530 may connect the moving motor rotation shaft disposed in each of the at least one moving motor to the movement guide 532 driven by the at least one moving motor to have different rotation ratios using a belt and a pulley.

The laundry treating apparatus 1000 may further include a first support frame 1381 and a second support frame 1382 that are located between the top panel 132 and the first chamber top surface 112 and extend along the third direction to be coupled to a first side panel 134 and a second side panel 135, respectively.

The first support frame 1381 may be located closer to the inlet 139 than the second support frame 1382.

The movement guide 532 may include a first movement guide 5321 and a second movement guide 5322 supported by the first support frame 1381 and the second support frame 1382, respectively, to move the moving member 535, a first transfer guide 5331 connected to the moving gear 536 and the first movement guide 5321 to transmit the rotational force of the moving motor 531, and a second transfer guide 5332 connected to the moving gear 536 and the second movement guide 5322 to transmit the rotational force of the moving motor 531.

Referring to FIG. 29, the movement guide 532 may further include a moving member 535 coupled to the dividing portion 119 to move the dividing portion 119 along the third direction.

In addition, the first movement guide 5321, the second movement guide 5322, the first transfer guide 5331, and the second transfer guide 5332 may be formed in a shape of a screw. The first transfer guide 5331 and the first movement guide 5321 may be respectively defined along the second direction and the third direction to intersect each other. The second transfer guide 5332 and the second movement guide 5322 may also be respectively defined along the second direction and the third direction to intersect each other.

In addition, the moving driver 530 may further include a first connection gear 5366 that is disposed between the first transfer guide 5331 and the first movement guide 5321 to transmit the rotational force of the first transfer guide 5331 to the first movement guide 5321, and a second connection gear 5367 that is disposed between the second transfer guide 5332 and the second movement guide 5322 to transmit the rotational force of the second transfer guide to the second movement guide 5322.

Accordingly, the rotational force of the moving motor 531 may be transmitted to the moving gear 536. The moving gear 536 may include a main gear 5361 coupled to the moving motor rotation shaft 5311, the first auxiliary gear 5362 and the second auxiliary gear 5363 that individually rotate in engagement with the main gear 5361, and a first moving gear 5364 and a second moving gear 5365 connected to rotation shafts of the first auxiliary gear 5362 and the second auxiliary gear 5363 and rotating together with the first auxiliary gear 5362 and the second auxiliary gear 5363, respectively.

Lengths of the first transfer guide 5331 and the second transfer guide 5332 may be different from each other.

The reason for using the two transfer guides to move the dividing portion is to transmit forces for the movement to the front and rear surfaces of the dividing wall 1191, respectively, to move the dividing wall 1191 without bending.

The moving member 535 may include a moving nut assembly 5353 coupled to the first movement guide 5321 and the second movement guide 5322, and a moving body 5352 for connecting the moving nut assembly 5353 and the dividing portion 119 to each other. When the first movement guide 5321 and the second movement guide 5322 rotate, the moving nut assembly 5353 will move along the third direction.

The moving nut assembly 5353 may include a first moving nut 5353*a* coupled to the first movement guide 5321 and moving based on the rotation of the first movement guide 5321, and a second moving nut 5353*b* coupled to the second movement guide 5322 and moving based on the rotation of the second movement guide 5322. This is the principle that the nut moves when the screw rotates, similar to the relationship between the screw and the nut.

Accordingly, because the moving body 5352 connected to the moving nut assembly 5353 transmits a force to the dividing portion 119, the dividing portion 119 may move along the third direction.

That is, the dividing portion 119 may move based on the movement of the moving body 5352 when the moving nut assembly 5353 moves.

The moving body 5352 may include a first fastening body 5352*a* connected to the first moving nut 5353*a* and extending toward the first chamber bottom surface 111, a second fastening body 5352*b* connected to the second moving nut 5353*b* and extending toward the first chamber bottom surface 111, and a fastening body connecting body 5357 for connecting the first fastening body 5352*a* and the second fastening body 5352*b* to each other.

The moving body 5352 may be made of a metal material. This may prevent the bending of the moving body 5352 due to a reaction force when the dividing portion 119 moves.

In addition, the moving member 535 may further include a plate-shaped hanger cover 5351 that covers a portion of one cutout hole at the position to which the dividing portion 119 will move among the plurality of cutout holes 1121.

The moving member 535 may further include a cover connecting body 5355 for connecting the moving body 5352 and the hanger cover 5351 to each other.

Therefore, when moving by the moving driver 530, the hanger cover 5351 and the moving member 535 will move together. Referring to FIG. 29, the hanger cover 5351 may be positioned between the first chamber top surface and the hanger supporting stage 620.

In particular, the hanger cover 5351 may cover the hanger hole portion 11211 of the cutout hole.

The hanger cover 5351 may cover the hanger hole portion 11211 at the location where the dividing portion should be located.

This is to prevent a complex structure such as the driver located on the dividing portion 119 from being seen by the user, and is to prevent breakage of the driver caused by steam or hot air entering the space between the first chamber top surface 112 and the top panel 132 through the open hanger hole portion 11211.

Because the hanger is inserted into another hanger hole portion 11211 in which the dividing portion is not located, said another hanger hole portion 11211 may be sealed to some extent by the hanger even without being covered with the hanger cover 5351.

Because steam and hot air may also enter the space between the first chamber top surface 112 and the top panel 132 through the linear hole portion 11212 in each of the plurality of cutout holes, a hanger gasket 1123 (see FIG. 16) for preventing such phenomenon may be included.

Referring to FIG. 29 and (c) and (d) in FIG. 31, the hanger gasket 1123 may be disposed at both sides of the linear hole portion 11212, extend so as to have a length greater than a length of the linear hole portion 11212 along the second direction, and extend toward a center of the linear hole portion 11212. Accordingly, the hanger gasket 1123 may be in a form of being cut in a direction from the hanger hole portion 11211 to the linear hole portion 11212.

The hanger gasket 1123 may be made of a polymer material such as rubber. Therefore, when each of the plurality of hangers 610 moves in the second direction through the linear hole portion 11212, the hanger gasket 1123 may be bent to both sides around a cut portion and seal the linear hole portion 11212.

Unlike the hanger cover 5351, the hanger gasket 1123 may be disposed in each of all of the plurality of cutout holes 1121. The hanger cover 5351 and the hanger gasket 1123 may prevent steam and hot air from entering the space between the first chamber top surface 112 and the top panel 132.

In addition, it is possible to prevent the driver disposed between the first chamber top surface 112 and the top panel 132 from being exposed to the user.

(a) to (b) in FIG. 30 show a state in which the hanger cover 5351 moves together with the dividing portion 119. It may be seen that, when the dividing portion 119 moves from one cutout hole to another cutout hole, the hanger cover 5351 also moves. (c) in FIG. 30 shows that one cutout hole 1121 in the movement section of the dividing portion is covered while the dividing portion moves to one side surface of the first chamber.

FIG. 30 shows the example of the laundry treating apparatus having the five cutout holes 11211*a*, 11211*b*, 11211*c*, 11211*d*, and 11211*e* and having the five hangers as in the example described above. When the dividing portion 119 moves from the position of the second hanger to the position of the third hanger, similarly, the hanger cover 5351 will also move from the position of the second hanger to the position of the third hanger.

When the dividing portion 119 moves from the position of the third hanger to one side surface of the first chamber connected to the first surface 1111, the dividing portion 119 sequentially passes the positions of the fourth hanger and the fifth hanger, so that the hanger cover 5351 will also pass the positions of the fourth hanger and the fifth hanger.

When the dividing portion 119 moves along the third direction inside the first chamber 110, the hanger cover 5351 will move in the same direction at the location outside of the first chamber.

That is, when the dividing portion 119 moves at the location below the first chamber top surface 112, the hanger cover 5351 may move at the location above the first chamber top surface 112.

Like the hanger cover 5351 and the hanger gasket 1123 serving to prevent steam and hot air from entering the space between the first chamber top surface 112 and the top panel 132, the dividing portion 119 may require a component for sealing each accommodation space in order to use the divided accommodation spaces V1 and V2 independently when dividing the space of the first chamber 110.

That is, at the same time a school uniform of a cotton material is treated with a first steam amount and a first dry time in the first accommodation space V1, a dress of a silk material may be treated with a second steam amount and a second dry time in the second accommodation space V2. To this end, the sealing member that prevents steam and hot air from leaking between the accommodation spaces will be needed.

Referring to (b) in FIG. 31, the dividing portion 119 may include a front gasket 1192*a* that is disposed on a front surface of the dividing wall 1191 and is in contact with the main door inner surface 201 when the main door 200 is closed. The front gasket 1192*a* may be coupled to the front surface of the dividing wall 1191, may be hollow inside, and made of a flexible material, for example, a polymer such as rubber.

This is to make the front gasket 1192*a* easy to deform. Because the main door inner surface 201 has the structure such as the door liner assembly 230 or the door inclined portion 240, this is to prevent the front gasket 1192*a* and the main door inner surface 201 from being spaced apart from each other by such structure.

When there is no dividing portion 119, as shown in FIG. 41, a plurality of hanger clips 226 for mounting the laundry on the main door inner surface 201 may be arranged.

(b) in FIG. 31 shows that the moving member 535 is located inside the dividing wall 1191. In addition, it is shown that the dividing wall gasket 1192 is disposed along a periphery of the dividing wall 1191. The front gasket 1192*a* described above may be disposed on the front surface of the dividing wall 1191. An upper gasket 1192*b*, a rear gasket 1192*c*, and a lower gasket 1192*d* may be arranged on a top surface, a rear surface, and a bottom surface of the dividing wall 1191, respectively. Unlike the front gasket 1192*a*, the upper gasket 1192*b*, the rear gasket 1192*c*, and the lower gasket 1192*d* may be formed as a thin gasket. This is because, unlike the front gasket 1192*a*, as the first chamber top surface 112, the first chamber rear surface 113, and the bottom cover assembly 180 have a smooth shape, a need for the gasket to be deformed is low. Accordingly, the upper gasket 1192*b*, the rear gasket 1192*c*, and the lower gasket 1192*d* may be made of a graphite material.

In (b) in FIG. 31, the upper gasket 1192*b* and the rear gasket 1192*c* are indicated by thick lines. The lower gasket 1192*d* will also be indicated by a thick line.

(a) in FIG. 31 is a top view of the laundry treating apparatus cut perpendicular to the first direction. A state in which the dividing portion 119 has the rear gasket 1192*c* on the rear surface of the first chamber 110 between the two accommodation spaces is enlargedly shown.

FIG. 32 shows an example of the transport driver 540. (a) in FIG. 32 shows a state in which the hanger support frame 630 is located S1 in the hanger hole portion 11211. In addition, (b) in FIG. 32 shows a state in which the hanger support frame 630 is located S2 as the transport driver 540 moves the hanger support frame 630 toward the inlet 139 when the main door 200 is opened.

Only when the hanger support frame 630 is positioned in the hanger hole portion 11211, the hanger assembly 600 may reciprocate along the third direction via the reciprocating portion 520.

As shown in FIG. 32, when the hanger support frame 630 moves, the hanger arranging portion 510 moves together, but the transport driver 540 may be at a fixed position. The reciprocating portion and the moving driver 530 may also be at fixed positions.

In addition, the hanger supporting stage 620 may also move only in the third direction without moving in the second direction. This is because the force is transmitted such that the hanger supporting stage 620 may move only in the third direction by the moving body 526.

Because the transport driver 540 is coupled to the hanger supporting stage 620 like the hanger support frame 630, when the hanger assembly 600 reciprocates, the transport driver 540 and the hanger support frame 630 may reciprocate together with the hanger assembly 600. Accordingly, the transport driver 540 and the hanger support frame 630 may be prevented from being spaced apart from each other and deviated during the reciprocating motion.

Because the moving driver 530 is coupled to the first chamber top surface 112, the moving driver 530 may operate independently of the reciprocating portion 520. However, in order to prevent the dividing portion 119 from being damaged during the movement when the clothes hanger is mounted on the hanger in the section in which the dividing portion 119 moves or the aromatizing means 750 and the bottom cover assembly 180 are installed incorrectly, a clothes hanger check sensor 359, and aromatizing kit installation sensors 7518 and 7528 and bottom sensors 1111*a*, 1111*b*, 1111*c*, and 1111*d* may be arranged for the respective cases.

When an abnormality is sensed via the clothes hanger check sensor 359, the aromatizing kit installation sensors 7518 and 7528 and the bottom sensors 1111*a*, 1111*b*, 1111*c*, and 1111*d*, the controller 900 may stop the movement of the dividing portion 119 and provide alarm to the user via the display or the speaker.

(a) in FIG. 33 shows a state in which the plurality of hangers 610 are located S1 in the hanger hole portions 11211 when the main door 200 is closed. The hanger hole portion 11211 may be located at a center of the first chamber top surface 112 along the second direction.

(b) in FIG. 33 shows a state in which the plurality of hangers 610 are moved to the position S2 close to the inlet 139 along the linear hole portions 11212 by the transport driver 540 when the main door 200 is opened. This is for the user convenience.

Referring to (c) in FIG. 33, in order to know whether the main door 200 is opened or closed, the door hinge assembly 225 may include door opening/closing check means 2255. The door opening/closing check means 2255 may be located in the first door hinge 2251 or the second door hinge 2252, or may be located in a coupling portion (not shown) necessary for fixing the main door 200 to the inlet. (c) in FIG. 33 shows, as an example, a switch sensor that is positioned in the second door hinge 2252 to allow the user to know whether the main door 200 is open.

The controller 900 may sense whether the main door 200 is opened or closed based on a control signal of the door opening/closing check means 2255.

FIG. 34 shows an example in which the dividing portion 119 is located in one of the plurality of cutout holes 1121. As described above, in the hanger hole portion of the one cutout hole 1121, the hanger cover 5351 that moves together with the moving body 5352 may be located.

It may be seen that most of a hanger hole portion of another cutout hole spaced apart from the dividing portion 119 is covered by the hanger and the hanger support 605 as shown in FIG. 34. Specifically, the most of the hanger hole portion may be covered by the hanger support frame 630.

Alternatively, the hanger support 605 may include a frame bushing 6311 positioned between the hanger support frame 630 and the hanger supporting stage 620 and supporting the hanger support frame 630, and may be covered by the frame bushing 6311. In particular, it may be coupled to the movement support frame 631 may support the movement support frame 631.

(a) to (c) in FIG. 35 show an example of the length-adjustable shelf 310 whose length is adjusted based on the movement of the dividing portion 119.

In the case of the conventional laundry treating apparatus, because the width of the first chamber is fixed, the length of the shelf is also fixed. However, in the case of the laundry treating apparatus 1000 described in the present disclosure, because the size of the accommodation space of the first chamber may be variable by the dividing portion 119, the length of the shelf should also change when the dividing portion 119 moves along the third direction.

(a) in FIG. 35 shows an example in which the length-adjustable shelf 310 is disposed in the second accommodation space V2. The length-adjustable shelf 310 may be supported by a side surface shelf mounting portion 1145 that is located on of both of the side surfaces of the first chamber 110 and extends along the second direction, and a dividing wall shelf mounting portion 1195 that is disposed on one of both side surfaces of the dividing wall 1191 opposite to said one side surface and extends along the second direction.

Similarly, length-adjustable shelf 310 may be located in the first accommodation space V1. However, because the dividing portion 119 may be in contact with one side surface of the first chamber 110 connected to the first surface 1111, when there is the mounting portion for mounting the length-adjustable shelf in the first accommodation space V1, the dividing portion 119 and said one side surface of the first chamber 110 may not be able to be in contact with each other, so that it will be preferable that the side surface shelf mounting portion 1145 and the dividing wall shelf mounting portion 1195 are located in the second accommodation space V2.

As the dividing portion 119 moves, the length-adjustable shelf must also be adjusted in length along the third direction. Because sizes of the side surface shelf mounting portion 1145 and the dividing wall shelf mounting portion 1195 are fixed, the length-adjustable shelf 310 will also be fixed in length in the second direction.

Accordingly, referring to FIG. 36, the length-adjustable shelf 310 may include a first fixing bar 311 that is coupled to the side surface shelf mounting portion 1145, a second fixing bar 312 that is coupled to the dividing wall shelf mounting portion 1195, and a plurality of length-adjustable bars 313 that connect the first fixing bar 311 and the second fixing bar 312 to each other, and are formed in a telescopic or bellows shape such that a length thereof is adjustable based on a distance between the first fixing bar 311 and the second fixing bar 312.

There is an elastic member such as a spring inside the length-adjustable bar 313, so that the length of the length-adjustable bar 313 may be automatically increased when the dividing portion moves. In contrast, the user may directly adjust the length of the plurality of length-adjustable bars 313 by pulling or pushing the first fixing bar 311 or the second fixing bar 312.

The reason why the length-adjustable shelf is constructed in the form of the plurality of bars instead of a single surface is to move hot air, steam, and aroma in an upward direction through the length-adjustable shelf. This is because the steam supply 160, the air supply means 150, and the aromatizing means 750 are all located at the first surface 1111, the extended surface 1114, or the second surface 1112.

(b) and (c) in FIG. 35 show a state in which the length of the length-adjustable shelf changes as the dividing portion 119 moves. In a case of performing care of an object-to-be-dried such as a doll or a hat, when a size of the doll is great, the doll may be put on the length-adjustable shelf after moving the dividing portion 119 to fit the size of the doll to secure the accommodation space.

Referring to FIG. 36, the second fixing bar 312 and the first fixing bar 311 may include magnets 316 and 317 on surfaces coupled to the side surface shelf mounting portion 1145 and the dividing wall shelf mounting portion 1195, respectively. When the side surface shelf mounting portion 1145 and the dividing wall shelf mounting portion 1195 are made of a metal material such as iron to which the magnet may be attached, when the user simply takes the length-adjustable shelf 310 near the side surface shelf mounting portion 1145 and the dividing wall shelf mounting portion 1195, naturally, the second fixing bar 312 and the first fixing bar 311 will be respectively coupled to the side surface shelf mounting portion 1145 and the dividing wall shelf mounting portion 1195 by a magnetic force.

In addition, when the dividing portion 119 moves, because the magnets are coupled to the side surface shelf mounting portion 1145 and the dividing wall shelf mounting portion 1195 by magnetism of the magnets 316 and 317, respectively, the plurality of length-adjustable bars 313 may be automatically stretched.

Therefore, it will be easier for the user to mount and support the length-adjustable shelf 310 between the dividing wall 1191 and one of both of the side surfaces of the first chamber 110 opposite to the dividing wall 1191.

The laundry treating apparatus 1000 described in the present disclosure may support the object-to-be-dried using a shelf other than the length-adjustable shelf 310.

(a) and (b) in FIG. 37 show an example of a mountable shelf 320 detachable from one side surface of the first chamber 110. The mountable shelf 320 is for the user to easily attach and detach the shelf inside the first chamber 110 so as to use the shelf 320 in various layouts.

In the case of the conventional laundry treating apparatus, not only the length of the shelf was fixed, but also the position where the shelf is mounted was fixed.

When clothes made of a material such as knit are hanged on the hanger assembly 600 using the clothes hanger, there is a risk of damage to the clothes as a shoulder area is stretched. In this case, it is necessary to perform care for the clothes by placing the clothes on the shelf rather than hanging the clothes on the clothes hanger. However, in the case of the conventional laundry treating apparatus, as the length and the position of the shelf are fixed, when using the shelf, the clothes are not able to be hanged on the hanger bar, and when using the hanger bar, the shelf is not able to be used.

In order to solve such problem, the laundry treating apparatus 1000 described in the present disclosure may include the mountable shelf 320 that may serve as the shelf by sufficiently supporting the object-to-be-dried even when only one side thereof is fixed.

The mountable shelf 320 may be usable regardless of the presence or absence of the dividing portion 119. Preferably, the mountable shelf 320 may be supported on the first chamber rear surface 113 when in use and directed toward the inlet 139 in parallel with the first chamber top surface. In this case, because the dividing portion 119 may interfere with the mountable shelf 320, the dividing portion 119 may not exist.

Referring to (a) in FIG. 37, the mountable shelf 320 may be suspended by a plurality of shelf fixing clips 327 located on the side surfaces 114 and 115 of the first chamber. Alternatively, the mountable shelf 320 may be separately disposed outside. In order to use the mountable shelf 320, the user may pivot the mountable shelf 320 and fix the shelf 320 to the plurality of shelf fixing clips 327. Referring to (b) in FIG. 37, because the mountable shelf 320 is parallel to the first chamber top surface 112, the object-to-be-dried may be mounted on the mountable shelf 320.

To this end, the laundry treating apparatus 1000 may include the plurality of shelf fixing clips 327 arranged on one of inner surfaces of the first chamber 110, and the at least one mountable shelf 320 that is fixed to at least one of the plurality of shelf fixing clips 327 and supports the object-to-be-dried.

Referring to (a) in FIG. 37, the plurality of shelf fixing clips 327 are arranged at fixed positions preset on the first chamber rear surface 113. The shelf fixing clip 327 has a structure that may support the mountable shelf 320 even when only one end of the mountable shelf 320 is fixed.

(a) in FIG. 37 shows an example in which 9 shelf fixing clips are arranged. The mountable shelf 320 may be fixed in 6 mounting areas J1 to J6 via the 9 shelf fixing clips. The number of shelf fixing clips and the number of mounting areas vary depending on a design, and (a) in FIG. 37 is merely an example. The number of shelf fixing clips and the number of mounting areas are not limited to those shown in (a) in FIG. 37.

In addition, the mountable shelf 320 may be mounted by two adjacent shelf fixing clips located at the same vertical level among the plurality of shelf fixing clips 327.

Referring to (a) in FIG. 37, 6 mountable shelves may be mounted in 6 mounting areas. In (a) in FIG. 37, three mountable shelves 321, 323, and 324 are currently mounted in parallel with the first chamber rear surface 113. (b) in FIG. 37 is a view showing a state in which the user has mounted one mountable shelf 322 in one mounting area J4 perpendicular to the first chamber rear surface 113 or parallel to the first chamber top surface 112. This will allow the object-to-be-dried to be placed on the one mountable shelf 322.

The user may also move some of the currently mounted mountable shelves 321, 322, 323, and 324 to desired positions by detaching the same for use in other mounting areas J5 and J6.

Referring to (a) in FIG. 38, each of the one or more mountable shelf 320*s* may include a plurality of support bars 3215 arranged at preset spacings, and a first coupling bar 3211 and a second coupling bar 3212 that are vertically coupled to the plurality of support bars 3215 so as to be closer to one end than the other end of the support bar 3215, and the first coupling bar 3211 may be coupled to the plurality of support bars 3215 closer to one end of the support bar 3215 than the second coupling bar 3212.

When the at least one mountable shelf 320 is mounted in parallel with the first chamber top surface 112 via the shelf fixing clips 327 for use, the first coupling bar 3211 will be located closer to the first chamber rear surface 113 than the second coupling bar 3212.

As shown in (a) in FIG. 38, when mounting the mountable shelf 320 in parallel with the first chamber top surface 112 via the shelf fixing clips 327, the first coupling bar 3211 and the second coupling bar 3212 will be inserted into the shelf fixing clip 327 and fixed by the shelf fixing clip 327. When fixing only one end of the mountable shelf 320 as described above, because a moment is applied caused by weights of the mountable shelf 320 and the object-to-be-dried to be placed on the mountable shelf 320, the first coupling bar 3211 and the second coupling bar 3212 will rotate around the shelf fixing clip 327.

Referring to (a) and (b) in FIG. 38, the first coupling bar 3211 and the second coupling bar 3212 may be simultaneously inserted into the shelf fixing clip 327 through a clip opening 3272 of the shelf fixing clip 327. Accordingly, during the rotation, the first coupling bar 3211 may be supported by an upper support body 3271*a* of the clip body 3271, and the second coupling bar 3212 may be supported by a lower support body 3271*b* of the clip body 3271. Accordingly, the rotation of the first coupling bar 3211 and the second coupling bar 3212 may be prevented, and the mountable shelf 320 may be disposed perpendicular to the first chamber rear surface.

Referring to (b) in FIG. 38, each of the plurality of shelf fixing clips 327 includes a clip body 3271 forming an outer shape thereof, a clip through-hole 3273 defined through the clip body 3271 in a direction parallel to the first chamber top surface 112, a clip opening 3272 defined as a portion of a surface facing the first chamber top surface 112 among outer surfaces of the clip body 3271 is opened, and connected to the clip through-hole 3273, and a center dividing portion 3274 protruding from an inner circumferential surface of the clip through-hole 3273 and extending inwardly of the inner circumferential surface of the clip through-hole 3273.

The plurality of shelf fixing clips 327 require at least two shelf fixing clips 327 for the one mountable shelf 320 using both ends of the first coupling bar 3211 and the second coupling bar 3212.

When two shelf fixing clips are used for each mountable shelf for such reason, the space will not be efficiently used. In addition, when the two shelf fixing clips are used for each mountable shelf, shaking of the first coupling bar 3211 or the second coupling bar 3212 in a horizontal direction will not be able to be prevented.

In order to solve such problem, each of the plurality of shelf fixing clips 327 may include the center dividing portion 3274 protruding from the inner circumferential surface of the clip through-hole 3273 and extending inwardly of the inner circumferential surface of the clip through-hole 3273.

That is, the center dividing portion 3274 may divide the inner circumferential surface of the clip through-hole 3273 into a first installation portion 3274*a* and a second installation portion 3274*b* in which one or more different mountable shelves 320 are installed, respectively.

Therefore, the three shelf fixing clips may support the two mountable shelves because of the first installation portion 3274*a* and the second installation portion 3274*b* separated from each other by the center dividing portion 3274, and the mountable shelf 320 may be prevented from shaking in the direction parallel to the coupling bar 3211 and the second coupling bar 3212 by the center dividing portion 3274.

Accordingly, the number of plurality of shelf fixing clips 327 in the laundry treating apparatus may be greater than the number of one or more mountable shelves 320 mounted on the plurality of shelf fixing clips 327.

In addition, the at least two of the plurality of shelf fixing clips 327 for mounting the at least one mountable shelf 320 may be located at the same vertical level on one side surface of the first chamber 110.

Therefore, when one of the one or more mountable shelves 320 is installed in the direction parallel to the first chamber top surface 112 to support the object-to-be-dried, one end of each of the first coupling bar 3211 and the second coupling bar 3212 will be located in the first installation portion of one of the plurality of shelf fixing clips 327, and the other end of each of the first coupling bar 3211 and the second coupling bar 3212 will be located in the second installation portion of another shelf fixing clip located at the same vertical level as the one shelf fixing clip of the plurality of shelf fixing clips 327.

Alternatively, one end of each of the first coupling bar 3211 and the second coupling bar 3212 will be located in the second installation portion of one of the plurality of shelf fixing clips 327, and the other end of each of the first coupling bar 3211 and the second coupling bar 3212 will be located in the first installation portion of another shelf fixing clip located at the same vertical level as the one shelf fixing clip of the plurality of shelf fixing clips 327.

In one example, when mounting the at least one mountable shelf 320 on the plurality of shelf fixing clips 327 parallel to the first direction, the first coupling bar 3211 may be located inside the plurality of shelf fixing clips 327, and the second coupling bar 3212 may be located outside the plurality of shelf fixing clips 327. Therefore, only the first coupling bar 3211 may be located inside the shelf fixing clip 327.

That is, the first coupling bar 3211 may be located inside one of the plurality of shelf fixing clips 327 and another shelf fixing clip located at the same vertical level as the one shelf fixing clip, and the second coupling bar 3212 may be located outside said one shelf fixing clip and said another shelf fixing clip of the plurality of shelf fixing clips 327.

Even in this case, the mountable shelf 320 may be prevented from shaking in the direction parallel to the first coupling bar 3211 by the center dividing portion 3274.

(a) to (d) in FIG. 39 show various embodiments of the mountable shelf 320.

(a) in FIG. 39 shows a state in which each two of four mountable shelves 321, 322, 323, and 324 are positioned at the same vertical level, and the four mountable shelves 321, 322, 323, and 324 are mounted on the plurality of shelf fixing clips 327 arranged on the first chamber rear surface 113.

The plurality of shelf fixing clips 327 may be located at three different vertical levels C1, C2, and C3 on the first chamber rear surface so as to mount the four mountable shelves 321, 322, 323, and 324 in up to 4 out of 6 different areas.

(b) in FIG. 39 shows a state in which two mountable shelves 325 and 326 are arranged in different areas. Because a width of the two hanging mountable shelves 325 and 326 is greater than a width of the mountable shelf shown in (a)

in FIG. 39, two shelf fixing clips rather than three shelf fixing clips are arranged at one vertical level.

(c) in FIG. 39 shows a state in which one mountable shelf 3251 is mounted. The shelf fixing clips are positioned at two different vertical levels C4 and C5, so that one mountable shelf 3251 may be positioned in one of two different areas.

(d) in FIG. 39 shows a state in which two mountable shelves 328 and 329 are arranged at the same vertical level. The two mountable shelves 328 and 329 may be fixed without shaking in the width direction of the cabinet 130 by means of three shelf fixing clips.

Such various layouts of the mountable shelf 320 may vary depending on a length of the first coupling bar 3211 and the second coupling bar 3212, the number and arrangement of plurality of shelf fixing clips 327, and the number of mountable shelves 320.

(a) to (e) in FIG. 40 show steps of installing or removing the mountable shelf 320 for use.

(a) in FIG. 40 shows an example in which the user stores the mountable shelf 320 inside the first chamber 110 without using the same in normal days. That is, the mountable shelf 320 is mounted in parallel with one side surface of the first chamber or the second direction.

The first coupling bar 3211 may be located inside at least two shelf fixing clips 327 adjacent to each other at the same vertical level among the plurality of shelf fixing clips 327, and the second coupling bar 3212 may be located outside the at least two shelf fixing clips 327. In this regard, because the mountable shelf 320 pivots around the at least two shelf fixing clips 327 on which the mountable shelf 320 is mounted, the mountable shelf 320 will naturally hang in a direction of gravity.

(b) to (d) in FIG. 40 show a state in which the user pivots the mountable shelf 320 around the first coupling bar 3211 in order to use the mountable shelf 320 step by step. (d) in FIG. 40 shows a state in which the mountable shelf 320 is pivoted and lifted upwards by an angle greater than an angle of the direction parallel to the first chamber top surface 112 in order to insert the second coupling bar 3212 into the shelf fixing clip 327 through the clip opening 3272. Thereafter, when the user inserts the second coupling bar 3212 into the two shelf fixing clips 327, the mountable shelf 320 may be directed in the direction parallel to the first chamber top surface 112 by the shelf fixing clips 327 to support the object-to-be-dried.

The to-be-dried object as a concept including the laundry refers to an object or the like that is not able to be hanged on the hanger assembly or is damaged when being hanged on the hanger assembly. For example, there are the hat, a scarf, the doll, and the like. The laundry treating apparatus 1000 may be utilized as the user arranges the mountable shelf 320 in various ways based on sizes of such objects-to-be-dried.

In addition, because the mountable shelf 320 is directed in a direction of the shelf fixing clip 327 to which both the first coupling bar 3211 and the second coupling bar 3212 are to be coupled, one end of each of the plurality of support bars 3215 is blocked by the coupling bar 3211 and the second coupling bar 3212 vertically coupled to the plurality of support bars, but the other end of each of the plurality of support bars 3215 is opened. Therefore, the hat and the like may be hanged on the plurality of support bars 3215.

To this end, a length along the second direction of the plurality of support bars 3215 may be smaller than a depth along the second direction of the first chamber.

A method for removing the mountable shelf 320 will be performed in a reverse order of (a) to (e) in FIG. 40.

When the laundry treating apparatus 1000 includes the dividing portion 119, there is a problem in that a member having a complicated structure is not able to be disposed on the main door inner surface 201. This is because, even when the dividing portion 119 includes the front gasket 1192*a*, when the member having the complex structure is located on the main door inner surface 201, the accommodation spaces are not able to be sealed from each other.

Therefore, the conventional laundry treating apparatus 1 is not able to locate a member such as the pressor (or the pants presser) for removing wrinkles of the pants and making an intended crease of the pants more clear and prominent on the main door inner surface 201.

In order to solve such problem, the laundry treating apparatus 1000, which is the present disclosure, may accommodate the pressor 400 inside the main door 200.

(a) to (c) in FIG. 41 show an example in which the pressor 400 for removing the wrinkles of the laundry is accommodated inside the main door 200.

Referring to (a) and (b) in FIG. 41, the main door 200 may include a door body 215 including a door inlet 217 defined in one surface thereof, and an auxiliary door 210 that defines an inner space of the door together with and the door body 215, and opens and closes at least a portion of the door body 215 including the door inlet 217.

(b) in FIG. 41 shows an example in which the auxiliary door 210 opens and closes an entirety of a front surface of the door body 215, but it is not necessary to open and close a portion where the water supply tank 810 and the drain tank 820 are located, so that the auxiliary door 210 may open and close only a portion of the door body 215.

The pressor 400 may include a base 420 disposed on the door body 215, and pressing means 410 disposed on an auxiliary door inner surface 211 of the auxiliary door 210 facing the door inlet 217. However, alternatively, the pressing means 410 may be positioned on the door body 215, and the base 420 may be positioned on the auxiliary door inner surface 211.

The pressing means 410 may be coupled to one side surface of the base 420 in a hinge manner and pivot.

The base 420 may include a base plate 286 for supporting the laundry, a plurality of base plate through-holes 422 defined through the base plate 286, and a base plate depression 425 defined between both of side surfaces of the base plate 286 and depressed along the first direction.

In addition, the pressor 400 may further include a laundry hanging clip 285 for hanging the laundry. The laundry hanging clip 285 may be located on the base 420 or the pressing means 410.

When the laundry hanging clip 285 is located at an upper portion of the base 420, a pressing plate cutout 112*a* corresponding to the position of the laundry hanging clip 285 and defining a depression by cutting the pressing plate 288 may be located at the upper portion of the pressing means 410.

This is to prevent damage to the laundry hanging clip 285 when the auxiliary door 210 is closed in consideration of a size of the laundry hanging clip 285.

The base plate 286 may not be formed in a planar shape, and may include the base plate depression 425 defined as a center of the base plate 286 is depressed along the first direction. That is, the base plate 286 may be formed in a shape including wings on both sides of the base plate depression 425 as a center. This is to prevent interference with a seam of the pants legs when the laundry, such as the pants, are mounted by the laundry hanging clip 285.

In addition, the base plate depression 425 may include the plurality of base plate through-holes 422 for supplying hot air and steam. The door body 215 and the base 420 may be spaced apart from each other without being in close contact with each other. This is to allow hot air and/or steam to be supplied to the laundry through the base plate through-holes 422 as hot air and steam are supplied to a space between the door body 215 and the base 420.

The base plate depression 425 will prevent a phenomenon in which the laundry is in close contact with the plurality of base plate through-holes 422 and closes the plurality of base plate through-holes 422, and thus, results in blocking of supply of hot air and/or steam or damage to the laundry.

Alternatively, hot air and/or steam may be supplied through a separate passage from below the base 420.

The auxiliary door 210 may include the pressing means 410 disposed on the auxiliary door inner surface 211. Preferably, the auxiliary door inner surface 211 may include a depressed inner surface 213 defined as a portion thereof corresponding to the base 420 is depressed, and the pressing means 410 may be disposed on the depressed inner surface 213.

In addition, the pressing means 410 may include the plate-shaped pressing plate 288, and a pressing plate depression 413 defined as a portion corresponding to the base plate depression 425 is depressed in the first direction. This is to avoid the seam.

The auxiliary door 210 and the door body 215 may be coupled to each other in a hook manner. To this end, an auxiliary door hook 218 may protrude from one side of the auxiliary door inner surface 211, and the door body 215 may include an auxiliary door coupling portion 219 to which the auxiliary door hook 218 is inserted and coupled at a position where the auxiliary door hook 218 is coupled.

A length of the pressing plate 288 along the first direction may be smaller than a length of the base plate 286. This is because a portion that is pressurized of the pants is the leg portion, and a body portion, including a waist portion, does not need to be ironed due to pockets and various accessories and might be damaged when being pressed.

The pants will be hanged upside down with a hem of the legs fixed by the laundry hanging clip 285.

In addition, the base 420 may further include a laundry fixing clip 450 at a lower portion of the base 420 for preventing the waist portion of the pants from shaking in a left and right direction.

(c) in FIG. 41 shows an example of the main door 200 when the main door 200 instead of the auxiliary door 210 is opened. In particular, (c) in FIG. 41 shows an example in which the vertical level of the bottom surface of the first chamber is constant and there is no dividing portion 119.

Accordingly, the laundry treating apparatus 1000 may include the mountable shelf 320 located inside the first chamber 110, and may include a hanger clip 226 capable of mounting the laundry on the main door inner surface 201.

In order to supply hot air, aroma, and/or steam to the pressor 400 located inside the main door 200, there may be a need for a passage through which air, aroma, and/or steam supplied from the air supply means 150, the aromatizing means 750, and the steam supply 160 are introduced into the main door 200.

Referring to (a) in FIG. 42, air supplied from the air supply means 150 will rise to the upper portion of the first chamber 110. This is because high-temperature air has a relatively high density and is able to be forced to circulate by the circulating fan 715.

Air that has risen to the upper portion of the first chamber will switch a direction thereof by the top surface of the first chamber and move towards the main door 200. The door inclined portion 240 of the main door 200 may include a door upper communication port 2401 positioned at an upper portion thereof and in communication with the interior of the main door 200. Air will be introduced into the main door 200 through the door upper communication port 2401. Air will move downwards inside the main door 200. In addition, air introduced into the main door 200 will be discharged to the first chamber 110 through a door lower communication port 2303 that is located on one side surface or at a lower portion of the main liner 2301 and is in communication with the interior of the main door 200.

In particular, after being introduced to the space between the first chamber top surface 112 and the top panel 132, air may be introduced into the main door 200 through the door upper communication port 2401. To this end, a portion of the first chamber top surface 112 may be formed in a shape of a louver.

This is merely another embodiment for the air circulation, and air may be circulated even through a different movement path.

Therefore, air may circulate not only in the first chamber 110 but also inside the main door 200. Aroma and/or steam may also be circulated similarly to air.

Referring to (b) in FIG. 42, the laundry treating apparatus 1000 may circulate air outside the laundry treating apparatus 1000 even when the main door 200 is closed so as to remove the fine dust from the outside air or dehumidify the outside air.

The laundry treating apparatus 1000 may include an outside communication hole 1367 positioned at a bottom of the main door 200 to suck the outside air into the blower unit 700. In addition, the blower unit 700 may include an outside communication flip **1367*a* capable of sucking the sucked external air into the circulating duct 710**.

Therefore, the laundry treating apparatus 1000 may suck the outside air into the circulating duct 710, remove the fine dust from the sucked air via the filter 718 and the heat exchange means 740, dehumidify the air, and then discharge the dehumidified air to the outside.

The filter 718 may be formed as a HEPA filter.

To this end, the laundry treating apparatus 1000 may further include an outside communication flip 250 positioned on a front surface of the main door 200 and in communication with the inside of the main door 200, and a lower communication flip 2305 that closes the door lower communication port 2303. This is for discharging the air moving inside the main door 200 to the outside.

FIG. 43 shows an example in which the auxiliary door 210 for accessing the pressor 400 accommodated inside the main door 200 is located on the inner surface of the main door. FIG. 44 shows a case in which the auxiliary door 210 for accessing the pressor 400 accommodated inside the main door is a portion of the front surface of the main door 200.

That is, as long as the pressor 400 may be located inside the main door, the auxiliary door 210 may be located at any location and open in any direction. In addition, the pressor may be located on one of both of the side surfaces 114 and 115 of the first chamber, not inside the main door 200. Preferably, in order to avoid the interference with the dividing portion 119, the pressor may be located on one side surface of the first chamber 110 connected to the second surface 1112 on which the dividing portion 119 does not move.

(a) and (b) in FIG. 45 schematically show the hanger bar 64 of the conventional laundry treating apparatus and the hanger assembly of the laundry treating apparatus described in the present disclosure.

Referring to (a) in FIG. 45, the hanger bar 64 of the conventional laundry treating apparatus is only capable of reciprocating along the third direction at the fixed position. In addition, the hanger groove 65 for hanging the clothes hanger may be located in the hanger bar 64 extending long along the third direction. Because a spacing between the hanger grooves 65 is also fixed, a position for hanging the clothes hanger is fixed, and a spacing between two clothes is not able to be reduced to a spacing smaller than the spacing between the hanger grooves 65. In addition, in order to increase the spacing between the two clothes, the hanger groove 65 must be skipped, so that the clothes are not able to be hanged to the maximum.

In (b) in FIG. 45, as described above, the laundry treating apparatus 1000 described in the present disclosure includes the plurality of independent hangers 610, so that the interference with the dividing portion may be avoided. This may be achieved via the hanger arranging portion 510. In addition, the plurality of hangers 610 may collectively reciprocate via the reciprocating portion 520. When the main door 200 is opened, the plurality of hangers may be moved in the direction closer to the inlet 139.

In addition, each of the plurality of hangers 610 may include the hanger body 681 that is inserted into the first chamber 110 through each of the plurality of cutout holes 1121 and protrudes, and the hanger hooks 682 arranged on both sides of the hanger body 681 along the third direction.

The hanger hooks 682 may have two hanger hook grooves 683, so that the clothes hangers may be mounted in the hanger hook grooves 683.

Therefore, when there are the hangers of the number the same as the number of hanger grooves 65 of the conventional laundry treating apparatus, an amount of laundry that may be accommodated will be doubled. The case in which the hanger hooks 682 are arranged on both sides of the independent hanger is referred to as a dual hanger.

In addition, in order for the user to mount the laundry in the hanger groove 65, the user must ensure that the laundry goes over the hanger bar 64 extending long along the third direction. This may cause great inconvenience depending on the user. On the contrary, because the laundry treating apparatus 1000 described in the present disclosure has the plurality of hangers 610 all independently, access through empty spaces on both sides of one hanger is available (see arrows in (b) in FIG. 45).

In addition, because the hanger hooks 682 are arranged on both sides of the hanger, the user may use both hands. That is, the plurality of hangers 610 may be conveniently used regardless of whether the user is right-handed or left-handed.

In addition, in the case of the dual hanger, there is an advantage that the user may select the spacing between the hangers on which the clothes are hanged based on a thickness of the clothes.

When performing care of clothes with relatively small thickness, such as a dress shirt, both of the hanger hooks 682 arranged on both of the sides of the independent hanger may be used. In addition, when there is a jumper with a great thickness, a spacing between the jumper and another clothes may be adjusted using hanger hooks 682 located on farther sides of respective hangers adjacent to each other, instead of skipping the hanger groove 65 like the conventional laundry treating apparatus.

Referring to (a) in FIG. 46, each of the plurality of hangers 610 may include a hanger support body 6811 having one end inserted into one cutout hole 1121 of the plurality of cutout holes 1121 and positioned between the top panel 132 and the first chamber top surface 112, and the other end located inside the first chamber 110, and the hanger hooks 682 positioned close to the other end of the hanger support body 6811 and arranged on both side surfaces of the hanger support body 6811 to mount the clothes hangers.

One end of the hanger support body 6811 may be inserted into the pivoting support frame 632 and pivotably coupled to the pivoting support frame 632. To this end, the hanger support body 6811 may include a hanger support body through-hole 6812 defined through the hanger support body along the third direction closer to the one end than the other end of the hanger support body.

That is, in order for the hanger arranging portion 510 to be connected to the hanger to be pivoted, each of the arranging motor rotation shafts 5111*a*, 5111*b*, and 5111*c* included each of the one or more arranging motors 5111, 5112, and 5113 may be coupled to the hanger inserted into the pivoting support frame 632 through one surface of the pivoting support frame 632 along the second direction. Accordingly, each of the arranging motor rotation shafts 5111*a*, 5111*b*, and 5111*c* may extend through and be coupled to the hanger support body through-hole 6812.

Accordingly, the arranging motor rotation shaft may rotate with the hanger support body through-hole 6812.

The hanger support body 6811 may be formed such that a length thereof along the first direction is greater than a length thereof along the third direction or the second direction. In addition, the hanger support body 6811 may be formed such that the length thereof along the second direction is greater than the length thereof along the third direction.

The hanger hooks 682 may include a first hanger hook body 6821 and a second hanger hook body 6825 coupled to both sides of the hanger support body 6811, respectively. Each of the first hanger hook body 6821 and the second hanger hook body 6825 may include a connecting hanger body 6822 coupled to the hanger support body 6811, a fixed hanger body 6824 disposed to face the connecting hanger body 6822, and a bent hanger body 6823 that connects the fixed hanger body 6824 and the connecting hanger body 6822 to each other such that the first hanger hook body 6821 is opened toward the first chamber top surface 112.

In (a) and (b) in FIG. 46, in the hanger hook 682, a length of the connecting hanger body 6822 along the first direction may be greater than a length of the fixed hanger body 6824 along the first direction. Therefore, the connecting hanger body 6822 may further include an inclined surface 6821*a* formed as a surface located on an opposite side of a surface of the connecting hanger body 6822 coupled to the hanger support body 6811 is inclined toward the bent hanger body 6823.

In order to hang the laundry on one of the plurality of hangers 610, the user may access a space between the one hanger and a hanger adjacent to the one hanger. In this regard, when the user approaches the inclined surface 6821*a* without being required to accurately access the hanger hook 682 disposed in the one hanger, the clothes hanger may be guided naturally to the hanger hook groove 683. In other words, there is no need for the user to pay attention when hanging the clothes hanger.

FIG. 47 shows another embodiment of the plurality of hangers 610. Each of the plurality of hangers of said another embodiment may define the hanger hook groove with a bent hanger body 6842 and a fixed hanger body 6844 directly without a connecting hanger body coupled to a hanger support body 6843. Therefore, a line (see a line with a medium thickness) leading to the bent hanger body 6842 from the hanger support body 6843 may be bent almost vertically.

However, because an inner surface of the fixed hanger body 6844 is curved, the clothes hanger may be guided to the hanger hook groove 683.

That is, the hanger hook may be formed in another shape as long as it may hang the clothes hanger by defining the hanger hook groove that is opened toward the first chamber top surface.

(a) and (b) in FIG. 48 show a clothes hanger unit 370 that may be mounted on the hanger hook 682. The laundry treating apparatus 1000 may further include at least one clothes hanger unit 370 detachable from the plurality of hangers 610.

The at least one clothes hanger unit 370 may include a clothes hanger hook 374 in a form of a hook with a portion thereof opened, and a clothes hanger body 371 connected to one end of the clothes hanger hook 374 and hanging the laundry thereon in order to hang the laundry on one of the plurality of hangers.

The clothes hanger body 371 may be inclined downwards toward both sides of the clothes hanger body 371 from the clothes hanger hook 374 in order to correspond to shoulder portions where the laundry is hanged.

The clothes hanger unit 370 may further include a body cover 379 coupled to a bottom surface of the clothes hanger body 371. The body cover 379 may also be inclined downwards toward both of the sides of the clothes hanger body 371. In addition, the clothes hanger unit 370 may further include a connecting rod 377 extending at a lower portion of the clothes hanger body 371 in a direction parallel to the clothes hanger body 371 and connecting one side and the other side of the lower portion of the clothes hanger body 371 to each other.

The connecting rod 377 may be connected to connecting rod supports 378 respectively formed to protrude from both of the sides of the body cover 379.

One or more sliding clips 3771 and 3772 slidable along the connecting rod may be positioned on the connecting rod 377. This is to hang the top on the clothes hanger body, or to hang the bottom using the sliding clips 3771 and 3772.

A first strap groove 3711 and a second strap groove 3712 in which both shoulder straps of a dress may be mounted may be defined at shoulder portions of the clothes hanger body 371.

In addition, referring to (a) in FIG. 49, rubber pads 3713 and 3714 made of a polymer material such as rubber may be positioned at the shoulder portions of the clothes hanger body 371 so as to prevent the laundry from slipping down.

(a) in FIG. 49 is an exploded view of the clothes hanger unit. The at least one clothes hanger unit 370 may include the clothes hanger hook 374 in the form of the hook with the portion thereof opened, and the clothes hanger body 371 connected to one end of the clothes hanger hook 374 and hanging the laundry thereon in order to hang the laundry on one of the plurality of hangers.

The clothes hanger body 371 may include a hook rotation guide 373 coupled to the clothes hanger hook 374 and moving the clothes hanger hook 374, and a guide connecting portion 372 that accommodates the hook rotation guide 373 therein and connects the clothes hanger hook 374 and the clothes hanger body 371 to each other.

The clothes hanger hook 374 may include a hook opening 3741 in which the portion of the hook shape is opened. One end of the clothes hanger hook 374 may be coupled to the hook rotation guide 373.

Specifically, the clothes hanger hook 374 may be connected to the hook rotation guide 373 via a clothes hanger hook cap 375 through a hook coupling opening hole **3729*b* that extends through the guide connecting portion 372** along the first direction.

The hook rotation guide 373 may include a guide protrusion 3723 formed to protrude in a radial direction of the hook coupling opening hole. The guide protrusion 3723 serves to rotate and fix the clothes hanger hook 374.

In addition, the hook rotation guide 373 may be accommodated inside the guide connecting portion 372.

Referring to (b) in FIG. 49, the guide connecting portion 372 may include a hook coupling opening hole **3729*b* located in a surface facing the clothes hanger hook 374, a guide accommodating opening 3729*a* located in a surface facing the clothes hanger body 371, and a guide accommodating portion 3729 for accommodating the hook rotation guide 373 therein through the guide accommodating opening 3729*a***.

The guide accommodating portion 3729 may be defined by extending through the guide connecting portion 372 along the first direction via the hook coupling opening hole **3729*b* and the guide accommodating opening 3729*a***.

The guide accommodating portion 3729 may include a first inner surface of inner surfaces of the guide accommodating portion 3729 adjacent to the guide accommodating opening **3729*a*, a second inner surface 3727*b* of the inner surfaces of the guide accommodating portion 3729 formed with a smaller diameter than the first inner surface 3727*a*, and a stepped surface 3727*c* for connecting the first inner surface 3727*a* and the second inner surface 3727*b*** to each other.

The second inner surface **3727*b* may have at least two guide grooves into which the guide protrusions 3723 may be inserted. (b) in FIG. 49** shows that three guide grooves are defined.

That is, the second inner surface **3727*b* may include a first guide groove 3726*a* and a second guide groove 3726*b* in which the second inner surface is defined in a groove shape along the first direction such that the guide protrusions 3723 may be inserted thereinto. (b) in FIG. 49 also additionally shows a third guide groove 3726*c***.

The hook rotation guide 373, specifically, the guide protrusion 3723 may be located in each of the first guide groove **3726*a* and the second guide groove 3726*b*, and may move to the first guide groove 3726*a* or the second guide groove 3726*b* via the stepped surface positioned between the first guide groove 3726*a* and the second guide groove 3726*b***.

Accordingly, when the hook rotation guide 373 moves via the stepped surface positioned between the first guide groove **3726*a* and the second guide groove 3726*b*, the clothes hanger hook 374** will rotate relative to the clothes hanger body.

In addition, when the hook rotation guide 373 is positioned in one of the first guide groove **3726*a* and the second guide groove 3726*b*, the clothes hanger hook 374 will be prevented from rotating with respect to the clothes hanger body 371** and will be fixed.

The guide connecting portion 372 may further include the guide protrusion 3723 protruding toward the clothes hanger body 371 from a surface thereof coupled to the clothes hanger body 371. In addition, the clothes hanger body 371 may include a body coupling groove 3719, which is defined as a portion of the clothes hanger body 371 to which the guide protrusion 3723 is coupled is depressed, to correspond to the guide protrusion 3723. When the guide connecting portion 372 and the clothes hanger body are coupled to each other, the guide protrusion 3723 will be inserted into the body coupling groove 3719.

This is to prevent the guide connecting portion 372 from rotating together when rotating the clothes hanger hook 374, and to further strengthen the coupling between the guide connecting portion 372 and the clothes hanger body 371.

The clothes hanger unit 370 may further include a hook elastic member 3721 positioned between the hook rotation guide 373 and the clothes hanger body 371 and elastically supporting the hook rotation guide.

This is to provide an elastic force to push the clothes hanger hook 374 came out of one of the first guide groove 3726*a* and the second guide groove 3726*b* into the other after the rotation.

The clothes hanger unit 370 may further include an elastic member support 3722 for supporting the hook elastic member 3721. The elastic member support 3722 may include a hook coupling groove 634 with one surface opened, and the hook elastic member 3721 may be inserted into the hook coupling groove 634.

The clothes hanger body 371 may further include a body opening 371*a* in communication with the guide accommodating opening 3729*a* and into which the elastic member support 3722 is inserted.

In order to prevent the elastic member support 3722 from rotating during the rotation of the clothes hanger hook 374, when a portion of an outer surface of the elastic member support 3722 is able to be formed in a protruding shape, the body opening 371*a* is also able to be formed in a shape corresponding to the same.

(a) to (c) in FIG. 50 show an example of use of the clothes hanger unit 370. In general, similarly to (a) in FIG. 50, the clothes hanger unit 370 may be mounted on any one hanger in a direction AR1 parallel to the second direction.

When the shoulder width of the clothes is greater than a depth of the first chamber 110, it is impossible to accommodate the clothes as shown in (a) in FIG. 50. In this case, after rotating the clothes hanger hook 374 of the clothes hanger unit 370 in a direction AR2 inclined with respect to the second direction, the clothes may be accommodated in the first chamber as shown in (b) in FIG. 50.

In addition, in order to maintain the spacing between the clothes, other clothes may be hanged on the hanger assembly 600 after rotating the clothes hanger hook 374 in the direction inclined with respect to the second direction as shown in (c) in FIG. 50.

When a general clothes hanger is rotated and mounted as above, during the reciprocating motion of the hanger assembly 600, the hook is not fixed due to vibration of the hanger assembly 600, so that the clothes hanger hook 374 and the clothes hanger body 371 may move individually without maintaining a rotation angle therebetween.

To prevent such problem, the clothes hanger unit 370 may include the first guide groove 3726*a* and the second guide groove 3726*b* into which the guide protrusions 3723 of the hook rotation guide 373 are inserted.

(a) to (c) in FIG. 51 show an example of a method for rotating and fixing the clothes hanger hook 374 step-by-step. The guide accommodating portion 3729 has the first guide groove 3726*a*, the second guide groove 3726*b*, and the third guide groove 3726*c* into which the guide protrusions 3723 may be inserted.

Referring to (a) in FIG. 51, a state in which the guide protrusion 3723 comes out of the second guide groove 3726*b* is shown. When the user pushes the clothes hanger hook 374, the hook rotation guide 373 will come out of the second guide groove 3726*b*.

A force to push the clothes hanger hook 374 will have to be greater than an elastic force of the hook elastic member 3721.

Referring to (b) in FIG. 51, the user may rotate the clothes hanger hook 374 in one of a clockwise direction and a counterclockwise direction after the guide protrusion 3723 comes out of the first guide groove 3726*a*. In this regard, the guide protrusion 3723 will move along the stepped surface 3727*c*.

In addition, as the clothes hanger hook 374 rotates in the clockwise or counterclockwise direction, the guide protrusion 3723 will meet the first guide groove 3726*a* or the third guide groove 3726*c*.

Because the hook elastic member 3721 provides the elastic force to the hook rotation guide 373, the guide protrusion 3723 may be inserted into one of the first guide groove 3726*a* and the third guide groove 3726*c*.

(c) in FIG. 51 shows the guide protrusion 3723 inserted into the first guide groove 3726*a* by the hook elastic member 3721.

When the clothes hanger hook 374 is positioned in parallel with the clothes hanger body, the guide protrusion 3723 may be positioned in the second guide groove 3726*b*. In addition, as the user rotates the clothes hanger hook 374 in the clockwise or counterclockwise direction, the guide protrusion 3723 will be positioned in the first guide groove 3726*a* and the third guide groove 3726*c*.

When the guide protrusion 3723 is inserted into and located in the three guide grooves 3726*a*, 3726*b*, and 2736*c*, further rotation thereof is prevented, so that, even when the hanger assembly 600 reciprocates, the clothes hanger hook 374 may be prevented from arbitrarily rotating with respect to the clothes hanger body 371.

This is only an example, and more guide grooves may be defined to rotate the clothes hanger hook 374 at various angles. However, at least two guide grooves must be defined top realize the case in which the clothes hanger hook 374 is directed in parallel with the clothes hanger body 371 and the case in which the clothes hanger hook 374 is rotated so as to have a different angle with respect to the clothes hanger body 371.

FIG. 52 shows an example in which the guide protrusion 3723 is inserted into the first guide groove 3726*a*. When the clothes is hanged on the clothes hanger unit 370, the clothes hanger body 371 will receive a force in a downward direction by a weight of the clothes. On the other hand, because the hook rotation guide 373 is inserted into the guide grooves 3726*a*, 3726*b*, and 2736*c*, as the guide connecting portion 372 of the clothes hanger body 371 receives the force in the downward direction, rather, the hook rotation guide 373 is inserted into the guide grooves 3726*a*, 3726*b*, and 2736*c* and receives a force in an upward direction, so that the clothes hanger hook 374 may be fixed more stably.

(a) in FIG. 53 shows an example of an opening defined in a hook of a clothes hanger included in a conventional laundry treating apparatus. In the case of the conventional clothes hanger, a size N1 of the opening was measured between the hook and a protruding clothes hanger body SA1 corresponding to a neck of the clothes. In this case, the size N1 of the opening was limited, so that there was a case in which the clothes hanger is caught on the hanger bar when the user mounts the clothes hanger on the hanger bar.

(b) in FIG. 53 shows an example of the hook opening 3741 of the clothes hanger unit 370 described in the present disclosure in order to solve such problem.

That is, the clothes hanger unit 370 may lower a vertical level of both ends SA2 of the guide connecting portion 372 so as to secure a size N2 of the hook opening 3741 as much as possible, so that the user may more conveniently mount the clothes hanger unit 370 on the hanger assembly 600 or remove the clothes hanger unit 370 from the hanger assembly 600.

The present disclosure may be modified and implemented in various forms, so that the scope of rights is not limited to the above-described embodiment. Therefore, when the modified embodiment includes components of the claims of the present disclosure, it should be viewed that the modified embodiment belongs to the scope of the present disclosure.

The invention claimed is:

1. A laundry treating apparatus comprising:

a cabinet defining an inlet;

a top panel that defines a top surface of the cabinet;

a laundry treating chamber positioned inside the cabinet and configured to accommodate therein laundry through the inlet;

a laundry treating chamber top surface that defines a top surface of the laundry treating chamber;

a hanger assembly including a hanger, the hanger being configured to hang the laundry thereon in the laundry treating chamber; and a reciprocating portion spaced apart from the hanger assembly in a first direction or a second direction, wherein the first direction extends along a height of the cabinet, and the second direction extends along a depth of the cabinet, wherein the reciprocating portion is configured to reciprocate the hanger assembly in a third direction that extends along a width of the cabinet, and wherein the reciprocating portion is spaced apart from the hanger assembly in the second direction or the third direction, and the hanger assembly and the reciprocating portion share at least a portion of a height range along the first direction.

2. The laundry treating apparatus of claim 1, wherein the reciprocating portion includes:

a power motor assembly including a power motor rotation shaft assembly that extends in parallel with the first direction, the power motor assembly being configured to rotate the power motor rotation shaft assembly based on a rotating magnetic field, and a moving body coupled to the power motor rotation shaft assembly in a direction parallel to the first direction, the moving body being configured to convert a rotational motion of the power motor assembly into a reciprocating motion along the third direction to thereby reciprocate the hanger assembly in the third direction and in a direction parallel to the second direction.

3. The laundry treating apparatus of claim 1, wherein the hanger assembly further includes a hanger support positioned outside the laundry treating chamber and supporting the hanger, wherein the hanger support and the reciprocating portion are located between the top panel and the laundry treating chamber top surface, wherein the reciprocating portion is configured to reciprocate the hanger support in the third direction.

4. The laundry treating apparatus of claim 3, wherein the hanger support includes:

a hanger support frame supporting the hanger and configured to allow the hanger to rotate relative to the hanger support frame, a hanger supporting stage configured to guide the hanger support frame and the hanger to reciprocate in the third direction and move in the second direction, and a movement guide hole extending through the hanger supporting stage and extending along the second direction.

5. The laundry treating apparatus of claim 4, wherein the reciprocating portion is connected to the hanger supporting stage and configured to reciprocate the hanger supporting stage in the third direction, the reciprocating portion being located farther away from the inlet than the hanger assembly along the second direction.

6. The laundry treating apparatus of claim 4, further comprising:

a transport driver configured to move the hanger support frame in the second direction along the movement guide hole, wherein the transport driver is positioned at the hanger supporting stage between the hanger support frame and at least one of opposite side surfaces of the cabinet.

7. The laundry treating apparatus of claim 4, further comprising:

a dividing portion located inside the laundry treating chamber and dividing the laundry treating chamber into one or more accommodation spaces; and a moving driver configured to move the dividing portion along the third direction inside the laundry treating chamber.

8. The laundry treating apparatus of claim 7, wherein the moving driver is positioned between the hanger supporting stage and at least one of opposite side surfaces of the cabinet.

9. The laundry treating apparatus of claim 1, further comprising:

a cutout extending through the laundry treating chamber top surface in the first direction, wherein the hanger includes a plurality of hangers, and wherein the laundry treating apparatus includes a hanger arranging portion configured to move one or more of the plurality of hangers into or out of the laundry treating chamber via the cutout.

10. The laundry treating apparatus of claim 9, wherein the cutout includes a plurality of cutout holes corresponding to the plurality of hangers, respectively, and wherein the hanger arranging portion is configured to pivot and move the one or more of the plurality of hangers into or out of the laundry treating chamber via one or more of the plurality of cut holes corresponding to the one or more of the plurality of hangers, respectively.

11. The laundry treating apparatus of claim 10, wherein the hanger assembly includes:

a hanger supporting stage located between the laundry treating chamber top surface and the top panel and supporting the plurality of hangers, a plurality of movement guide holes extending through the hanger supporting stage along the second direction and defined along the third direction, wherein the plurality of movement guide holes correspond to the plurality of cutout holes, respectively, and a hanger support frame coupled to the hanger supporting stage and coupled to the plurality of hangers, the plurality of hangers being respectively inserted into the plurality of movement guide holes and the plurality of cutout holes, the plurality of cutout holes respectively facing the plurality of movement guide holes, wherein the hanger arranging portion is coupled to the hanger support frame and configured to pivot one of the plurality of hangers into or out of the laundry treating chamber.

12. The laundry treating apparatus of claim 11, wherein the hanger support frame includes a plurality of pivoting support frames, the plurality of pivoting support frames being respectively positioned above the plurality of movement guide holes and configured to support pivoting of the plurality of hangers, respectively, and wherein the hanger arranging portion is located between adjacent two of the plurality of pivoting support frames.

13. The laundry treating apparatus of claim 11, wherein the hanger arranging portion includes:

an arranging motor assembly including one or more arranging motors, the one or more arranging motors being configured to rotate the one or more of the plurality of hangers, respectively, and an arranging motor rotation shaft assembly including one or more arranging motor rotation shafts that are provided at the one or more arranging motors and configured to rotate, wherein each of the one or more arranging motor rotation shafts is connected to each of the one or more hangers by being inserted into and extending through one or both of opposite surfaces of each of one or more pivoting support frames that receive the one or more of the plurality of hangers, respectively.

14. The laundry treating apparatus of claim 1, wherein the hanger includes a plurality of hangers.

15. The laundry treating apparatus of claim 14, further comprising:

a plurality of cutout holes extending through the laundry treating chamber top surface in the first direction, wherein the hanger assembly includes:

a hanger supporting stage located between the laundry treating chamber top surface and the top panel and configured to support the plurality of hangers, a plurality of movement guide holes extending through the hanger supporting stage along the second direction and defined along the third direction, wherein the plurality of movement guide holes face the plurality of cutout holes, respectively, and a hanger support frame coupled to the hanger supporting stage, wherein the plurality of hangers are coupled to the hanger support frame and configured to move, wherein the reciprocating portion includes:

a power motor assembly configured to generate a rotational force, a power motor rotation shaft assembly disposed inside the power motor assembly and configured to rotate, a power motor support positioned between the laundry treating chamber top surface and the top panel and supporting the power motor assembly, and a moving body configured to convert a rotational motion of the power motor assembly into a reciprocating motion along the first direction and transferring the reciprocating motion to the hanger assembly.

16. The laundry treating apparatus of claim 1, further comprising:

a cutout extending through the laundry treating chamber top surface in the first direction, wherein the hanger includes a plurality of hangers, wherein the cutout includes a plurality of cutout holes respectively corresponding to positions of the plurality of hangers, wherein each of the plurality of cutout holes includes:

a hanger hole portion defined through each of the plurality of cutout holes along the third direction, and a linear hole portion extending vertically from the hanger hole portion in a direction toward the inlet and connected to the hanger hole portion.

17. The laundry treating apparatus of claim 16, further comprising:

a transport driver configured to move the hanger assembly along the linear hole portion.

18. The laundry treating apparatus of claim 9, further comprising:

a main door disposed at the cabinet and configured to rotate to open and close the inlet, wherein the hanger arranging portion is configured to, based on the main door being opened, pivot and move the hanger into or out of the laundry treating chamber.

19. A laundry treating apparatus comprising:

a cabinet defining an inlet;

a laundry treating chamber positioned inside the cabinet and configured to accommodate therein laundry through the inlet;

a laundry treating chamber top surface that defines a top surface of the laundry treating chamber;

a hanger assembly including a hanger configured to hang the laundry thereon in the laundry treating chamber; and a reciprocating portion configured to reciprocate the hanger assembly in a width direction of the cabinet, wherein, based on the hanger assembly and the reciprocating portion being orthogonally projected to the laundry treating chamber top surface along a height direction of the cabinet, the hanger assembly is located at a first position at the laundry treating chamber top surface, and the reciprocating portion is located at a second position different from the first position at the laundry treating chamber top surface, and wherein the reciprocating portion is spaced apart from the hanger assembly in a depth direction of the cabinet or the width direction of the cabinet, and the hanger assembly and the reciprocating portion share at least a portion of a height range along the height direction.

20. A laundry treating apparatus comprising:

a cabinet defining an inlet;

a laundry treating chamber positioned inside the cabinet and configured to accommodate therein laundry through the inlet;

a laundry treating chamber top surface that defines a top surface of the laundry treating chamber;

a hanger assembly including a hanger disposed in parallel with a height direction of the cabinet and configured to mount the laundry thereon in the laundry treating chamber; and a reciprocating portion including:

a power motor assembly configured to generate a rotational force, and a power motor rotation shaft assembly extending in a direction parallel to the hanger and configured to rotate at a center of the power motor assembly, wherein the reciprocating portion is spaced apart from the hanger assembly in a depth direction of the cabinet or a width direction of the cabinet and configured to reciprocate the hanger assembly in the width direction of the cabinet, and wherein the hanger assembly and the reciprocating portion share at least a portion of a height range along the height direction.

* * * * *